US008708152B2

(12) United States Patent
Lehtinen et al.

(10) Patent No.: US 8,708,152 B2
(45) Date of Patent: Apr. 29, 2014

(54) IRON ORE SEPARATION DEVICE

(75) Inventors: Lucas Lehtinen, Chicago, IL (US); Shawn Henriksen, Pengilly, MN (US); David Chappie, Cohasset, MN (US); Travis Edward Cunningham, Ely, MN (US); Danilo Bibancos, Cohasset, MN (US)

(73) Assignee: Magnetation, Inc., Grand Rapids, MN (US)

( * ) Notice: Subject to any disclaimer, the term of this patent is extended or adjusted under 35 U.S.C. 154(b) by 0 days.

(21) Appl. No.: 13/452,420

(22) Filed: Apr. 20, 2012

(65) Prior Publication Data

US 2012/0325726 A1 Dec. 27, 2012

Related U.S. Application Data

(60) Provisional application No. 61/477,590, filed on Apr. 20, 2011.

(51) Int. Cl.
*B03C 1/03* (2006.01)

(52) U.S. Cl.
USPC ..... 209/39; 209/223.1; 209/225; 209/232

(58) Field of Classification Search
USPC ..... 209/39, 213, 222, 213.1, 225, 226, 228, 209/232
See application file for complete search history.

(56) References Cited

U.S. PATENT DOCUMENTS

| | | | | |
|---|---|---|---|---|
| 359,085 A | | 3/1887 | Mansfield | |
| 686,402 A | | 11/1901 | Greenway | |
| 832,825 A | | 10/1906 | Wait | |
| 2,045,098 A | | 6/1936 | Payne | |
| 2,714,960 A | | 8/1955 | Schmid | |
| 2,765,074 A | | 10/1956 | Diamond | |
| 2,959,287 A | * | 11/1960 | Westwood et al. | 210/222 |
| 3,022,956 A | | 2/1962 | Haseman | |

(Continued)

FOREIGN PATENT DOCUMENTS

| | | |
|---|---|---|
| GB | 843889 | 8/1960 |
| GB | 1046832 | 10/1966 |

(Continued)

OTHER PUBLICATIONS

Patent Cooperation Treaty International Search Report, PCT Patent Application No. PCT/US2012/034497. Jul. 18, 2012.

(Continued)

*Primary Examiner* — Joseph C Rodriguez
(74) *Attorney, Agent, or Firm* — Krieg DeVault LLP

(57) ABSTRACT

Slurries of magnetic and nonmagnetic particles in water are treated in a high intensity magnetic separator including at least one turntable that defines at least one circular channel therethrough in which a matrix material is positioned. Rotation of the turntable in a generally horizontal plane about a generally vertical virtual axis causes the circular channel(s) to rotate through a plurality of magnetic and nonmagnetic zones generated by magnet members. Treatment slurry is directed into the channel(s) in one or more of the magnetic zones as the turntable rotates. A tailings fraction passing through the channel(s) in a generally downward direction in the magnetic zones is collected in tailings launders. Magnetic particles attracted to the matrix material in the magnetic zones remain in the channel(s) until they pass into an adjacent nonmagnetic zone, where the magnetic particles are washed from the channel(s) into concentrate launders.

38 Claims, 25 Drawing Sheets

(56) References Cited

U.S. PATENT DOCUMENTS 3,062,376 A 11/1962 Davis
3,289,836 A 12/1966 Weston
3,326,374 A * 6/1967 Jones ..... 209/214
3,355,024 A 11/1967 Skoyles et al.
3,375,925 A * 4/1968 Carpenter ..... 209/214
3,439,803 A 4/1969 Duval
3,463,727 A 8/1969 Faney
3,557,276 A 1/1971 Williams
3,690,454 A 9/1972 Berkhtle et al.
3,794,163 A 2/1974 Israelson et al.
3,822,016 A 7/1974 Jones
3,830,367 A 8/1974 Stone
3,838,773 A 10/1974 Kolm
3,849,301 A 11/1974 Reading
3,869,379 A 3/1975 Vorster et al.
3,873,448 A 3/1975 Isberg et al.
3,887,458 A * 6/1975 Laurila ..... 209/219
3,920,543 A 11/1975 Marston et al.
3,935,095 A 1/1976 Susse et al.
3,947,349 A 3/1976 Fritz
4,046,680 A * 9/1977 Fritz ..... 209/214
4,052,310 A 10/1977 Nolan
4,059,510 A * 11/1977 Reading ..... 209/223.2
4,077,872 A 3/1978 Glover et al.
4,115,262 A 9/1978 Gustavsson et al.
4,116,839 A 9/1978 Unkelbach et al.
4,144,163 A 3/1979 Kolm
4,144,164 A 3/1979 Absil et al.
4,153,542 A * 5/1979 Bender et al. ..... 209/223.1
4,157,953 A 6/1979 Mawardi
4,166,789 A * 9/1979 Imai et al. ..... 209/219
4,191,591 A * 3/1980 Bender et al. ..... 134/25.1
4,192,738 A 3/1980 Colombo et al.
4,204,948 A 5/1980 Wechsler et al.
4,246,097 A 1/1981 Pouillon
4,260,477 A 4/1981 Corrans
4,261,815 A 4/1981 Kelland
4,317,719 A 3/1982 Tokuno
4,382,856 A 5/1983 Arbiter
4,455,228 A * 6/1984 Jones ..... 210/222
4,496,457 A 1/1985 Schickel
4,565,624 A 1/1986 Martinez
4,659,457 A 4/1987 Martinez
4,726,895 A 2/1988 Martinez
4,737,294 A * 4/1988 Kukuck ..... 210/695
4,755,302 A * 7/1988 Unkelbach et al. ..... 210/695
4,874,508 A * 10/1989 Fritz ..... 209/214
4,941,969 A 7/1990 Schonert et al.
5,116,434 A 5/1992 Keem et al.
5,137,629 A 8/1992 Dauchez
5,178,334 A 1/1993 Hebert et al.
5,193,687 A 3/1993 Martinez
5,200,084 A 4/1993 Liberti et al.
5,205,414 A 4/1993 Martinez
5,316,746 A 5/1994 Narita et al.
5,348,160 A 9/1994 Kindig
5,356,015 A 10/1994 Notebaart et al.
5,356,534 A 10/1994 Zimmerman et al.
5,415,294 A * 5/1995 Nagaoka ..... 209/393
5,436,384 A 7/1995 Grant et al.
5,462,173 A * 10/1995 Darling ..... 209/39
5,462,513 A 10/1995 McAlister
5,465,849 A 11/1995 Wada et al.
5,540,089 A 7/1996 Fitch
5,541,072 A 7/1996 Wang et al.
5,568,869 A 10/1996 Turkenich et al.
5,622,831 A 4/1997 Liberti et al.
5,628,407 A 5/1997 Gilbert et al.
5,636,748 A 6/1997 Arvidson
5,655,665 A 8/1997 Allen et al.
5,705,059 A 1/1998 Miltenyi
5,705,064 A 1/1998 Leupold
5,711,871 A 1/1998 Miltenyi
5,716,520 A 2/1998 Mason
5,759,391 A 6/1998 Stadtmuller
5,762,204 A 6/1998 Yang et al.
5,766,450 A 6/1998 Herman et al.
5,795,470 A 8/1998 Wang et al.
5,858,223 A 1/1999 Stadtmuller et al.
5,868,255 A 2/1999 McGaa
5,868,257 A 2/1999 Stadtmuller
5,890,663 A 4/1999 Strach et al.
5,894,934 A 4/1999 Davis
5,908,166 A 6/1999 Freitas et al.
5,932,108 A 8/1999 Brunsting
5,961,055 A 10/1999 Lehtinen
5,975,310 A 11/1999 Darling et al.
6,045,705 A 4/2000 Watson et al.
6,056,872 A 5/2000 Glass
6,085,912 A 7/2000 Hacking, Jr. et al.
6,092,665 A 7/2000 Schmidt et al.
6,103,113 A 8/2000 Saho et al.
6,143,045 A 11/2000 Witaszak et al.
6,171,504 B1 1/2001 Patterson
6,180,005 B1 1/2001 Iannicelli
6,224,777 B1 5/2001 Iannicelli
6,253,924 B1 7/2001 Bleifuss et al.
6,261,450 B1 7/2001 Yeh
6,264,842 B1 7/2001 Boehm
6,273,265 B1 8/2001 Greenwalt
6,308,835 B1 10/2001 Wade
6,310,309 B1 10/2001 Ager et al.
6,352,160 B1 3/2002 Harden
6,355,085 B1 3/2002 Pillin et al.
6,365,856 B1 4/2002 Whitelaw
6,451,207 B1 9/2002 Sterman et al.
6,458,274 B1 10/2002 Mori
6,638,433 B2 10/2003 Watters et al.
6,649,054 B2 11/2003 Iida et al.
6,666,335 B1 12/2003 Bradley et al.
6,688,473 B2 2/2004 Franzreb et al.
6,706,178 B2 3/2004 Simonson
6,722,503 B2 4/2004 Watters et al.
6,743,365 B1 6/2004 Marlowe
6,758,968 B2 7/2004 Ashton
6,818,042 B2 11/2004 Peacocke et al.
6,823,270 B1 11/2004 Roys
6,824,686 B2 11/2004 Smis et al.
6,831,540 B1 12/2004 Lin
6,832,691 B2 12/2004 Miles et al.
6,968,956 B2 11/2005 Iwasaki
7,226,537 B2 6/2007 Broyer et al.
7,241,380 B2 7/2007 Reiling
7,258,799 B2 8/2007 Ras et al.
7,331,467 B2 2/2008 Wise
7,429,331 B2 9/2008 Lumsden et al.
7,438,190 B2 10/2008 Wise
7,473,407 B2 1/2009 Phillip et al.
7,506,765 B2 3/2009 Franzreb et al.
7,553,414 B2 6/2009 Hall
7,666,304 B2 2/2010 Meeks
7,678,270 B2 3/2010 Sisemore
7,712,455 B2 5/2010 Szalai
7,713,360 B2 5/2010 Chashi
7,740,759 B2 6/2010 Su et al.
7,753,211 B2 7/2010 Rem et al.
7,785,475 B2 8/2010 Saho et al.
7,841,475 B2 11/2010 Ricardo et al.
7,886,913 B1 * 2/2011 Fritz et al. ..... 209/224
7,886,915 B2 2/2011 Shulman
8,292,084 B2 * 10/2012 Chappie et al. ..... 209/39
2002/0074266 A1 6/2002 Franzreb et al.
2002/0175120 A1 * 11/2002 Norell et al. ..... 210/499
2003/0116745 A1 6/2003 Ozaki et al.
2006/0118479 A1 6/2006 Shevkoplyas et al.
2007/0221543 A1 9/2007 Karmeniemi et al.
2008/0011650 A1 1/2008 Lewis-Gray
2008/0023709 A1 1/2008 Tsai et al.
2009/0039029 A1 2/2009 Vlad
2010/0078362 A1 4/2010 Riise et al.
2010/0113622 A1 5/2010 Mohedas et al.
2010/0193618 A1 8/2010 Lewis-Gray
2010/0228056 A1 9/2010 Wang et al.
2010/0301146 A1 12/2010 Chang

(56) References Cited

U.S. PATENT DOCUMENTS

| | | | | |
|---|---|---|---|---|
| 2011/0094943 | A1* | 4/2011 | Chappie et al. | 209/38 |
| 2011/0127201 | A1 | 6/2011 | Domke et al. | |
| 2011/0163014 | A1 | 7/2011 | Bender et al. | |

FOREIGN PATENT DOCUMENTS

| | | |
|---|---|---|
| GB | 1094646 | 12/1967 |
| GB | 1300309 | 12/1972 |
| GB | 1371623 | 10/1974 |
| JP | 58186452 | 10/1983 |
| JP | 59183842 | 10/1984 |
| JP | 60172361 | 9/1985 |
| WO | WO 03/097202 | 11/2003 |
| WO | WO 2010/054847 | 5/2010 |
| WO | WO 2011/044608 | 4/2011 |

OTHER PUBLICATIONS

Patent Cooperation Treaty Written Opinion of the Internatinal Search Authority. PCT Patent Application No. PCT/US2012/034497. Jul. 18, 2012.

Patent Cooperat ion Treaty International Search Report, PCT Patent Application No. PCT/US2010/054268. Dec. 27, 2010.

Patent Cooperation Treaty Written Opinion of the International Search Authorty PCT Patent Application No. PCT/US2010/054268. Dec. 27, 2010.

* cited by examiner

IRON ORE SEPARATION DEVICE

CROSS REFERENCE TO RELATED APPLICATION

The present application claims the benefit of U.S. Provisional Patent Application No. 61/477,590 filed Apr. 20, 2011, which is incorporated herein by reference in its entirety.

BACKGROUND

The current demand for commodities is very high, at least in part as a result of the industrial revolution occurring in China and to a lesser extent in India and other developing countries. This demand has led to a search of the globe for occurrences of economic concentrations of a wide variety of minerals and elements including but not limited to iron oxides. Occurrences of iron oxides, whether present in their natural state or in tailings of prior mining or mineral processing operations, can be economically recoverable if low cost mineral processing systems are developed that can isolate the iron oxides into commercially valuable concentrations. Of particular economic interest are concentrations of iron that occur naturally in certain rock and mineral formations around the planet and iron concentrations that result from the creation of reject tailings deposition basins or lean ore stockpiles resulting from past mining and mineral processing operations. These tailings basins and stockpiles represent a collection of elements in a form that already has considerable energy, manpower and "carbon footprint" invested into the mining and size reduction of the rock involved and therefore such occurrences have even greater economic and environmental attraction in the ongoing commodity shortage and concerns regarding climate change. However, to date mineral processing systems effective to isolate iron oxides from such occurrences have been unavailable, unknown, or prohibitively expensive to build and operate. There is an ongoing need, therefore, for advancements relating to the recovery of iron oxide from such occurrences. The present application addresses this need.

SUMMARY

There are provided magnetic separator devices and systems, and methods for using same, which separate magnetic particles from non-magnetic particles where both types of particles are present in a mixture. The mixture is transported through the separator devices and systems described herein in a water-mineral suspension referred to herein as a "slurry". As used herein, the term "magnetic," when referring to a particle or mineral, is used interchangeably with the term "magnetically susceptible," and refers to the property of being a material that is susceptible to influence by a magnetic field. This may be separate and distinct from, and/or inclusive of, a material that is referred to as a "magnet."

In one aspect, the present application provides a high intensity magnetic separation device for separating a treatment slurry including magnetic particles and nonmagnetic particles suspended in water into a concentrate fraction and a tailings fraction. The device includes: (1) a generally horizontal rotor rotatable about a generally vertical axis, the rotor defining a circular channel rotatable about the axis, the channel defining a flow path through the rotor and containing a matrix material therein, wherein the channel is configured to allow passage of a downwardly moving fluid stream therethrough in contact with the matrix material; (2) a rigid support frame operable to support the rotor; (3) a driver mounted to the support frame, the driver operable to rotate the rotor at a generally constant rate; (4) a plurality of permanent magnet members fixedly attached to the support frame, the permanent magnet members positioned to straddle the channel at a plurality of locations spaced apart along the circular path of the channel, the magnet members effective to apply magnetic fields across a plurality of portions of the path where the channel is straddled by the permanent magnet members, the portions defining a plurality of magnetic zones, the magnetic zones being separated along the circular path by nonmagnetic zones, thereby providing a repeating series of magnetic zones and nonmagnetic zones along the circular path; (5) a plurality of feed conduits for delivering a treatment slurry into the channel at a plurality of input locations, each input location being positioned within one of the plurality of magnetic zones defined by the first plurality of permanent magnet members; (6) a plurality of water delivery conduits for delivering water into the channel at a plurality of locations within the magnetic zones and within the nonmagnetic zones defined by the plurality of permanent magnet members; and (7) a plurality of tailings launders and a plurality of concentrate launders positioned beneath the channel; the tailings launders positioned beneath the magnetic zones for receiving a tailings fraction of the treatment slurry that passes through the channel in the magnetic zones; and the concentrate launders positioned beneath the nonmagnetic zones for receiving a concentrate fraction of the treatment slurry that passes through the channel in the nonmagnetic zones. In another embodiment, the tailings launders and concentrate launders are connected to hoses that convey the collected tailings fractions and concentrate factions, respectively, from the collection launders to slurry receiving sumps and pumps/pipelines of delivery systems as described herein.

These and other aspects of the inventive devices, systems and processes are discussed further below.

DETAILED DESCRIPTION

Figure 1:
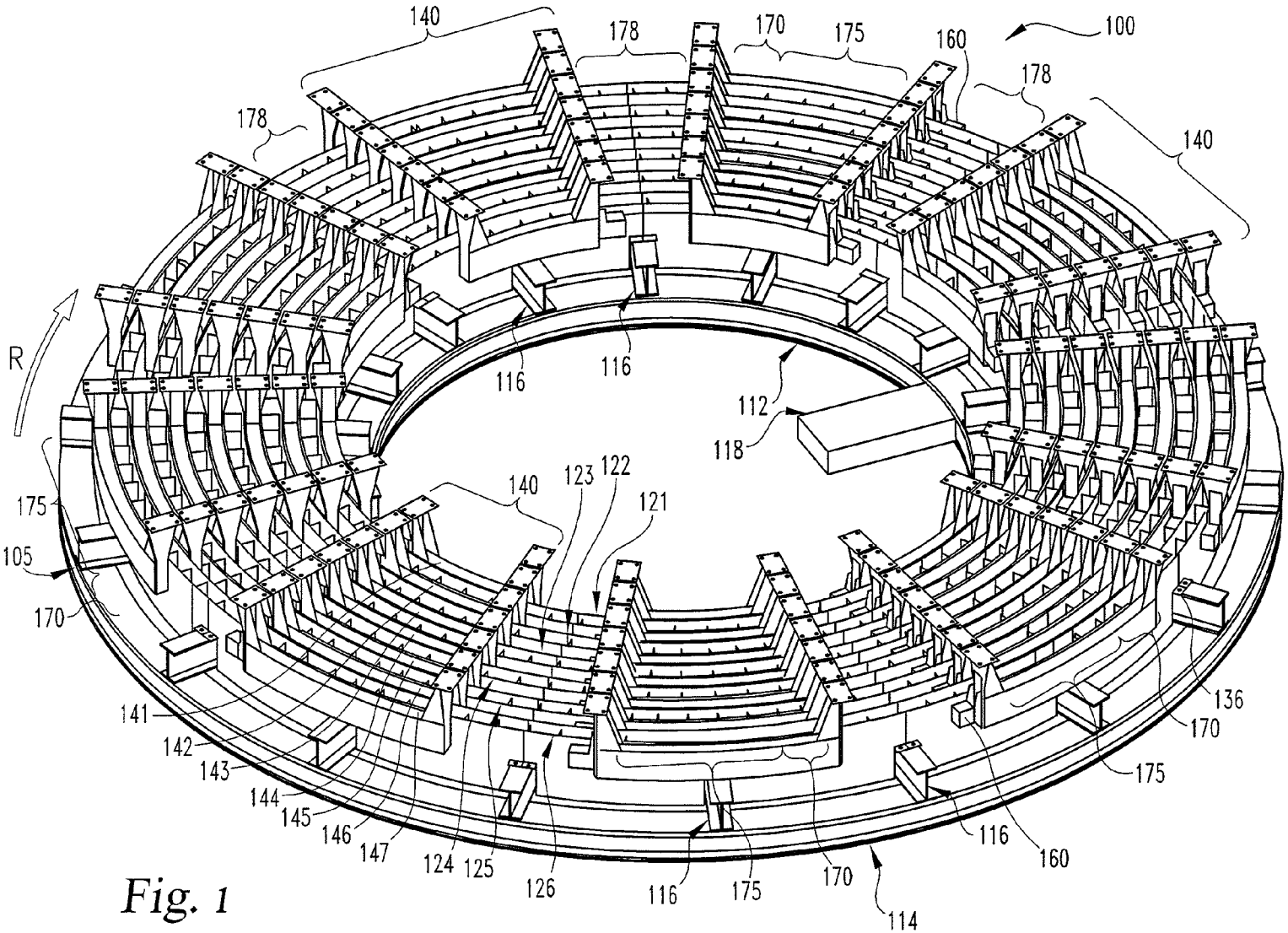
FIG. 1 is a perspective view of one embodiment magnetic separator of the present application.

For the purposes of promoting an understanding of the principles of the invention, reference will now be made to the embodiments illustrated in the figures and specific language will be used to describe the same. It will nevertheless be understood that no limitation of the scope of the invention is thereby intended. Any such alterations and further modifications in the described devices, systems, processes and methods, and such further applications of the principles of the invention as described herein are contemplated as would normally occur to one skilled in the art to which the present application relates.

The present application provides devices, systems, methods and processes to treat iron-containing treatment slurries in such a fashion as to separate magnetically susceptible particles from non-magnetic particles. In one aspect of the application, a unique magnetic separation device is described that is useful for separating a slurry including magnetic particles and nonmagnetic particles into fractions, at least one, referred to as a concentrate fraction, having a higher magnetic particle content than the treatment slurry and at least one, referred to as a tailings fraction, having a lower magnetic particle content than the treatment slurry. For purposes of the present description, the term "treatment slurry" refers to an aqueous suspension of particles that is introduced into a magnetic separator as described herein.

A treatment slurry to be introduced into a magnetic separator as described herein can be a suspension of sized particles obtained from a mineral assemblage by screening or other size classification process. The term "mineral assemblage" is used herein to refer to a material that includes both magnetic and nonmagnetic particles, examples of which include particle mixtures that result from mining, manufacturing, mineral processing, or other treatment processes or systems. One mineral assemblage specifically contemplated by the present application is a particle mixture that results from iron mining operations, such as, for example, discarded solid material, or tailings, that includes ore of relatively low grade and/or material that includes a significant proportion of non-ferrous rock material. The mineral assemblages can also be mineral assemblages that are extracted for treatment from their natural state in rock formations or alluvial mineral collections. The present application also contemplates that certain mineral assemblages may include large rocks or other solid portions that include target minerals, which would benefit from size reduction processing to extract target minerals therefrom. Thus, the application contemplates passing such materials through a crusher or grinder device, or other suitable size reduction device, prior to formation of a treatment slurry for treatment as described herein. The mineral assemblages to be treated may include, for example, iron oxide from taconite processing; iron oxide from natural iron ore, density separation, sluicing plants, or heavy media processing plants; iron oxide stockpiles containing concentrations of silica, magnetite and/or hematite and possibly other minerals; or iron formations including concentrations of hematite, magnetite, silica and possibly other minerals. In one embodiment, the slurry is first passed through a wet screening device to remove relatively large particles and debris from the mineral assemblage.

The magnetic separation device is a high intensity separator that utilizes an amplified magnetic field generated by a plurality of permanent magnet members. The separation device is effective for recovering even weakly magnetic particles from a treatment slurry including same in admixture with non-magnetic particles. Generally, the device comprises at least one large rotatable turntable, also referred to herein as a rotor, that defines at least one circular channel, and preferably a set of connected, spaced apart concentric channels, therethrough. For purposes of the present description, embodiments having multiple spaced apart concentric channels on a single rotor are described; however, the present application contemplates embodiments having only a single channel, or having more or fewer channels than the embodiments illustrated in the drawings. The turntable is supported on a fixed separator frame and rotates the channel, or each of the channels in an embodiment that includes more than one channel, in a generally horizontal plane around a generally vertical virtual axis, and a treatment slurry is directed through the channel or channels as the turntable rotates. Each channel is defined by an outer circular vertical side wall, an inner circular vertical side wall and a foraminous, screen cloth, slotted, or porous floor. One or more of the outer and inner side walls and the floor can optionally be composed of a magnetically susceptible material, such as, for example, a magnetically susceptible steel. In other embodiments, the outer and inner side walls and the floor are composed of non-magnetically susceptible materials, such as, for example, stainless steel, aluminum, fiberglass, carbon composite, high density polyurethane or other durable plastic material. At least one of the channels, and preferably each of the channels, also includes a plurality of spaced apart vertical separating walls that separate the circular channel into compartmentalized arc sections (also referred to herein as "arcuate channel sections" or "channel sections"). The channel sections contain a magnetically susceptible matrix material that is effective when positioned in a magnetic field to attract and at least partially retain magnetically susceptible particles in the treatment slurry as the treatment slurry passes in a generally downward direction through the channel.

As the turntable is rotated, the channel or channels are concurrently rotated through a 360° arc, and a single full rotation of the channels through a 360° arc causes each point of the channel or channels to pass through a plurality of magnetic zones by passing the point through a plurality of applied magnetic fields spaced radially around the axis. In this manner a single rotation of the turntable through a 360° arc passes a given point of each channel (i.e., each channel section) into and out of a plurality of magnetic zones. In one preferred embodiment, described in more detail below, the magnetic separator includes nine separate magnetic zones separated by nine nonmagnetic zones, each pair of adjacent magnetic and nonmagnetic zones being referred to herein as a sector of the separation device. It is not intended, however, that the present application be limited to this specific number of magnetic zones and nonmagnetic zones, it being understood that magnetic separators having a greater or lesser number of sectors are also contemplated.

The magnetic field in each magnetic zone is produced by permanent magnet members located at fixed positions relative to the circular path of rotation of the channel or channels. In one preferred embodiment, the permanent magnet members are placed in juxtaposition with the inner side wall and outer side wall that define a given channel, such that rotation of the turntable, and thus the rotation of the channel, about the vertical axis, passes the channel between two permanent magnet members, which define a magnetic zone, encompassing a portion of the arc rotation. In order to apply a magnetic field across a given arc length of the channel, the permanent magnet members can be curved to a predetermined radius of curvature, and can have a predetermined arc length to provide a magnetic zone having a desired arc length. The permanent magnet members are held in such fixed locations by attachment to a portion of the fixed separator frame that is positioned above the turntable. The portion of the fixed separator frame to which the permanent magnet members are attached is rigidly connected to the portion of the fixed separator frame upon which the turntable is supported so that the relative orientation of the permanent magnet members to the rotating channel remains substantially uniform during rotation of the turntable and operation of the magnetic separator.

In embodiments in which the turntable defines multiple spaced-apart concentric channels, the plurality of channels defined by the turntable are preferably positioned sufficiently near one another such that a permanent magnet member juxtaposed to the inner circular wall of one channel is also juxtaposed to the outer circular wall of another channel (with the exception of the magnet member juxtaposed to the inner wall of the innermost channel). In this way, a single permanent magnet member positioned between two channels applies a magnetic field across both channels. By orienting each of the channels and magnet members in this way, the number of permanent magnet members required to provide a magnetic field across multiple channels in a given sector is represented by the equation:

$$M=C+1$$

where "C" represents the number of channels in the magnetic zone and "M" represents the number of permanent magnet members, magnet cans, or magnet containers in the magnetic zone sector. In the embodiments illustrated in the drawings, for example, each sector includes six channels and seven permanent magnet members. Orientation of permanent magnet members in this manner defines a single magnetic zone that spans each of the channels in one radial section of the separator. Moreover, with multiple permanent magnet members positioned in a given sector of the turntable, the magnetic members in a given sector enhance the magnetic effects of one another, thereby generating an intensified magnetic field in a given sector of the turntable.

During the portion of arc movement when a given channel section is within the applied magnetic field (i.e., within the magnetic zone), magnetic materials within the treatment slurry introduced into the channel in the magnetic zone are attracted to the matrix material positioned in the channel, and tend to become entrapped by the matrix material. The nonmagnetic materials, however, are unaffected by the magnetic field and tend to pass through the matrix material and channel in the magnetic zone. The magnetic particles entrapped by the matrix material in the channel tend to remain associated with the matrix material in the channel while it is in the magnetic field, but can be released from the matrix material in the channel section after it rotates out of the magnetic zone and into a nonmagnetic zone. Due to the different behavior of the respective magnetic and nonmagnetic particles with respect to the matrix material, separation of the particles can be achieved as the treatment slurry passes through the matrix material in the channel.

In typical operation of the magnetic separator, a treatment slurry is directed into each channel at positions within one or more, and preferably each of, the applied magnetic fields (i.e., within the magnetic zones). Preferably, treatment slurry is directed into each channel at positions where a channel first enters the magnetic zones relative to the rotation of the channel through the magnetic zones. Once the treatment slurry is introduced into the channel, the magnetic particles in the treatment slurry begin to become attached to and entrapped within the channel by magnetic attraction to the matrix residing within the channel. Nonmagnetic particles, however, pass through the matrix. Continued rotation of the channel brings the entrapped magnetic particles out of the magnetic zone and into a nonmagnetic zone, and the magnetic particles are then released from the matrix and washed out of the channel section. Separate collectors, also referred to herein as launders, can be positioned below the turntable and used to receive the magnetic particles and nonmagnetic particles separately. Circular construction of the individual channels permits efficient operation as a continuous, rather than a batch, system.

Figure 17:
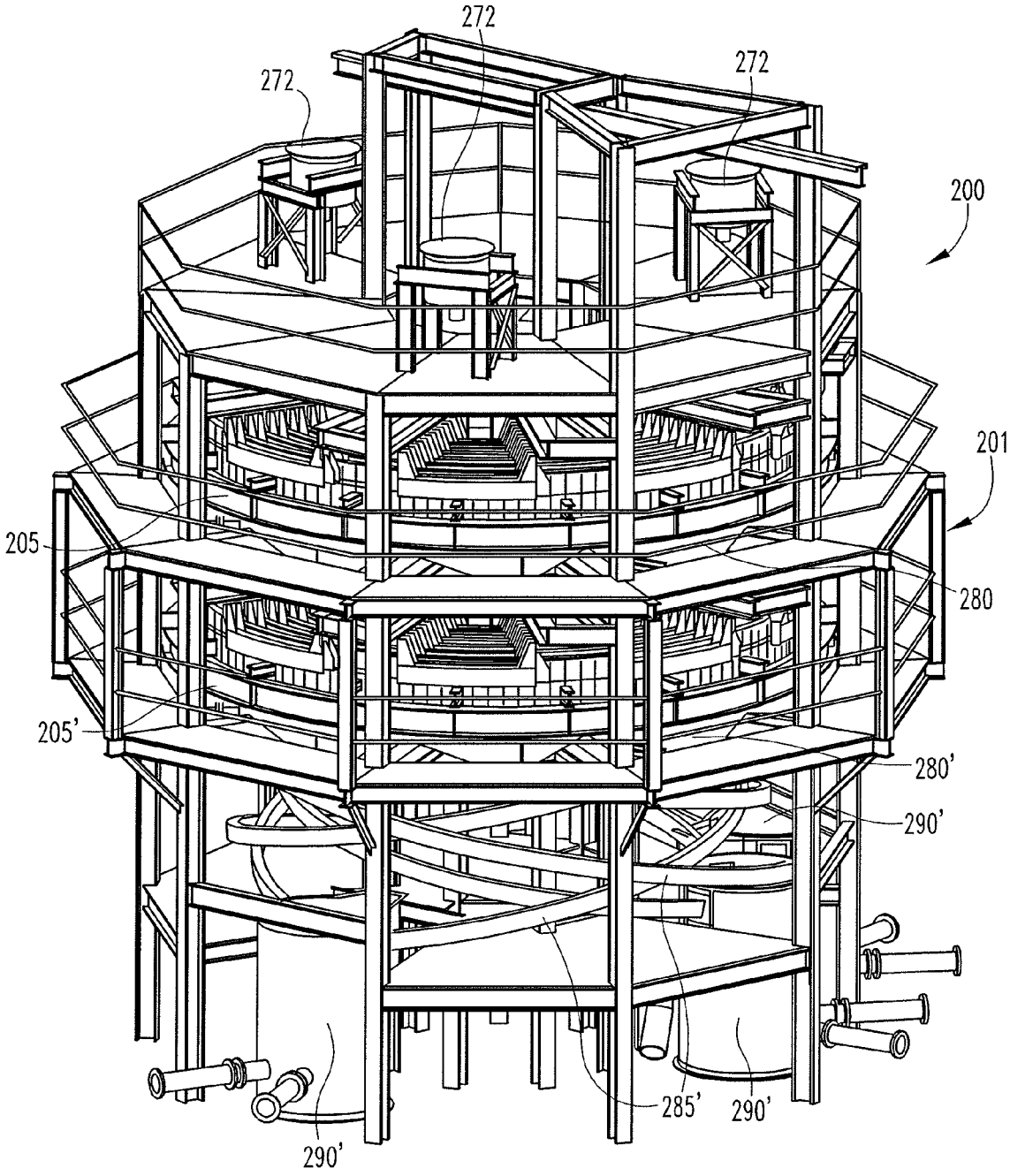
FIG. 17 is a perspective view of another embodiment magnetic separator of the present application.
Figure 18:
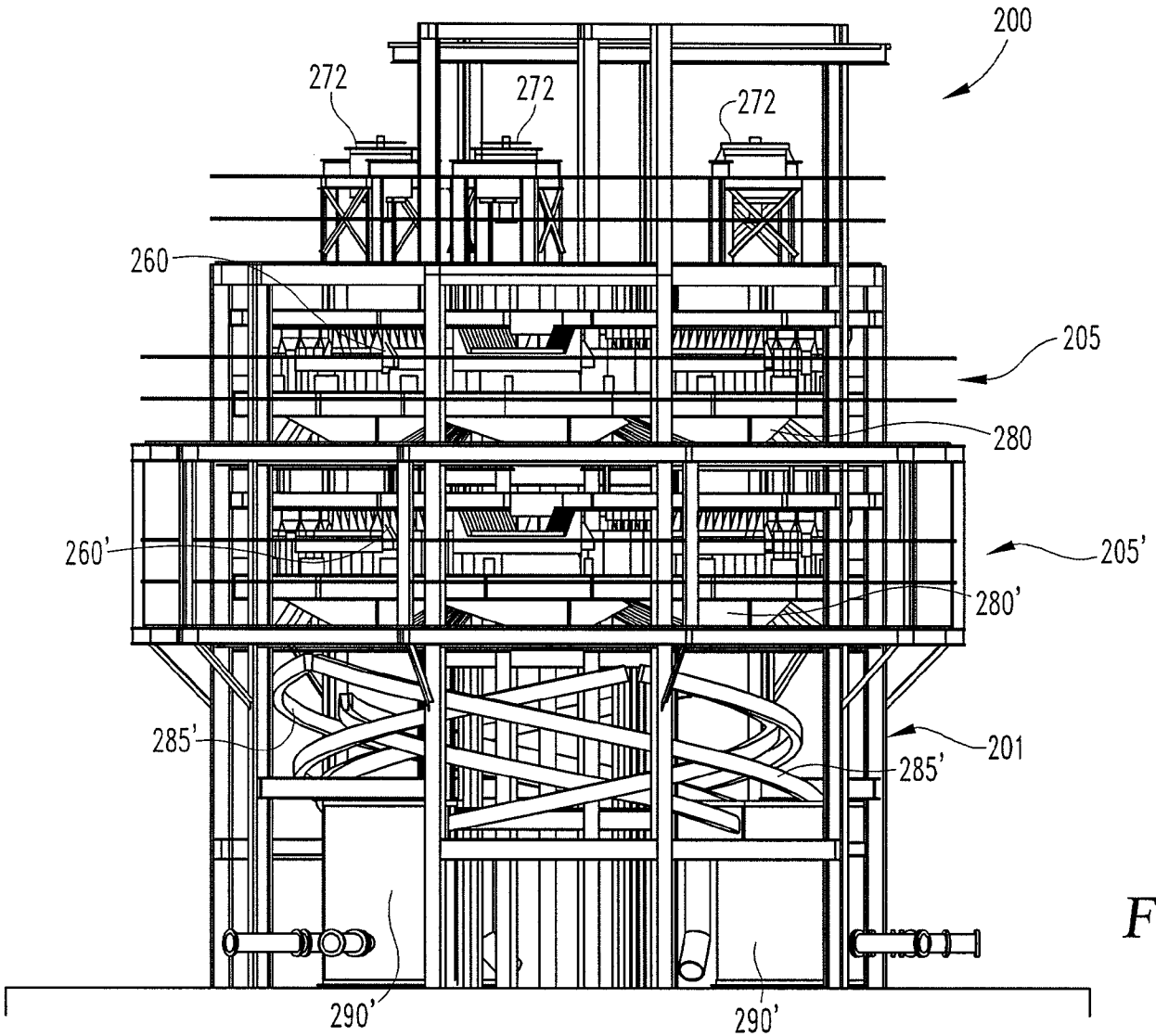
FIG. 18 is an elevation view of the separator embodiment shown in FIG. 17.
Figure 19:
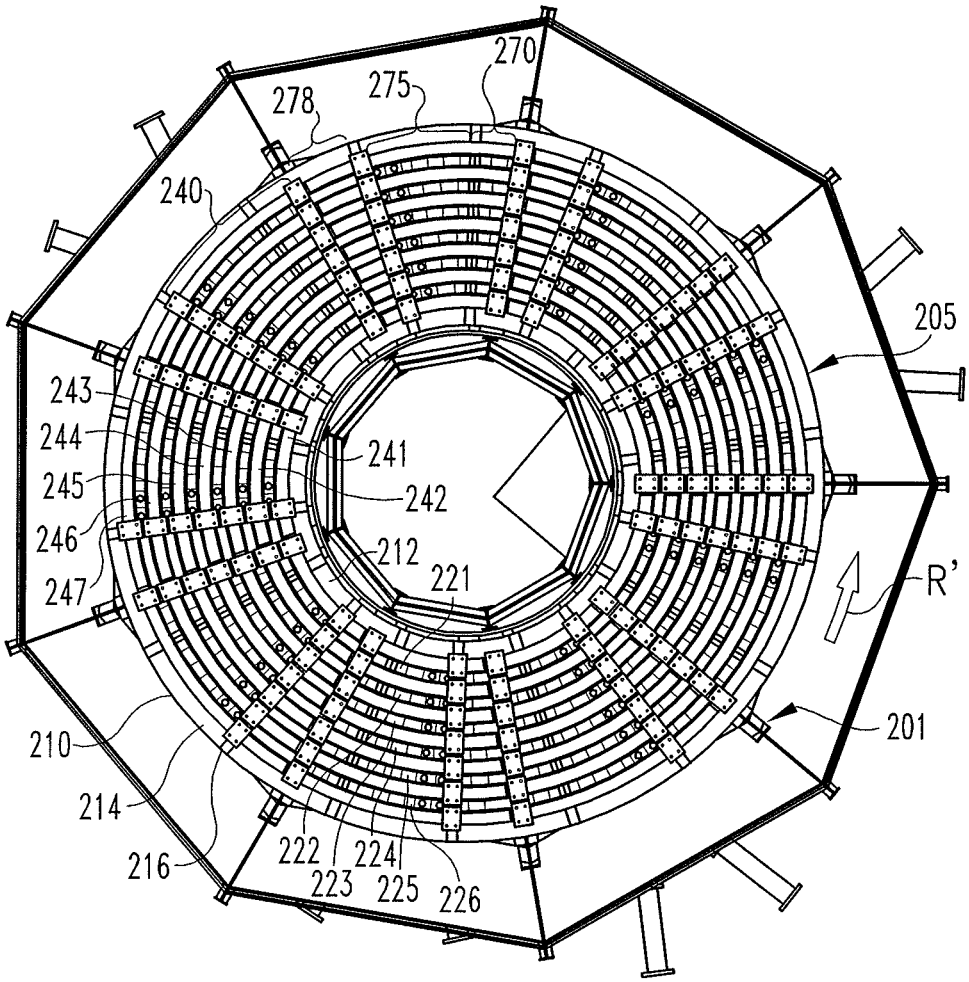
FIG. 19 is a cut-away top plan view of the upper separation stage of the separator embodiment shown in FIGS. 17 and 18.
Figure 20:
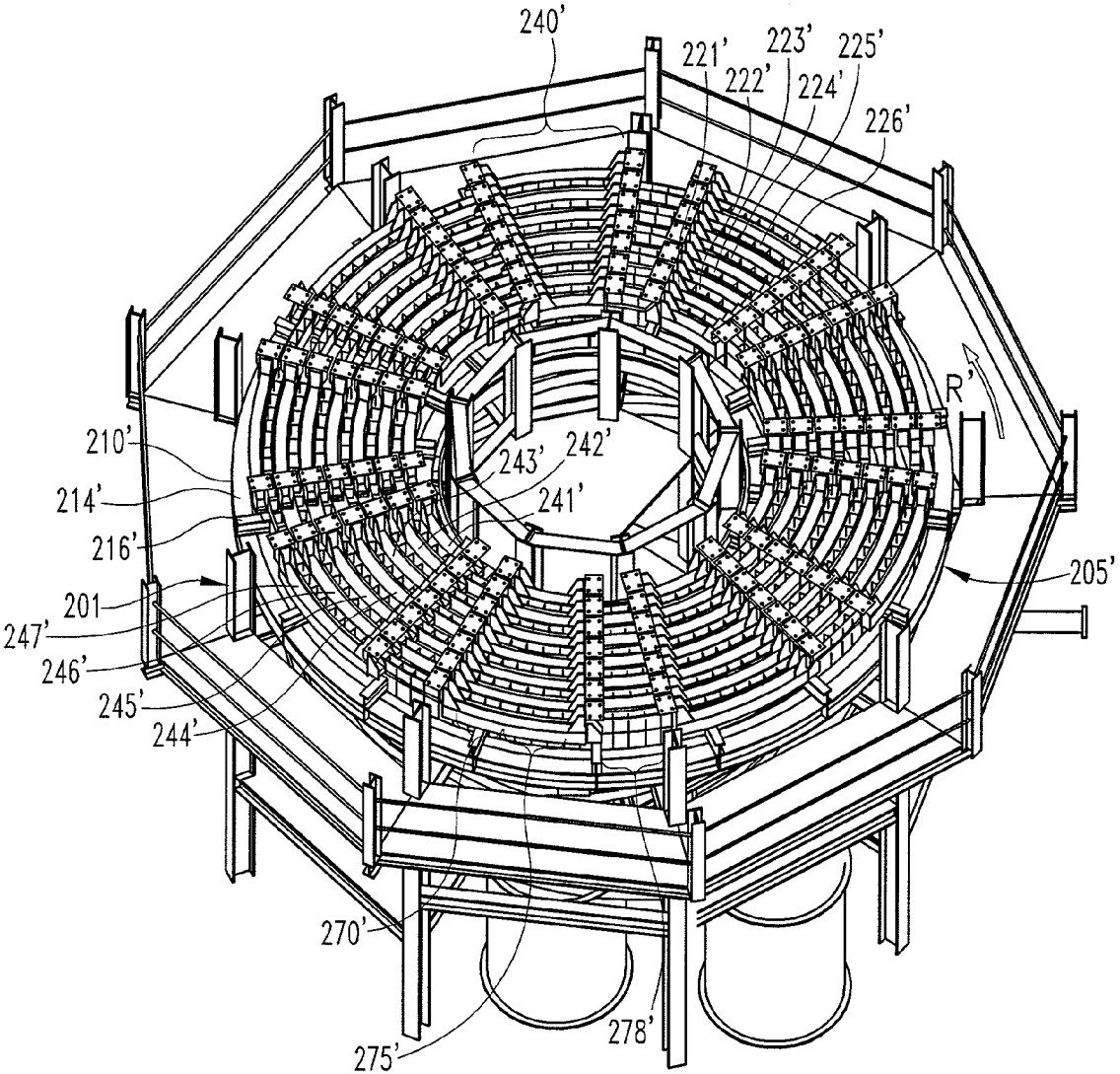
FIG. 20 is a cut-away perspective view of the lower separation stage of the separator embodiment shown in FIGS. 17 and 18.

FIG. 1 depicts a partial perspective view of one embodiment magnetic separator 100, omitting (for the sake of clarity) the fixed separator frame upon which various components of the magnetic separator are supported or mounted (see, e.g., fixed separator frame 201 of separator 200 depicted in FIG. 17), and also omitting (for the sake of clarity) treatment slurry delivery apparatus, rinse/flush water delivery apparatus and launder apparatus for collecting separated fractions of the treatment slurry. In magnetic separator 100, rotor 105 includes structural rotor frame 110 (see also FIG. 2) and six annular troughs 121, 122, 123, 124, 125, 126. In one embodiment, rotor 105 has an outside diameter of about twenty-two feet. Structural rotor frame 110 comprises inner support frame component 112, outer support frame component 114 and multiple radial support frame components 116 rigidly connected to inner support frame component 112 and outer support frame component 114. In the embodiment shown, radial support frame components 116 are depicted as having an "I beam" configuration. In an alternative embodiment, radial support frame components 116 comprise radial tubes that provide the necessary support, while causing less interference to the flow of concentrate and tail fractions that pass through rotor 105. In one embodiment, the radial tubes have a circular cross section. In another embodiment the radial tubes have a rectangular cross section. Other alternative configurations are also contemplated. Annular troughs 121, 122, 123, 124, 125, 126 are spaced apart from one another in concentric rings, are mounted on and carried by structural rotor frame 110, and define channels, also referred to as runways, for passage of a treatment slurry therethrough as described further hereinbelow.

Figure 2:
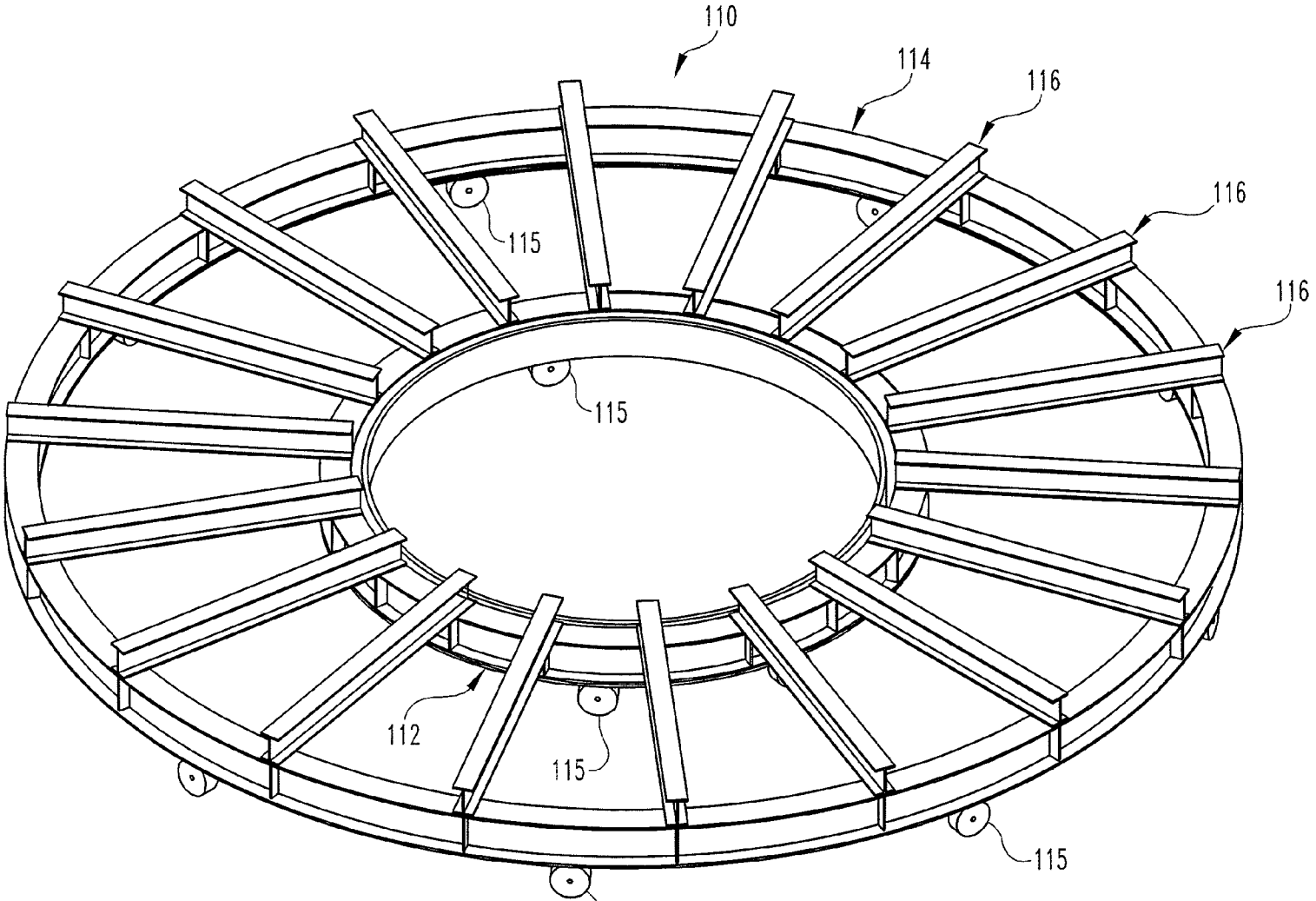
FIG. 2 is a perspective view of a structural rotor frame of the magnetic separator embodiment of FIG. 1.

As depicted in FIG. 2, each of inner support frame component 112 and outer support frame component 114 is supported by rotatable carriage wheels 115, which are in turn mounted either on the fixed separator frame (not shown) or to the rotor support frame components 112 and 114. In the embodiment shown, separator 100 includes fourteen carriage wheels 115. In other embodiments, more or fewer carriage wheels are included. For example, in an embodiment in which rotor 105 has a diameter of about twenty-five feet, as described further below, separator 100 includes twenty carriage wheels supporting each rotor frame. Further structures (not shown) can also be included to guide rotor 105 and maintain rotation of troughs 121, 122, 123, 124, 125, 126 through proper arcs of rotation. For example, guidance wheels or thrust control wheels (not shown) are also optionally positioned on either rotor frame 110 or the structural support frame to guide and maintain the proper rotation of rotor 105 about the vertical axis of rotation. While a specific embodiment of rotor 105 is shown and described, the present application is not intended to be limited by the specific carriage elements shown and described, it being understood that a variety of alternative arrangement can be readily envisioned by a person skilled in the art to ensure proper rotation of rotor 105 about the vertical axis. Having the benefit of the disclosure herein, one skilled in the mechanical arts can readily envisage and implement a variety of alternative designs to provide a rotor supported and guided in its rotation by, for example, bearing and thrust wheels attached to either the fixed frame or the rotor frame and riding on plates or rails or the like.

In operation of magnetic separator 100, rotor 105 is caused to rotate in the direction indicated by arrow R by driver 118, which driver can be, for example and without limitation, an electric motor. In certain embodiments, the rotation is at a generally constant rate, although the velocity profile of the rotation may be any configuration. Driver 118 can be configured to engage and drive rotor 105 in a wide variety of ways as would be contemplated by a person skilled in the art. For example, and without limitation, in one embodiment, driver 118 is configured to drive a sprocket (not shown) through a reducer (not shown), with the sprocket engaging a plurality of chain links (not shown) fastened to rotor frame 110. Alternatively, driver 118 can be configured to drive a rubber wheel that engages a surface of rotor frame 110 to drive rotation of rotor 105 by friction. In another embodiment, driver 118 is configured to drive rotor 105 using a bull gear (not shown) fastened to rotor frame 110 such that the bull gear is engaged by a pinion gear (not shown) driven by a reducer which is driven by the electric motor.

Figure 3:
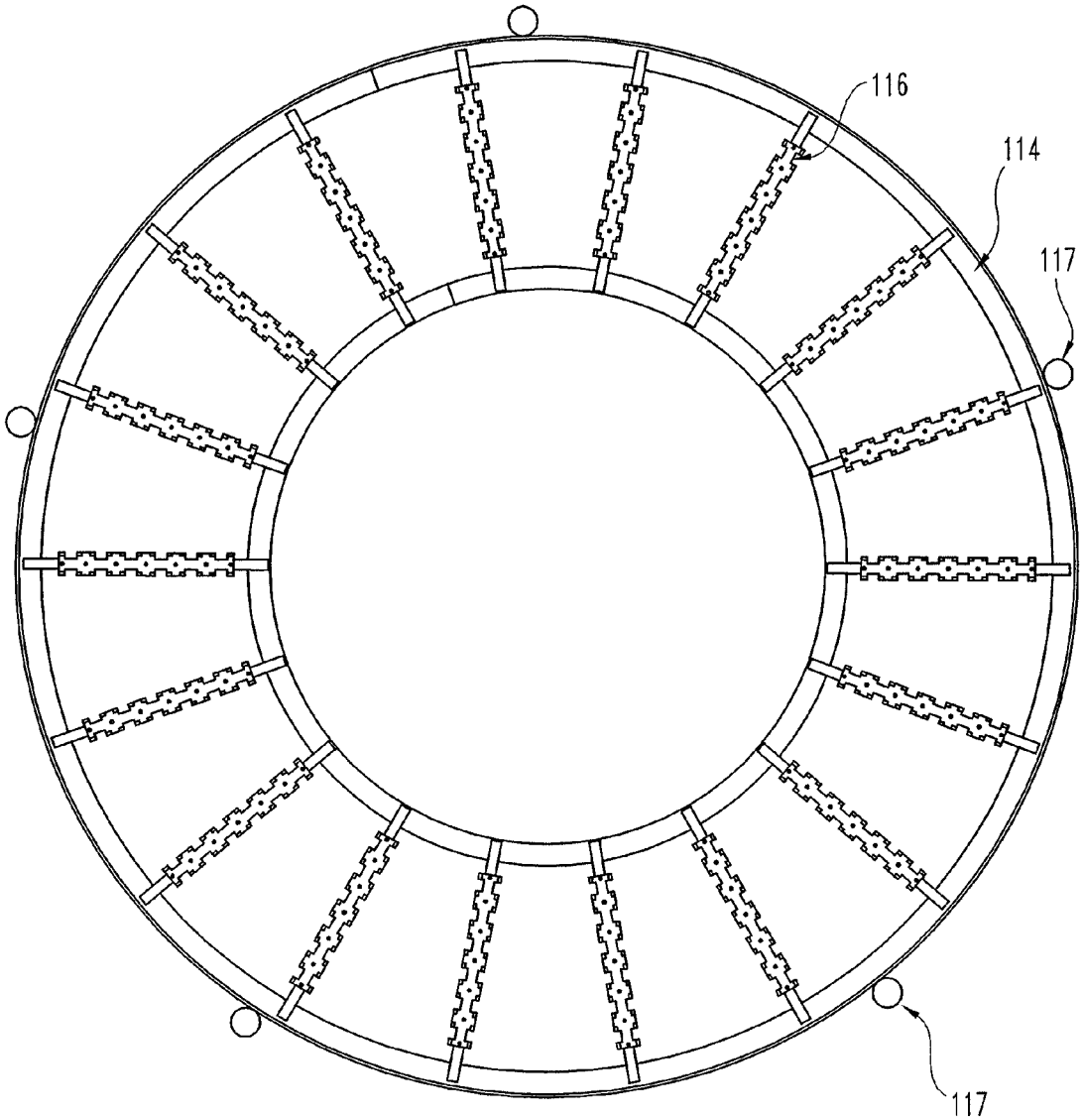
FIG. 3 is a top plan view showing a structural rotor frame of the magnetic separator embodiment of FIG. 1 with five thrust wheels oriented to engage the outer support frame component.

While the embodiment depicted in FIG. 1 includes driver 118 positioned to engage inner support frame component 112, in other embodiments a driver is positioned to engage outer support frame component 114. In other words, the driver can engage and rotate rotor 105 from the outside of support frame component 114 or the inside of support frame component 112. In one embodiment, separator 100 includes three thrust wheels to drive rotor 105. The three thrust wheels are positioned to engage inner support frame component 112 in one embodiment and are positioned to engage outer support frame component 114 in another embodiment. In yet another embodiment, separator 100 includes five thrust wheels to drive rotor 105. In one embodiment, depicted in FIG. 3, the five thrust wheels 117 are positioned to engage outer support frame component 114, and are preferably spaced out generally equal distances from one another along the arc of outer support frame component 114. In another embodiment, the five thrust wheels are positioned to engage inner support frame component 112. While embodiments including three and five thrust wheels, respectively, have been described above, it is not intended that the present application be limited to these numbers, it being understood that alternative numbers of thrust wheels or other drivers can be included in other embodiments. In one embodiment, driver 118 is a variable drive electric motor.

FIG. 1 also depicts nine sets 140 of permanent magnet members, each of sets 140 including multiple curved permanent magnet members 141, 142, 143, 144, 145, 146, 147 in spaced apart relationship to define a generally constant annular space therebetween. Each of permanent magnet sets 140 defines a magnetic zone and, together with the nonmagnetic zone 178 (discussed further below) on the trailing edge of the magnetic zone relative to the rotation of rotor 105, defines a sector of separator 100. Curved magnet members 141, 142, 143, 144, 145, 146, 147 are mounted on a portion of the fixed separator frame (not shown) above rotor 105, and are held in fixed positions as rotor 105 rotates. Each of curved magnet members 141, 142, 143, 144, 145, 146, 147 is positioned such that the annular space between adjacent ones of magnet members 141, 142, 143, 144, 145, 146, 147 provides a pathway for passage of one of troughs 121, 122, 123, 124, 125, 126 as rotor 105 turns. More specifically, in each permanent magnet set 140, magnet members 141 and 142 are positioned such that trough 121 passes therebetween as rotor 105 turns. Similarly, magnet members 142 and 143 are positioned such that trough 122 passes therebetween as rotor 105 turns, magnet members 143 and 144 are positioned such that trough 123 passes therebetween as rotor 105 turns, magnet members 144 and 145 are positioned such that trough 124 passes therebetween as rotor 105 turns, magnet members 145 and 146 are positioned such that trough 125 passes therebetween as rotor 105 turns, and magnet members 146 and 147 are positioned such that trough 126 passes therebetween as rotor 105 turns.

Figure 4:
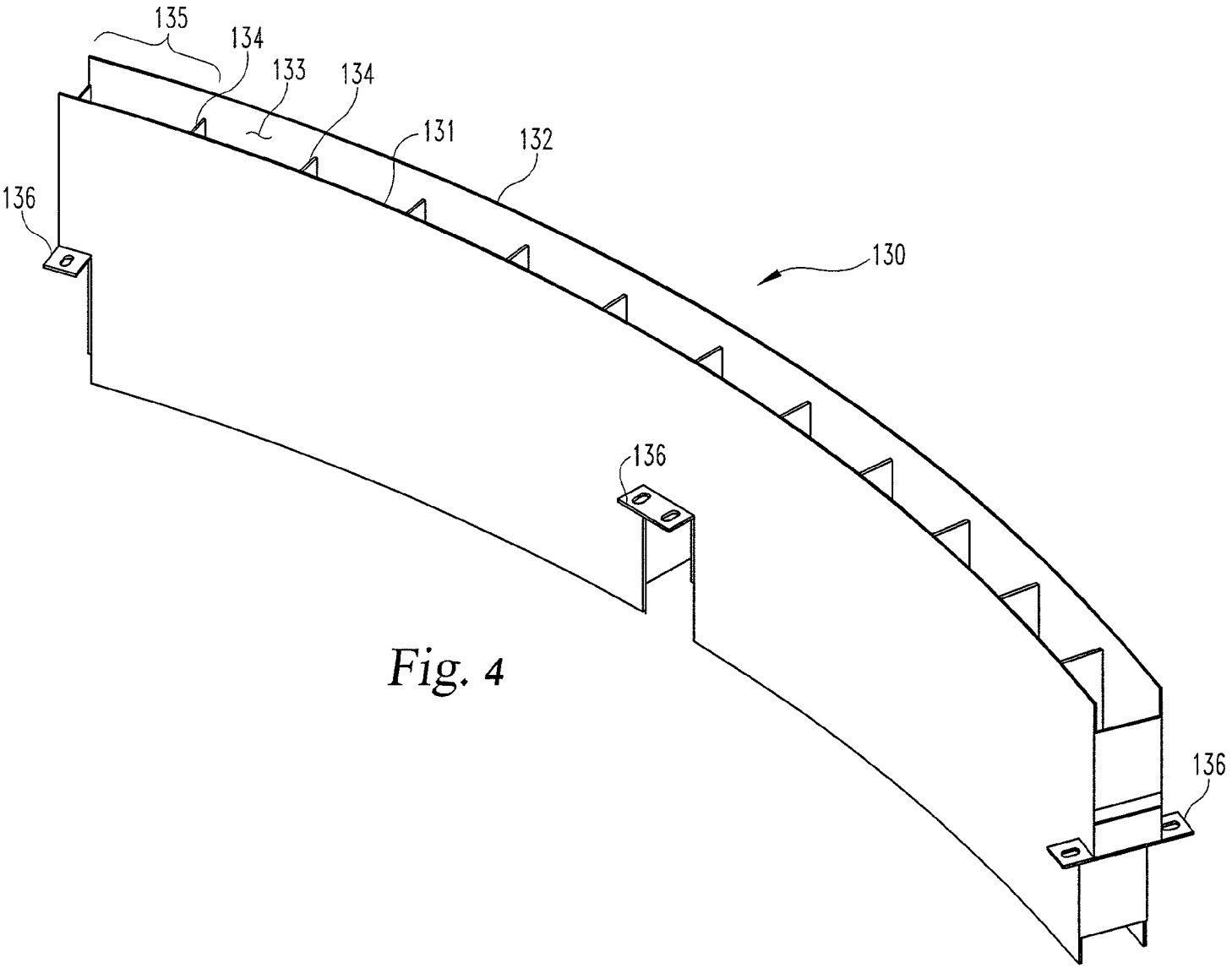
FIG. 4 is a perspective view of a trough component of the magnetic separator embodiment of FIG. 1.

FIG. 4 depicts a representative component 130 that can be used for assembly of one of troughs 121, 122, 123, 124, 125, 126 on rotor 105, and which comprises an arcuate segment of one of troughs 121, 122, 123, 124, 125, 126. Component 130 includes curved inner vertical wall 131 and curved outer vertical wall 132 defining channel 133 therebetween. In one embodiment, channel 133 is about four inches wide (i.e., the distance between inner wall 131 and outer wall 132 is about four inches) and has a height of about twelve inches. In another embodiment (not shown), components 130 are formed to have a greater height to thereby define a deeper trough. Deeper troughs can be desirable, for example, to prevent overflow of slurry that is introduced into the troughs during use of separator 100, as discussed in greater detail below. In another embodiment, components 130 define a channel 133 that has a height of about twenty-one inches. In one embodiment, the height of channel 133 is dimensioned such that channel 133 provides a distance of at least six inches between the top of the magnetic matrix material positioned in channels and the top of component 130. In another embodiment, the height of channel 133 is dimensioned such that channel 133 provides a distance of at least nine inches between the tope of the magnetic objects positioned in the channels and the top of component 130. In yet another embodiment, the distance is at least twelve inches. In other embodiments, various alternative heights can be employed. For example, in one embodiment, the height of channel 133 is from about twelve to about twenty-four inches. In another embodiment, the height is from about fourteen to about twenty-two inches.

Component 130 also includes a plurality of radially-oriented spaced apart vertical separating walls 134 that separate channel 133 into channel sections 135. Separating walls 134 preferably extend from near the top to near the bottom of troughs 121, 122, 123, 124, 125, 126. In one embodiment, such as an embodiment in which channel 133 has a height of about twelve inches, walls 134 have a height of about eight inches. In another embodiment in which channel 133 has a greater height, it is preferred that separating walls 134 also have a similarly greater height. For example, in one embodiment, the tops of separating walls 134 are from about two to about six inches below the tops of side walls 131, 132. In one embodiment, walls 134 are spaced out from one another about six inches, thereby providing channel segments 135 having arc lengths of about six inches. In other embodiments, walls 134 are spaced apart lesser or greater distances, thereby providing channel segments 135 having lesser or greater arc lengths. Component 130 also includes flanges 136 positioned and oriented for attachment to radial support frame components 116, for example by bolting the flanges to frame components 116 or by other attachment means as would occur to a person of ordinary skill in the art.

As discussed above, component 130 depicted in FIG. 4 is a representative example of a portion of troughs 121, 122, 123, 124, 125, 126; and it is understood that multiple parts having the general shape of component 130 are utilized to assemble a full 360° trough. Moreover, it is understood that components for assembling different ones of troughs 121, 122, 123, 124, 125, 126 in the example of FIG. 1 have different radii of curvature and different arc lengths due to the varying distances of the respective troughs from the vertical axis. Specifically, and by way of example, because trough 121 is positioned closer to the vertical axis than trough 122, trough 121 will have a smaller radius of curvature and a shorter arc length than trough 122, which is positioned further from the vertical axis.

In operation of magnetic separator 100, channel sections 135 (or channel 133 generally if separating walls 134 are omitted) contain a magnetically susceptible matrix material (not shown). The matrix material positioned within the channels can be composed of a wide variety of magnetically susceptible materials. In one embodiment, the matrix material comprises standard carbon steel screening, wire mesh, or steel mesh, that is folded upon itself in a number of plys, or "pleats" that, when well compacted, form a block of foraminous or reticulated material that fits tightly within the channels or alternatively fits tightly into removable baskets positioned in the channel compartments. In one embodiment, the wire mesh is folded with at least two and not more than six pleats and includes at least four but not more than twenty openings per square inch. In another embodiment, the matrix material comprises steel wool. In an embodiment that includes removable baskets to hold the pleated wire mesh cloth matrix or steel wool, the baskets can be readily removed and replaced to facilitate rapid change-out of the matrix material, which is useful, for example, in the event of plugging (such as with debris or oversize particles), a scheduled maintenance event, and/or deterioration of the matrix material (such as by rusting or corrosion).

In another embodiment, channel segments 135 are configured to contain a prescribed quantity per segment of discrete objects, such as, for example, hex nuts, steel shot, iron balls or spheres, with high magnetic susceptibility. The discrete objects function as magnetic field amplifiers, and can be used as the matrix material in place of the wire mesh matrix described above. While separating walls 134 are present in embodiments that employ a matrix material composed of discrete objects, walls 134 can be present or absent in embodiments employing other types of matrix materials, such as, for example, a folded screen or steel wool as described in the preceding paragraph. For convenience, the embodiments described below include discrete object matrix materials and therefore include walls 134; however, the present application expressly encompasses embodiments in which walls 134 are absent.

While not shown in FIG. 4, it is understood that, where the matrix material selected for use in a given operation is a discrete object matrix or a steel wool matrix, component 130 further includes a slurry-permeable floor (e.g. a perforated or foraminous floor—not shown) having flow elements sized to permit the treatment slurry or a fraction thereof to exit channel 133 without significant impedance, but that retains the discrete object matrix or a steel wool matrix in channel 133. In one embodiment, the foraminous floor comprises a screen consisting of slotted openings made using inverted V shaped wire to allow retainage of the discrete matrix elements while allowing passage of particles in the treatment slurry. When the discrete objects are included in channel segments 135, any apertures in the foraminous floor of channels 133 allowing flow of a slurry out of channel 133 should be structured to prevent passage of the discrete objects out of segments 135 as the slurry passes therethrough. For example, in one embodiment, apertures provided in the floors of channels 133 (not shown) are covered by a layer of screen cloth (not shown) defining openings or slot widths smaller than the smallest dimension size of the discrete objects, and thereby operative to hold the discrete objects in segments 135 as the slurry passes through segments 135. In one embodiment, the foraminous floor comprises a plurality of drop-in screens, each of which is sized and shaped to fit within one of channel segments 135. The use of drop-in screens, which are readily removable from the channel segments, allows for improved efficiency of normal maintenance, of clean-out in the event of, for example, screen failure, plugging problems, contamination events or the need to change the screen opening size to either a larger or smaller opening. A drop-in screen, as used herein, should be understood broadly. Any screen that is removable without major structural modifications to the segment 135 is understood to be a drop-in screen, including screens that are maintained in the channel segments by only gravity, quick connect devices, thumbscrews, that slide into a sleeve from below, and even screens that require a tool for removal (such as a screwdriver) but that can nevertheless be changed quickly without major structural modification to the corresponding channel segment 135.

In certain embodiments, the drop-in screens are made of a substantially rigid non-magnetic material such as stainless steel, aluminum, or polyurethane. In one embodiment, each of the drop-in screens includes a generally parallel set of rods, which set of rods provides the screening function, and at least two reinforcing members affixed to the rods in an orientation whereby the reinforcing members are generally perpendicular to the rods. The reinforcing members can be located either on top of the set of rods relative to the orientation of the screen in use or on the bottom of the set of rods. Alternatively, reinforcing members can be positioned both on top of and on the bottom of the set of rods. In one embodiment, each of the generally parallel rods has a wedge-shaped or V-shaped cross section with the pointed edge of the wedge or V shape oriented such that it points downward. In this way, the area of the openings in the screen increase as the slurry proceeds downward through the screen along its vertical flow path.

Figure 5:
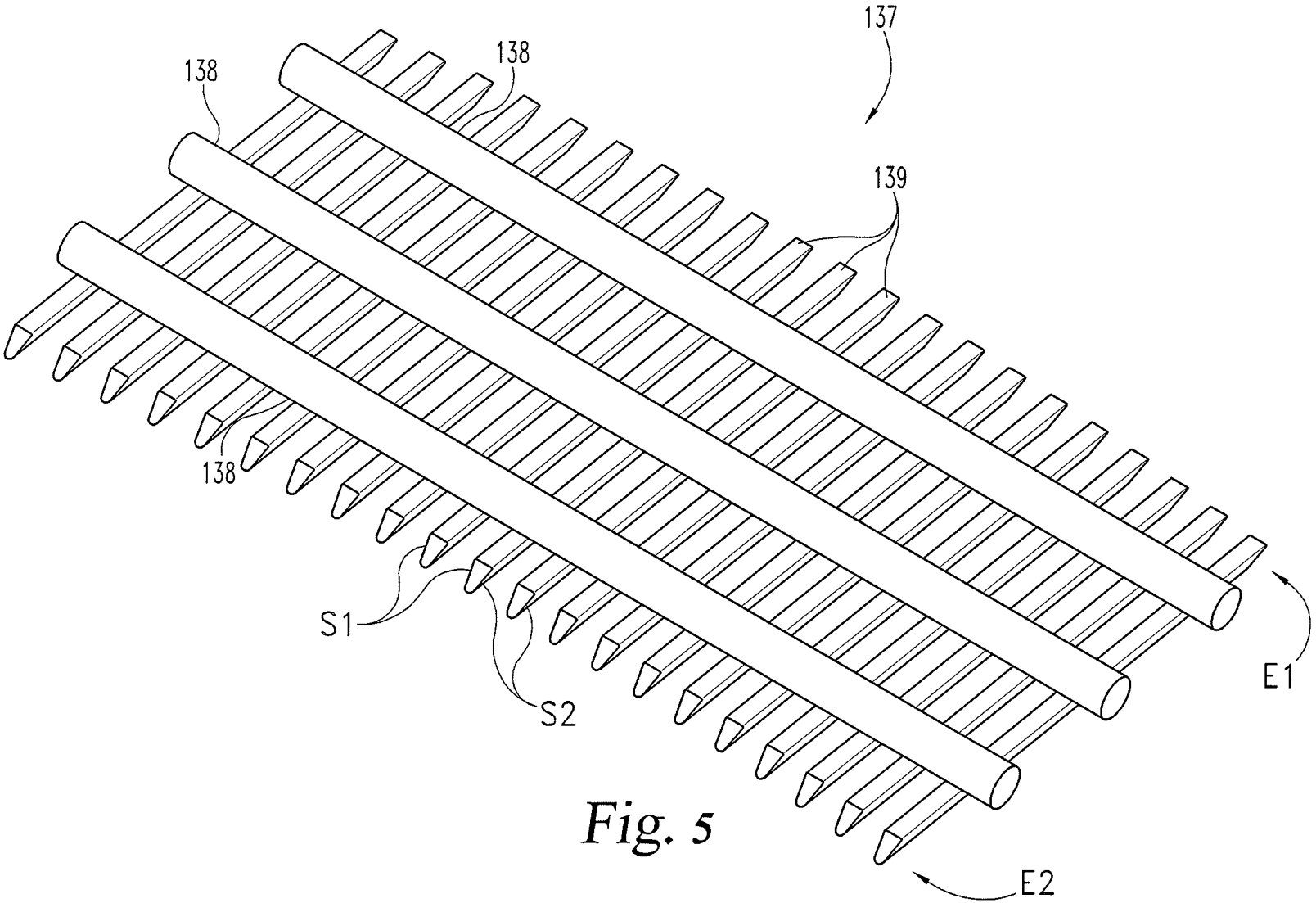
FIG. 5 is a perspective view of a drop-in screen embodiment suitable for placement in a channel segment of a magnetic separator embodiment described herein.

One embodiment of a drop-in screen, also referred to as a "drop-in screen cloth" or "screen cloth" is shown in FIG. 5, in which screen 137 includes three generally round support bars 138 oriented lengthwise along screen 137 and a plurality of generally wedge-shaped screen bars 139 oriented generally perpendicular to support bars 138 and affixed to the underside of support bars 138 when screen 137 is positioned for use. Installation of screen 137 with the round support bars oriented upward orients wedge-shaped screen bars 139 in a manner whereby surfaces S1 and S2 of screen bars 139 define draft angles having a downward-opening orientation. As used herein, the term "draft angle" refers to an angle between surfaces S1 and S2 and a vertical line passing through screen 137 perpendicular to a plane defined by screen 137, which corresponds generally to the perpendicular flow stream of a slurry passing through a channel. The descriptor "downward-opening" when referring to these draft angles refers to an orientation of surfaces 51 and S2 whereby the dimensions of the space between surfaces S1 and S2 is greater at the bottom side of screen 137 than at the top side of screen 137, as shown in FIG. 5, i.e., the dimensions of a flow path through screen 137 increase as a slurry flows downwardly therethrough. As depicted in FIG. 5, screen 137 also includes curved edges E1, E2 (i.e., the respective ends of screen bars 139 are cut or otherwise provided such that the ends corresponding to edges E1 and E2 form arcs corresponding to the side walls of a corresponding separator channel) so that the overall shape of screen 137 corresponds to the shape of an arcuate channel segment.

Figure 6:
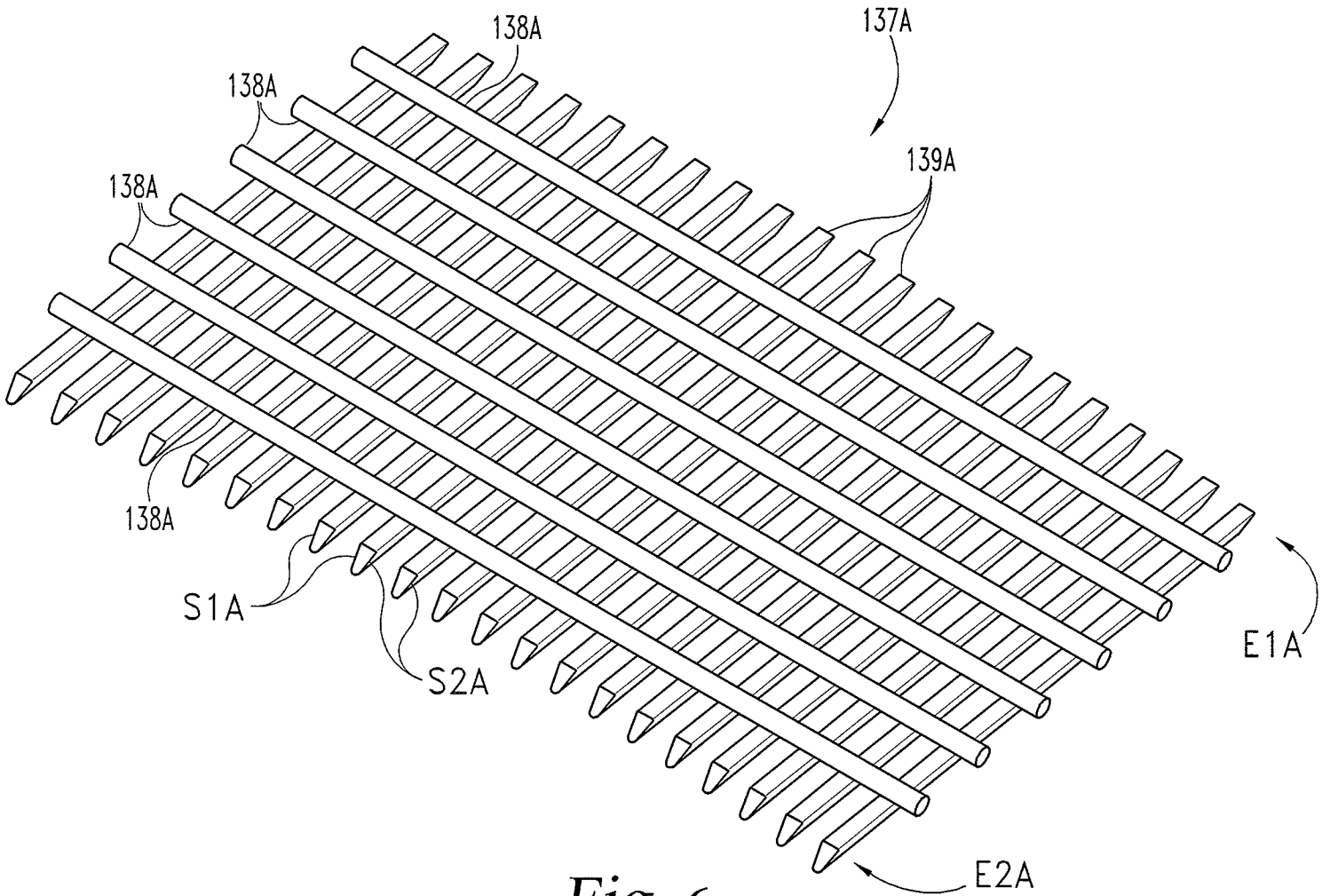
FIG. 6 is a perspective view of another drop-in screen embodiment suitable for placement in a channel segment of a magnetic separator embodiment described herein.

Another drop-in screen embodiment is depicted in FIG. 6 Screen 137A includes six generally round support bars 138A oriented lengthwise along screen 137A. Because six support bars 138A are included in this embodiment, support bars 138A are positioned closer together than support bars 138 of screen 137. This closer orientation reduces the unsupported span of screen bars 139A, which correspondingly reduces the susceptibility of screen bars 139A to becoming bent or otherwise damaged during handling and use. Screen 137A is configured for installation with support bars 138A oriented upward relative to screen bars 139A in a manner whereby surfaces S1A and S2A of screen bars 139A define draft angle having a downward-opening orientation.

Figure 7:
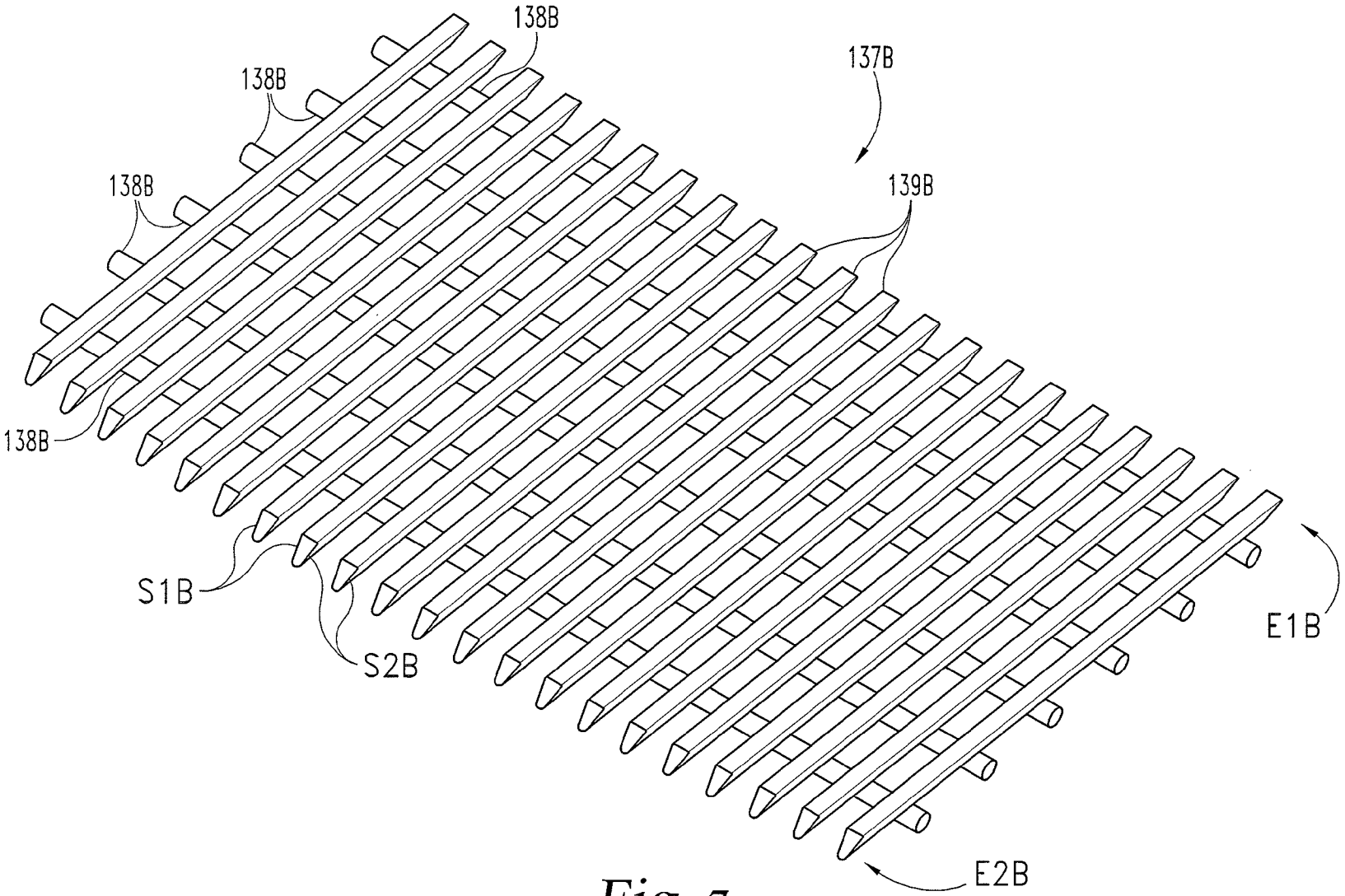
FIG. 7 is a perspective view of another drop-in screen embodiment suitable for placement in a channel segment of a magnetic separator embodiment described herein.

Yet another drop-in screen embodiment 137B, depicted in FIG. 7, includes six generally round support bars 138B oriented lengthwise along screen 137B, and includes screen bars 139B having generally wedge-like shapes. Screen 137B differs from screen 137A in the relative orientation of screen bars 139B, 139A and support bars 138B, 138A. In screen 137A, support bars 138A are positioned above screen bars 139A when screen 137A is properly installed for use (i.e., with the draft angle opening downward). In screen 137B, support bars 138B are positioned below screen bars 139B when screen 137B is properly installed for use (i.e., with the draft angle opening downward).

Figure 8:
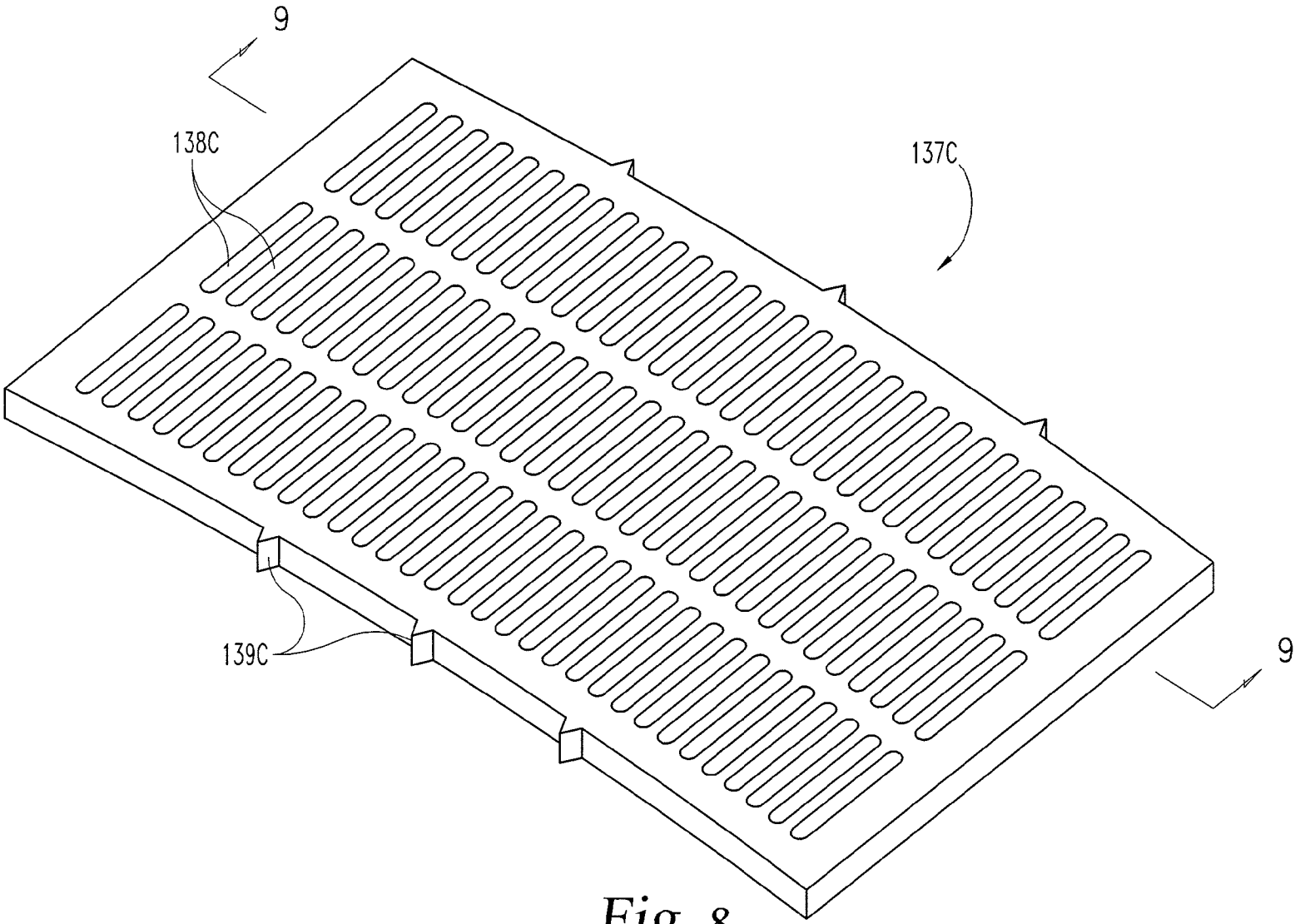
FIG. 8 is a perspective view of another drop-in screen embodiment suitable for placement in a channel segment of a magnetic separator embodiment described herein.
Figure 9:
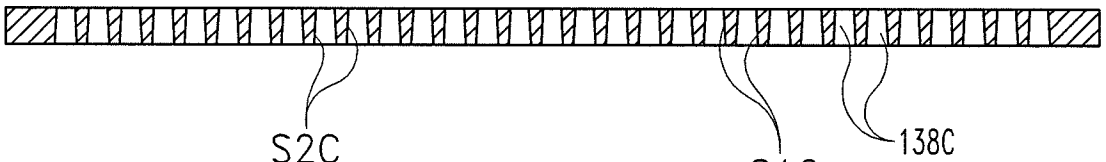
FIG. 9 is a cross section of the drop-in screen embodiment shown in FIG. 8.

Still another drop-in screen embodiment is depicted in FIGS. 8-9. Screen 137C is made from an integral sheet of material, such as, for example, stainless steel, aluminum, aluminum alloy, other metal alloy or a rugged polymer such as polyurethane. In one embodiment, screen 137C is cut from a ¼-inch 304L stainless steel plate. Screen 137C can be made, for example, by cutting slots having predetermined dimensions and locations from the plate using, for example, a two-axis waterjet machine. Slots 138C include angled side surfaces S1C and S2C to provide downward-opening draft angles as described above in connection with screens 137, 137A, 137B. While slots 138C are depicted in FIGS. 8 and 9 to have certain sizes, shapes and positions, it is to be understood that the dimensions and locations of slots 138C are variable, so long as slots 138C are sized to contain a selected matrix material within channel segments 135. For example, in one embodiment, slots 138C are positioned closer to the perimeter of the screen. In another embodiment, more or fewer than three rows of slots can be included. In one preferred embodiment, screen 137C has two rows of slots, leaving only one support section down the middle of the screen. Screen 137C can also optionally include tabs 139C along its edges if desirable to hold the screen in place in a channel segment. Tabs 139C can be filed or peened in order to respectively loosen or tighten the fit of a given screen in a given channel segment 135.

While it is not intended that the present invention be limited by an theory whereby it achieves any result, it is believed that the discrete objects in channel segments 135, when passing through the magnetic fields generated by permanent magnet members 141, 142, 143, 144, 145, 146, 147, become packed into fixed positions in channel segments 135, such as, for example, in a relatively horizontal layer as a result of the forces of gravity and of the applied magnetic fields, which packing provides an effective matrix for separating magnetic particles from non-magnetic particles as the treatment slurry passes through segments 135. After a given segment 135 passes out of a magnetic field, the discrete objects in channel segments 135 are released from the packed orientation. As a result, the use of the discrete objects in channel segments 135 provides an excellent matrix for separating magnetic particles having excellent grade, while also achieving excellent recovery and throughput together with excellent self-cleaning characteristics due to the freedom of the discrete objects to move relative to one another.

In one embodiment, the matrix used to amplify the magnetic field produced by permanent magnet members 141, 142, 143, 144, 145, 146, 147 is composed of a mixture of steel or iron shot (spheres) such as the shot used in shotgun shells or similar collections of iron or steel spheres or balls with diameters of for example 5/16 of an inch, ¼ of an inch, 3/16 of an inch or smaller down to #8 shot size. In another embodiment, the discrete objects are hex nuts, such as, for example ¼-inch size hex nuts.

In one embodiment, combinations of shot of different sizes are included in segments 135. For example, in one embodiment a combination of larger size shot, such as, for example, 5/16 of an inch diameter, ¼ of an inch diameter, F, FF, B, #00, #0, #BB, #1, #2 or #3 shot together with a smaller size shot, such as, for example, #4, #5, #6, #7 or #8 shot is included in segments 135. In one embodiment, the combination includes #2 or #3 shot together in a 1:1 ratio with a smaller size shot like a #4 or #5 shot. The combination of larger balls or shot, such as, for example, a #2 shot mixed in a 1:1 ratio with a #5 shot, are expected to give excellent recovery plus excellent flow rates and still offered the benefits of a self-cleaning matrix as the rotors of the separator turn and flush water hits the matrix. In another embodiment, the combination includes a large-size shot, such as, for example, a 5/16 of an inch diameter shot together in a 1:1 ratio with a smaller size shot, such as, for example, F shot. In one embodiment that includes a mixture of shot of different sizes, the shot is loaded into segment 135 by first introducing the smaller size shot and then introducing the larger size shot, which results in a layered formation or stratified formation with the larger shot on top and the smaller shot on the bottom. While it is not intended that the subject matter of the present application be limited by any theory, it is believed that this stratification allows enhanced flow through rate while maximizing recovery and consequently overall product output. It is also believed that the different sized shot remains generally layered in this manner even during operation of separator 100 due to the gravitational and physical forces acting on the matrix.

In yet another embodiment, the matrix material comprises discrete objects of different shapes, such as, for example, steel shot mixed with hex nuts, bolts, nails or the like. It is to be appreciated that a variety of sizes, shapes and/or ratios can be employed, and variation in the sizes, shapes and/or ratios can be useful to achieve an optimal combination of grade and recovery depending upon the actual characteristics of a slurry being treated, such as, for example, the mineral grain size, liberation degree, hematite content and nonmagnetic content. Moreover, in embodiments in which multiple different separator operations are performed (i.e., rougher, finisher, cleaner and/or scavenger operations, as discussed further below), it is possible to use different sizes, shapes and/or ratios of discrete objects in different phases of separation. As will be appreciated by a skilled artisan, where different separation phases are performed on a single turntable, the use of matrix materials of different sizes, shapes and/or ratios for the different operations will require the operations to be performed in different channels of the turntable rather than in different sectors of the turntable (see descriptions below for more details).

Figure 10:
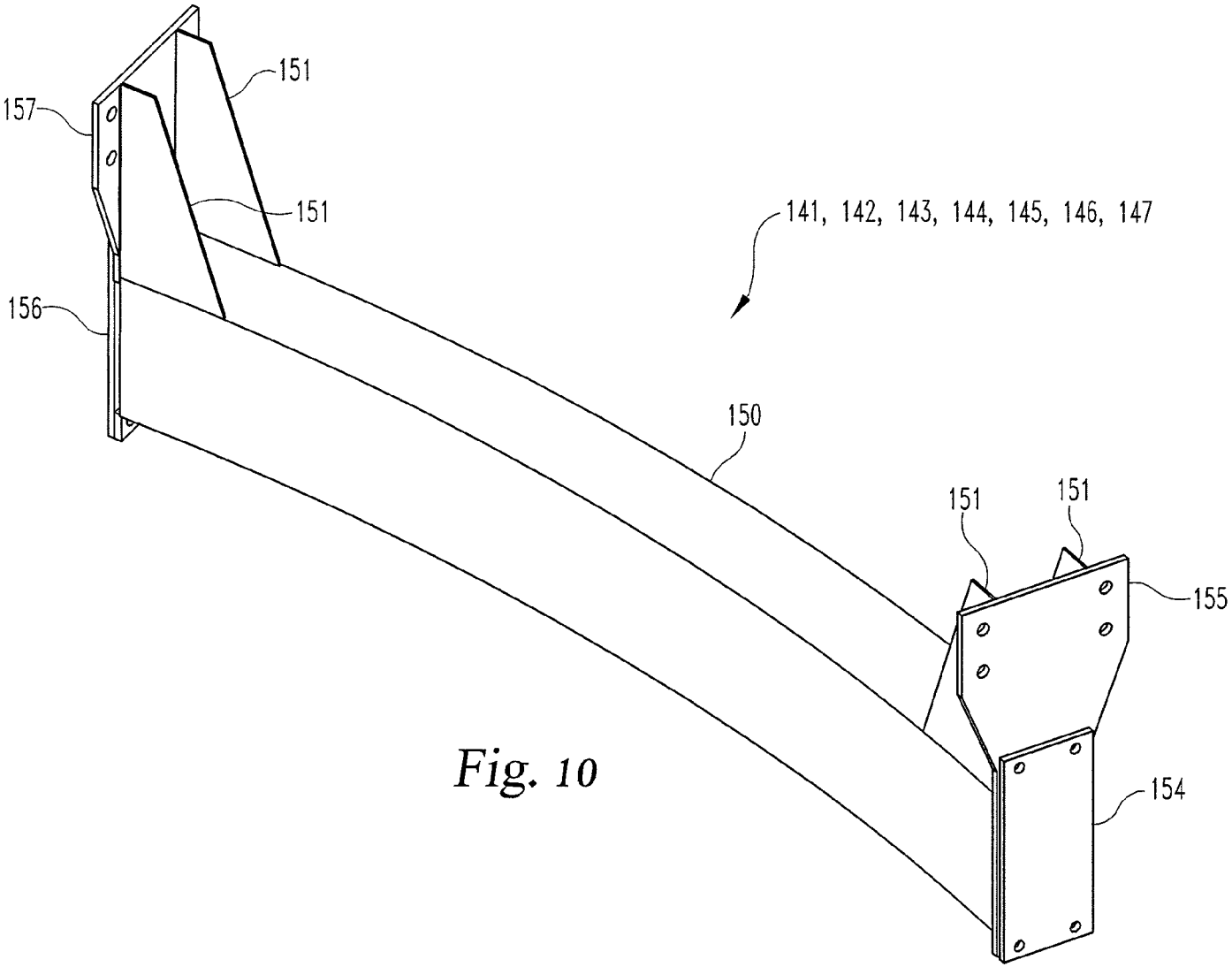
FIG. 10 is a perspective view of a curved permanent magnet member of the magnetic separator embodiment of FIG. 1.
Figure 11:
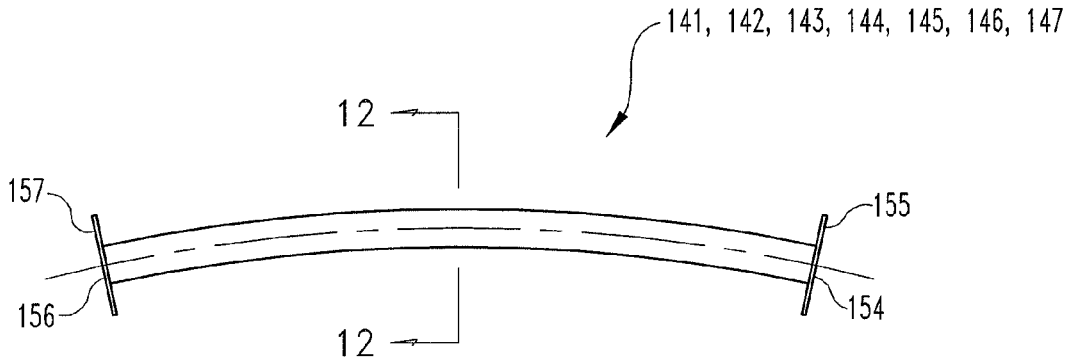
FIG. 11 is a top plan view of the permanent magnet member shown in FIG. 10.
Figure 12:
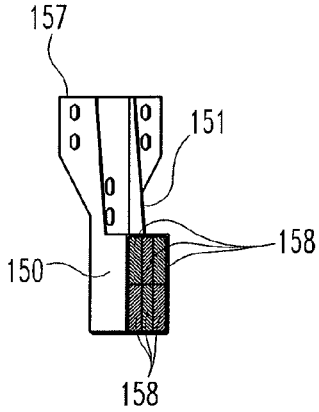
FIG. 12 is a sectional view of the permanent magnet member shown in FIGS. 10 and 11 along section line 12 in FIG. 10.

FIGS. 10-12 depict a representative example of one of curved permanent magnet members 141, 142, 143, 144, 145, 146, 147. Each of magnet members 141, 142, 143, 144, 145, 146, 147 includes hollow body 150, also referred to herein as a "magnet can," in the form of a curved rectangular tube and end plates 154, 156 affixed to body 150. Each of end plates 154, 156 includes a flange 155, 157 configured to be attached to radial members of the fixed separator frame (not shown) of magnetic separator 100 to mount magnet members 141, 142, 143, 144, 145, 146, 147 to the frame. Body 150 also includes structural support members 151. Body 150, end plates 154, 156 and support members 151 can be, for example, composed of stainless steel. As depicted most clearly in the cross section set forth in FIG. 12, a set of permanent magnet members 158 are contained inside body 150. Magnets 158 can be positioned in body 150 through an end thereof, and then are held in place by attachment of end plates 154, 156 to body 150. In the cross section shown in FIG. 12, six separate permanent magnets are contained in side by side and stacked relationship in body 150. An example embodiment includes multiple magnets contained in each magnet can to substantially fill body 150 along its arc length, i.e., from end plate 154 to end plate 156. Alternatively or additionally, permanent magnet members 141, 142, 143, 144, 145, 146, 147 are made using individual permanent magnets having dimensions of about 1 inch×4 inches×6 inches (not shown). A further example includes ten such magnets formed into a magnet block having dimensions of about 5 inches×8 inches×6 inches by gluing the ten magnets to one another in a 2×5 stacked arrangement. A specifically still further example includes two groups of five magnets, each glued together in side by side relationship, with the poles of the respective magnets aligned, and then one of the groups is glued to the other group in a stacked relationship, again, with the poles of the magnets aligned. Multiple magnet blocks made in this way are then pushed into the magnet can through one end, with the poles of the magnets aligned, and held in place by attachment of end plates 154, 156 to body 150.

In one embodiment, permanent magnet members 141, 142, 143, 144, 145, 146, 147 are oriented such that the magnetic north pole of the collective magnets in each permanent magnet member faces toward the virtual axis of the rotor, and the south pole faces away from the virtual axis of the rotor. Orientation of permanent magnet members in this manner defines a single magnetic zone that spans each of the channels in one radial section of the separator. With multiple permanent magnet members positioned in a given sector of the separator, the magnetic members in a given sector enhance the magnetic effects of one another, thereby generating an intensified magnetic field in a given sector of the separator. Using magnets made in the manner described herein, and arranged as shown in FIG. 1, each magnetic zone 140 is capable of generating a magnetic field having a localized filed strength of from about 50,000 to about 70,000 gauss at the contact points between the discrete matrix materials present at the center of magnetic zone 140. In another embodiment, permanent magnet members 141, 142, 143, 144, 145, 146, 147 are oriented such that the magnetic south pole of the collective magnets in each permanent magnet member faces toward the virtual axis of the rotor, and the north pole faces away from the virtual axis of the rotor.

While the magnetic zones depicted in FIG. 1 appear to have greater arc lengths than the corresponding nonmagnetic zones, it is not intended that the present application be limited to any such proportions. In one embodiment, the arc lengths of the magnetic zones 140 are less than the arc lengths of the nonmagnetic zones 178. In another embodiment, the arc lengths of the magnetic zones 140 are from about 50% to about 200% of the lengths of the corresponding nonmagnetic zones 178.

In one embodiment, magnetic separator 100 includes a field maximizing system (not shown) configured to shunt magnetic filed lines such that maximum field density is achieved in the gaps between permanent magnet members 141, 142, 143, 144, 145, 146, 147, i.e., the gaps through which troughs 121, 122, 123, 124, 125, 126 pass. The field maximizing system can include, for example, a first backing plate (not shown) attached to the inner wall of the innermost permanent magnet member (i.e., magnet member 141), a second backing plate (not shown) attached to the outer wall of the outermost permanent magnet member (i.e., magnet member 147), and a connecting steel member (not shown) connecting the first and second backing plates and thereby transmitting the magnetic field between the first and second backing plates. An example embodiment includes a structural support beam of the fixed structural frame from which the permanent magnet members are supported operating as the connecting steel member. In this way the first and second backing plates and the connecting steel member shunt the magnetic field lines such that maximum field density is achieved in the gaps between the permanent magnet members and thereby the matrix material passing therethrough is subjected to an enhanced magnetic field density for maximum amplification at the touch points between discrete matrix objects. These touch points, with maximum amplification, exhibit a strong attraction for magnetic particles in the treatment slurry, and operate as pickup points to attract and retain the magnetic particles. As will be appreciated by a person skilled in the art, each of the nine sets of permanent magnets 140 in separator 100 can optionally include a field maximizing system as described above. Alternatively, some, but not all of permanent magnet sets 140 can include a field maximizing system.

Figure 13:
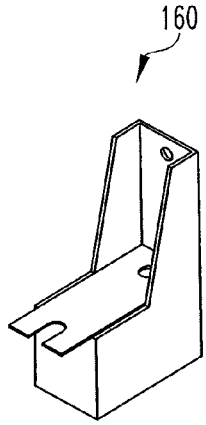
FIG. 13 is a perspective view of a jump magnet of the magnetic separator embodiment of FIG. 1.

Magnetic separator 100 also includes optional jump magnets 160. With reference to FIG. 1, jump magnets 160 are attached to the trailing end of magnet members 141, 142, 143, 144, 145, 146, 147, relative to the direction of rotation R of rotor 105. As used herein, the term "trailing end" is intended to indicate the end of magnet members 141, 142, 143, 144, 145, 146, 147 that is passed last by a given point of troughs 121, 122, 123, 124, 125, 126 as rotor 105 turns in direction R. As shown in FIG. 13, brackets for individual jump magnets 160 are provided with openings for bolting or otherwise affixing the jump magnets to the magnet members. In one embodiment, the openings in the brackets are provided as vertical and/or horizontal slots to allow for vertical and/or horizontal adjustment of the position of jump magnets relative to the magnet members, and thus relative to the troughs and compartments holding discrete matrix objects that pass thereby. Jump magnets are desirably included in embodiments in which the matrix material contained in one or more of channels 133 is a discrete object matrix, and operate to provide a jolt to the matrix as or immediately after a given channel segment 135 passes out of the magnetic zone defined by a given permanent magnet set 140, thereby assisting in dislodging magnetic particles adhered to the matrix in the magnetic zone for recovery as the channel passes into a non-magnetic zone between adjacent permanent magnet sets 140. The "jolt", as used herein, includes agitation, physical manipulation of the relative position of individual elements of the discrete object matrix within the channel 133, and/or an impulse motion of individual elements of the discrete object matrix within the channel 133.

The jolt produced by the jump magnets, additionally or alternatively accompanied by spray water, effectively removes entrapped particles from the matrix in a nonmagnetic zone. While jump magnets can be attached to each one of magnet members 141, 142, 143, 144, 145, 146, 147 in each sector of the separator, in alternate embodiments, jump magnets 160 are included in some, but not all, of magnet sets 140, or are attached to some, but not all, of magnet members 141, 142, 143, 144, 145, 146, 147 in a given magnet set 140. For example, in an embodiment that includes ten sectors, jump magnets can be installed on each magnet member in five of the ten magnet sets, in one example on each magnet member in every second magnet set around the rotor. Other embodiments are contemplated in which jump magnets are absent, and other sources of force are used to jostle or jiggle the discrete matrix objects to dislodge and effectively clean out the matrix of entrapped particles. Another jostling method includes the use of vibrators or rapid oscillators attached to strategic locations in or around the nonmagnetic zones. Another method includes the use of rumble strips or intentionally created bumps on the surface on which carriage wheels 115 roll, which may be, for example, a bearing plate or a rail. Such bumps or rumble strips would also serve to mechanically agitate the discrete matrix which, together with strategically positioned high pressure spray water pipes and nozzles, assist with dislodging particles from the magnetic matrix in the nonmagnetic zones.

As will be appreciated by a person skilled in the art, in operation of magnetic separator 100, rotation of rotor 105 is achieved by operation of driver 118. As rotor 105 rotates, a flow of treatment slurry is introduced into channel segments 135 at a plurality of locations within one or more magnetic zones. As used herein, the term "magnetic zone" is used to refer to an area through which channel segments 135 pass during rotation of rotor 105 at which magnet members 141, 142, 143, 144, 145, 146, 147 straddle channel 133 and apply a magnetic field across channel segments 135, and is identified in the drawings by the same reference number as used to identify the set of permanent magnet members 140. With reference to the embodiment depicted in FIG. 1, with rotor turning in direction R, a flow of treatment slurry is preferably directed into channels 133 in inflow zones adjacent the leading edge of magnetic zones 140, examples of which are represented by reference numeral 170. As used herein, the term "leading edge" is intended to indicate the edge of magnetic zones 140 that is passed first by a given point of troughs 121, 122, 123, 124, 125, 126 as rotor 105 turns in direction R. Delivery of treatment slurry into channels 133 in inflow zones 170 can be accomplished, for example, by utilizing one or a plurality of treatment fluid delivery systems (not shown), which can be configured in a wide variety of arrangements as would occur to a person skilled in the art having the benefit of the disclosure herein. An example arrangement includes a treatment fluid delivery systems having one or more manifold splitter tanks (also referred to as distributors) positioned above rotor 105 and mounted on the fixed separator frame (not shown), which have a plurality of splitters, sections and outlets connected to a plurality of treatment fluid conduits for delivering a flow of treatment fluid into channels 133 at fixed locations as channels 133 rotate through inflow zones 170. Another example arrangement includes distributors having adjustable weirs (not shown) that can be made of a variety of wear resistant materials such as urethane, high density polyurethane or high wear resistant steel to provide improved control of the distribution of the slurry. In one embodiment, the distributors also include screens similar to drop-in screens 137, 137A, 137B, 137C described herein (albeit with different shapes corresponding to the shape of the respective distributor), which provides an additional safeguard against debris or other over-size particles being introduced into a channel of the separator.

Magnetic separator 100 also includes a water delivery system (not shown) for introducing a flow of water into channels 133 at various positions. For example, with reference to the embodiment depicted in FIG. 1, a flow of rinse water can be directed into channels in rinse water zones, examples of which are represented by reference numeral 175. Each of zones 175 is within the magnetic zones of separator 100, and a flow of water through channels 133 in zone 175 can assist with washing nonmagnetic particles from channels 133 while the matrix material in channels 133 is in a magnetically energized state, and thus continues to adhere to magnetic particles captured from the treatment slurry. An example water delivery system (not shown) is also configured to introduce a flow of water through channels 133 in flush water zones, examples of which are represented by the reference numeral 178, which are co-extensive with the nonmagnetic zones discussed above. While it is understood that some residual magnetic field may exist in flush zones 178 by virtue of the proximity of magnet members 141, 142, 143, 144, 145, 146, 147, nonmagnetic zones 178 represent areas where channel sections 135 are not straddled by magnet members, and thus represent areas of lower influence of magnet members 141, 142, 143, 144, 145, 146, 147 within channels 133. Thus, zones 178 alternatively can be referred to as zones of zero or weaker magnetic field, and the present description is to be read in light of same.

In flush zones 178 the flow of flush water through channel segments 135 is effective to flush magnetic particles from channel segments 135 while the matrix material in channel segments 135 is in a nonmagnetic (or only weakly magnetic)

state. Jump magnets 160, discussed above, operate to assist the flushing of magnetic particles from channel segments 135 in zones 178 by causing the matrix material to be jolted, preferably within, or just prior to a point where flush water is passing through channel segments 135. Delivery of water into channel segments 135 in zones 175 and/or 178 can be accomplished, for example, by utilizing one or a plurality of water delivery systems (not shown), which can be configured in a wide variety of manners as would occur to a person skilled in the art. For example, water delivery systems can be in the form of one or more manifold holding tanks (also referred to as distributors) positioned above rotor 105 and mounted to the fixed separator frame, which have a plurality of outlets connected to a plurality of water conduits for delivering a flow of water into channels 133 at fixed locations as channel segments 135 rotate through zones 175 and/or 178. Alternatively, water delivery systems can be in the form of hoses and nozzles that are supplied with water at a desired pressure using conventional plumbing apparatus, and which deliver water into channels 133 at fixed locations as channel segments 135 rotate through zones 175 and/or 178. In theory, after a given channel segment 135 moves from flush zones 178 and into a subsequent magnetic zone 140, no portion of the treatment slurry remains in the channel segment 135 at that point.

Alternate embodiments of the water delivery system can have a variety of different features. For example, in one embodiment components of the water delivery system that are configured for delivery of water into channel segments 135 in zones 178 for flushing magnetic particles from channel segments 135 can be arranged to deliver a higher volume of water and/or to deliver water at a higher velocity in one or more of these zones to more thoroughly dislodge magnetically susceptible particles from the matrix materials in these zones and move these particles into the concentrate launders thereunder.

In another embodiment, components of the water delivery system that are configured and positioned for delivery of water into channel segments 135 in zones 178 for rinsing magnetically susceptible particles from channel segments 135 can be arranged to deliver sprays of water into channel segments 135 from below (referred to herein as "under sprays"). For example, an under spray nozzle can be positioned above a concentrate launder and below one or more of troughs 121, 122, 123, 124, 125, 126, 221, 222, 223, 224, 225, 226 and oriented to spray water into one or more of troughs 121, 122, 123, 124, 125, 126, 221, 222, 223, 224, 225, 226 in an upward direction. In one embodiment, for example, under spray nozzles can be provided beneath each trough in every other sector of both the rougher and cleaner/finisher rotors. Under spray nozzles are preferably positioned such that water streams delivered through the under spray nozzles impact the underside of the matrix materials contained within channel segments 135 as a given channel segment 135 passes thereover. In one embodiment, these spray nozzles are positioned laterally from about 6 to about 18 inches from a boundary between a magnetic zone and a non-magnetic zone in the direction of rotation of the channel. In one embodiment, the under spray nozzles are configured and positioned to shoot water into channel segments 135 in a directly upward (i.e., vertical) direction. In another embodiment, the under spray nozzles are zero degree full stream spray nozzles of capacity size 80 operating at between 15 and 20 psi of pressure. Nozzles of this type are readily available commercially. For example, a suitable under spray nozzles available commercially is part number H3/8U-0080 from Spraying Systems Inc.

As will also be appreciated by a person skilled in the art, magnetic separator 100 also includes launders positioned below rotor 105 in an arrangement whereby a fraction of the treatment slurry that passes through a magnetic zone is collected in one or more launders positioned beneath permanent magnet sets 140 as a tailings fraction, and a fraction of the treatment slurry that is washed from channel egments 135 beneath nonmagnetic zones 178 is collected in one or more launders positioned beneath nonmagnetic zones 178 as a concentrate fraction. The concentrate fraction has a higher content of magnetic particles than the treatment slurry, and can be stored, shipped, sold as a commodity or further concentrated in subsequent separation operations. The tailings fraction has a lower content of magnetic particles than the treatment slurry, and can be discarded, sold as a commodity or passed through further separation operations to scavenge remaining magnetic particles therefrom.

Launders can have a wide variety of configurations as would occur to a person skilled in the art. For example, circular launders can be provided beneath, and having similar dimensions to, each of channels 133. In one embodiment the dimensions of the circular launders are larger than the dimensions of the channel above. Because a slurry or water passing through the channels or channel segments tends to adhere to the sides of the channels before falling vertically due to surface tension of the water, the use of launders having larger dimensions improves the likelihood that the slurry or water falling from a given channel is still caught in the launder below. One skilled in the art can easily determine how much larger the dimensions of a given launder should be relative to the corresponding channels to catch all or nearly all of the passing slurry. In one embodiment, the dimensions of the circular launders are at least two inches and preferably about six inches larger than the dimensions of the channel above; however it is not intended that the invention be limited to the foregoing dimensions.

Launders of this type include dividing walls positioned near the leading edge of each of magnetic zones and near the trailing edge of each of magnetic zones 140, relative to the rotation of rotor 105. Because magnetic separator 100 includes nine magnetic zones 140 and nine nonmagnetic zones 179, this arrangement separates each circular launder into eighteen launder sections. Each launder section can have a hopper-style floor slanting toward a launder outlet, to which a hose or other conduit can be attached for transporting the fraction collected in each individual launder to an appropriate receptacle, such as, for example, a sump or a slurry distributor.

Alternatively, in some embodiments, there is no need to separate the respective fractions obtained from each channel individually, and therefore radially configured and positioned launders can be provided that collect the tailings fractions from all six channels in a given sector of the separator into a single tailings launder, and collect the concentrate fractions from all six channels in a given sector of the separator into a single concentrate launder. Given that there are nine sectors in magnetic separator 100, in an embodiment utilizing radially configured and positioned launders, separator 100 would include nine tailings launders beneath, and having dimensions generally corresponding to, the dimensions of each of magnetic zones 140, and would include nine concentrate launders beneath, and having dimensions generally corresponding to, the dimensions of each of nonmagnetic zones 178. In another embodiment, in which the magnetic separator includes ten sectors, the separator would include ten tailings launder sections beneath, and having dimensions generally corresponding to, the dimension of each of the ten magnetic zones, and would include ten concentrate launder sections beneath, and having dimensions generally corresponding to, the dimensions of each of the ten nonmagnetic zones. Stated alternatively, this separator embodiment includes ten collection launder sections, each collection launder section including a tailings launder section and a concentrate launder section. An embodiment of a launder system of this type is shown in FIGS. 14 and 15.

Figure 14:
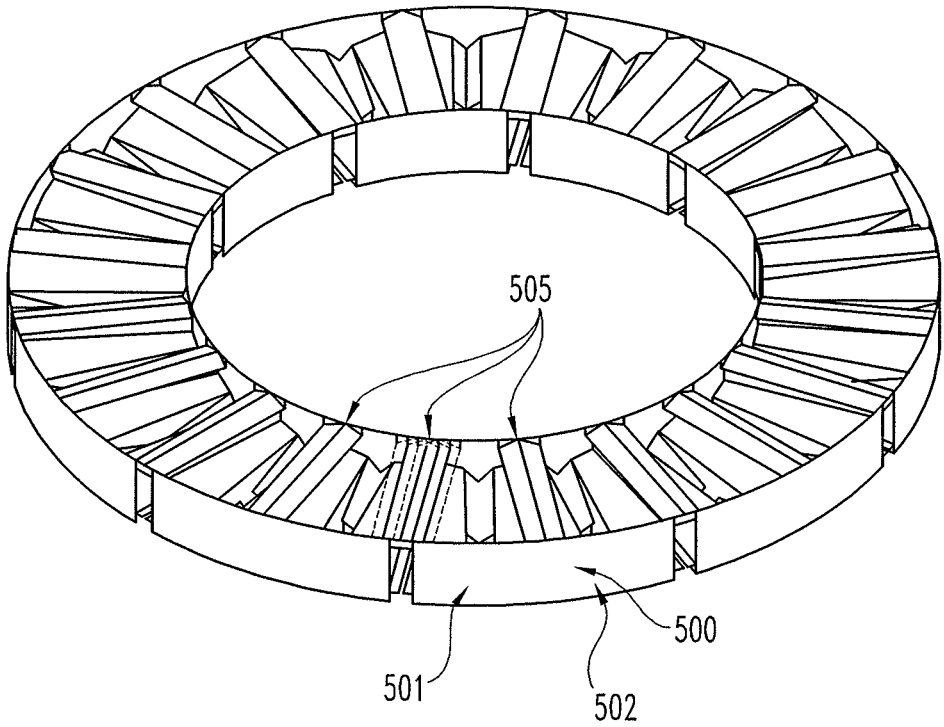
FIG. 14 is a perspective view of collections launders that are positioned under separator rotors of a magnetic separator embodiment having ten sectors.
Figure 15:
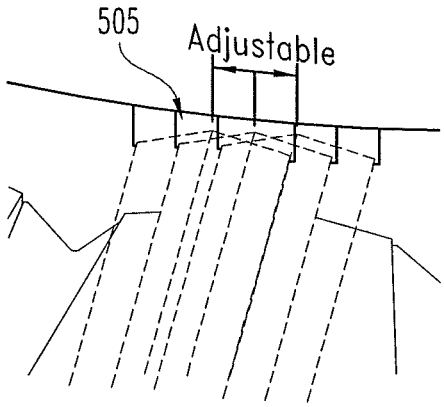
FIG. 15 is a closer-up perspective view of collection launders depicted in FIG. 14 showing a position-adjustable divider.

In the embodiment shown in FIGS. 14 and 15, dividing walls separate each tailings launder section from each adjacent concentrate launder section. The dividing walls comprise an inverted V shape divider plate 505 having end portions that rest on, but are not rigidly affixed to, inner and outer side walls of the launder system. With this configuration, divider plates 505 are configured to be horizontally adjustable so that the positioning of the dividing walls, defined by the apex of the inverted V, can be altered if desired to optimize the separation of concentrate and tails into different launder sections depending upon the specific process parameters being employed. The embodiment depicted in FIGS. 14 and 15 is configured for a separator that includes ten sectors, and thereby includes ten magnetic zones and ten nonmagnetic zones. This arrangement separates the launder system into twenty launder sections, which includes one tailings launder section and one concentrate launder section in each collection launder section that corresponds to one of the ten sectors of the separator.

With reference to the launder system embodiment depicted in FIGS. 14 and 15, collection launder section 500 includes a tailings launder section that collects tailings beneath one respective magnetic zone of the separator and discharges tailings through tailings discharge port 501, and a concentrate launder section that collects concentrate beneath one respective nonmagnetic zone of the separator and discharges concentrate through concentrate discharge port 502.

As with the circular launders described above, the radially oriented launders of this embodiment can have a hopper-style floor slanting toward a launder outlet, to which a hose or other conduit can be attached for delivering the fraction collected in each individual launder to be transported to an appropriate receptacle, such as, for example, a sump or a slurry distributor. In one embodiment, at least a portion of the slanted floor of the launders has a grooved or a zig zag floor configuration. The zig zag configuration has been found to facilitate flow of the slurry to the respective discharge ports 501, 502 and into the respective hoses and to reduce the degree to which suspended particles settle out of tailings or concentrate slurries as the case may be. In one embodiment, the slanted floor of the launders is composed of V shaped pieces of angle iron, or similarly angle shaped steel, which are welded together to form a floor with a zig zag shape.

In one embodiment, as discussed above, the outlets of the tailings launder sections and concentrate launder sections are connected to hoses that convey the collected tailings fractions and concentrate factions, respectively, from the respective launders to slurry delivery systems or sumps outfitted with pumps and pipelines as described herein. The hoses are preferably reinforced hose due to the significant forces placed on the hoses by the weight of the slurry fractions carried therein and the positive and/or negative pressures to which the hoses are subjected as the fluids are carried, in some cases for significant distances and over significant elevational drops. In one embodiment, some or all of the hoses comprise spiral wound wire reinforced hose. In another embodiment, one or more, and preferably each, of launder outlets (i.e., tailings discharge ports 501 and concentrate discharge ports 502) has a reducer (not shown) connected thereto to provide for improved flow of the respective slurry from the collection launder and into and through the hose or other conduit connected thereto. The presence of the reducer improves the rate of flow of the slurry out of the collection launder, thereby ensuring optimal flow rates of slurries through the separator. In one embodiment, the reducers are concentric reducers; however, eccentric reducers can be used also.

Figure 16:
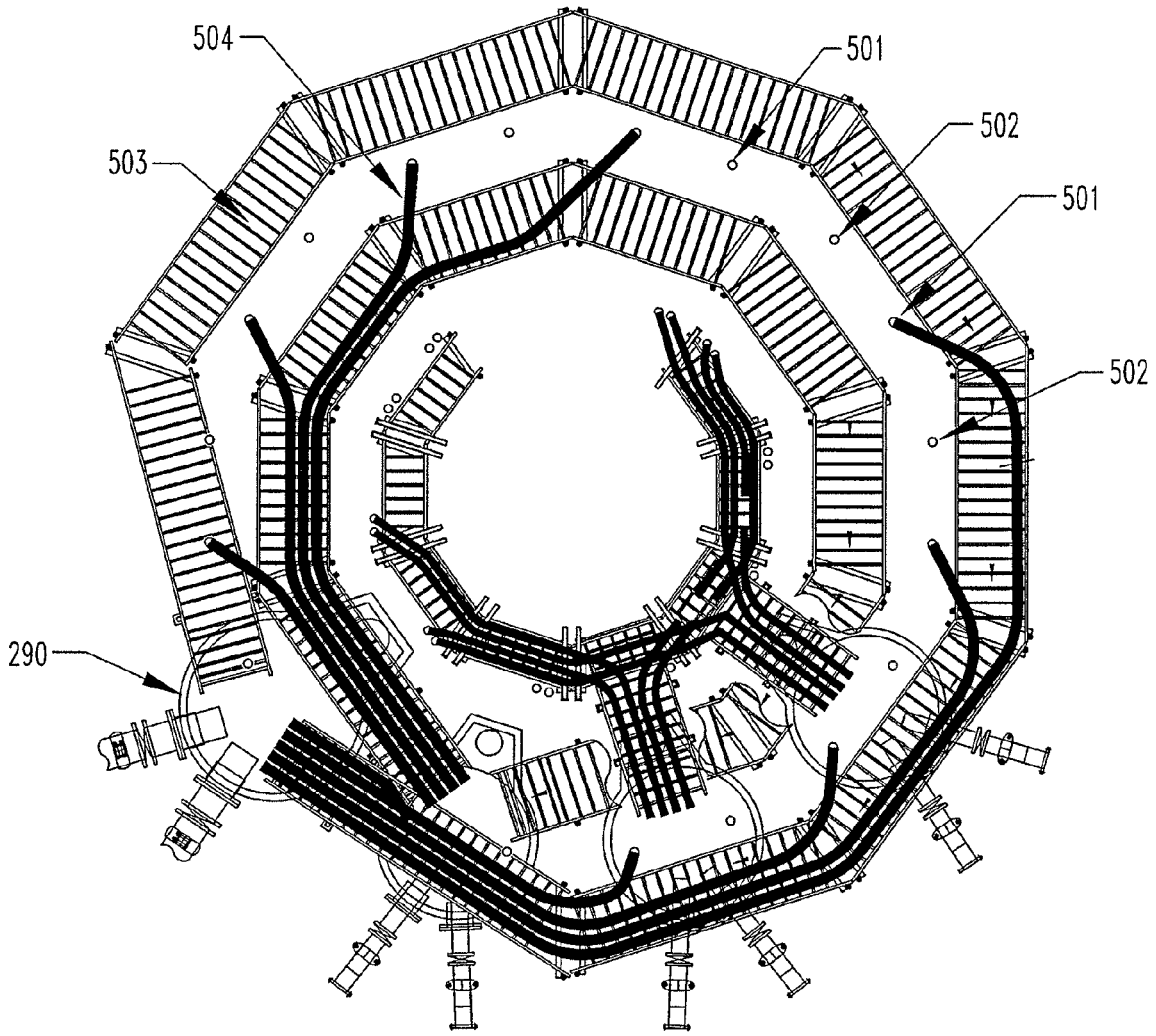
FIG. 16 is a top plan view of hose support trays of a magnetic separator embodiment having ten sectors.

In addition, due to the significant weight of the hoses and the slurry fractions carried therein, separator 100 includes hose supports positioned along the path from the respective launders to the respective sumps to which the respective slurry fractions are to be conveyed. In one embodiment, the hose supports comprise support trays upon which the hoses rest, such as, for example, electrical cable trays, which are well known and readily available commercially. The support trays are affixed to the separator frame, and can be configured, for example, in spiral pathways having a slope that allows for acceptable flow rates of the slurry fractions therein under the force of gravity, while also bearing a sufficient proportion of the weight of the hoses and slurry fractions contained therein allowing for reliable operation. With reference to FIG. 16, hose support tray 503 is shown for a magnetic separator embodiment that includes ten sectors. Also shown schematically in FIG. 16 are representations of tailings discharge ports 501 and concentrate discharge ports 502, and an example hose run 504. In another embodiment reinforced hose is used to convey slurry from the bottom of the distributors to the channels containing discrete magnetic objects rotating on the rotor.

Because magnetic separator 100 includes nine sectors, each including a magnetic zone 140 and a nonmagnetic zone 178, the individual sectors of separator 100 can optionally be used to conduct different separation operations, such as, for example, separations referred to as rougher separations, finisher separations, cleaner separations and scavenger separations. The term "rougher" is used herein to refer to a separation process applied to a treatment slurry starting material; the term "finisher" is used to refer to an optional intermediate stage of separation applied to a first concentrate fraction obtained from a rougher separation stage to further concentrate the magnetic particles in the first concentrate fraction; the term "cleaner" is used to refer to a final separation applied to a concentrate fraction, either from a rougher stage or from a cleaner stage, depending upon the process design being employed, which produced a final concentrate product; and the term "scavenger" is used to refer to an optional separation applied to a tailings fraction from the rougher stage, and is used to scavenge magnetic particles that may have found their way into the rougher tailings. As will be appreciate by a person skilled in the art, separator 100 can be used to perform a plurality of these functions on a single turntable by simply arranging launders and material feed systems to pass selected fractions back through the separator in different magnetic zones 140, thereby using different sectors for different separation operations.

For example, in an embodiment in which rougher, cleaner and scavenger operations are desired, separator 100 can be set up to deliver the treatment slurry to three of the nine magnetic zones 140, thereby using three sectors of separator 100 as a rougher separation phase, below which a first concentrate fraction and a first tailings fraction can be collected in launders as described above. The first concentrate fraction (also referred to as a rougher concentrate fraction) can be transported to a position above rotor 105, and delivered to a second set of three magnetic zones 140, thereby using three separation sectors in a cleaner operation. Below these three separation sectors, a second concentrate fraction (also referred to as a cleaner concentrate fraction) and a second tailings fraction (also referred to as a cleaner tailings fraction) can be collected in launders as described above. The second concentrate fraction is a final product of the separation. The second tailings fraction can be discarded, or can optionally be mixed into the treatment slurry and recycled to the rougher phase for further treatment. The first tailings fraction (collected beneath the portion of rotor 105 being used for the rougher separation, also referred to as a rougher tailings fraction) can be transported to a position above rotor 105 and delivered to a third set of three magnetic zones 140, thereby using three separation sectors in a scavenger operation. Below these three separation sectors, a third concentrate fraction (also referred to as a scavenger concentrate fraction) and a third tailings fraction (also referred to as a scavenger tailings fraction) can be collected in launders. The third concentrate fraction can be combined with the second concentrate fraction as a final product of the separation, or can optionally be mixed with the treatment slurry and recycled to the rougher phase for further treatment. The third tailings fraction can be discarded, or sold as a commodity.

The use of hoses to deliver slurry fractions from the launders to various sumps or from the various distributors to the channels as described above also provides the advantage of flexibility of the separator to readily alter the system flow diagram by simply repositioning the outflow end of a hose to a different sump or receptacle, thereby rerouting a flow stream from a given sector or channel of the separator rotor. For example, as discussed in more detail below, if an operator of the separator wishes to send some portion of the cleaner concentrate through the separator again for further upgrading of the concentrate, this can be efficiently done by moving the outflow end of the hose carrying the cleaner concentrate to a sump that contains a slurry that is to be passed again through a sector of the separator rather than to the final concentrate product receptacle or sump. Similarly, if the operator wishes to perform a scavenging operation from a rougher tails, or final tails, fraction, the outflow end of one or more hoses carrying this fraction can be repositioned into a sump containing a feed slurry for one of the subsequent passes through a sector of the separator, such as, for example, a finishing or cleaning step, to try to scavenge some additional iron values from the rougher tails, rather than delivering this fraction to a final tails receptacle.

As yet another option, the outflow end of one or more hoses carrying the rougher/final tails fraction can be repositioned to convey this fraction to a receptacle (i.e., a sump) that is used to feed a separate separator that is dedicated to a scavenger operation or to feed a portion of the separator producing the rougher tails with such portion of the separator dedicated to the scavenging function. Such a scavenger operation can be performed, for example, using a separator of similar configuration to those described herein, which can be operated using parameters suitable for separating a scavenger concentrate fraction. In this embodiment, the scavenger concentration can be ground, for example, in a ball mill or a verti-mill, to provide a liberated scavenger concentrate. The liberated scavenger concentrate can then be routed back to the main separator and combined, for example, to a rougher or finisher feed for further upgrading to a final concentrate product.

In another embodiment the rougher portion of the separator is operated at a relatively high percent solids such as for example 50% solids plus or minus 10% such that the flow velocity of the particles suspended in the slurry is reduced, and the hydro-dynamic forces or drag and kinetic energy of the passing particles are reduced relative to the magnetic forces of attraction to the discrete magnetic objects. In this embodiment, marginally magnetic particles can be attracted and captured in the matrix. In this embodiment the rougher recovery is maximized for a particular feed material. The rougher tail when the separator is operated in this way can be the final tailings not requiring any further scavenging separation. The rougher concentrate will generally be of lower iron grade when the rougher is operated in this high recovery fashion thus requiring more upgrading in the finisher, cleaner or even a fourth polisher stage of separation. The tailings from the finisher, cleaner or polisher stages of upgrading are preferably routed to a separate sump and pumped to a ball mill for additional grinding to liberate middling particles. The term "middling particles" as used herein refers to particles that contain both magnetic minerals, such as, for example, hematite and/or goethite, along with non-magnetic minerals, such as, for example, silica and/or alumina. A determination of whether to regrind the finisher, cleaner and/or polisher tailings can be made depending on the desired concentration of the target element, such as for example iron in the case of hematite recovery. One ordinarily skilled in the art can readily determine based on generally understood criteria, and based on the disclosures herein, whether or not it would be desired to subject the finisher, cleaner or polisher tailings to further grinding, or simply discard one or more of these flow streams to final tailings.

In another embodiment, magnetic separator is used in a process that includes rougher, finisher and cleaner operations, but no scavenger operation. In this embodiment, separator 100 can be set up to pass the treatment slurry through three of the nine separation sectors of separator 100 as a rougher separation phase, below which a first concentrate fraction and a first tailings fraction can be collected in launders as described above. The first concentrate fraction can be transported to a position above rotor 105, and passed through a second set of three separation sectors in a finisher operation. Below these three separation sectors, a second concentrate fraction and a second tailings fraction are collected in launders. The second concentrate fraction is transported to a position above rotor 105 and passed through a third set of three separation sectors in a cleaner operation. Below these three separation sectors, a third concentrate fraction and a third tailings fraction are collected in launders. The third concentrate fraction is a final product of the separation. In this embodiment, the first tailings fraction is removed from the process to be discarded or sold as a commodity. The second tailings fraction can likewise be discarded or sold as a commodity, or can optionally be mixed into the treatment slurry and recycled to the rougher phase for further treatment. The third tailings fraction (collected beneath the portion of rotor 105 being used for the cleaner separation) can be mixed into the treatment slurry and recycled to the rougher phase for further treatment, or can optionally be sold as a commodity.

It is to be understood that the above process can be modified or adjusted in a wide variety of ways as would occur to a person skilled in the art, including, for example, utilizing more or fewer separation sectors for the rougher, finisher, cleaner and/or scavenger operations. As further examples, magnetic separator 100 can be set up to include more or fewer separation sectors, to provide a stronger magnetic field in one or more of the separation sectors and/or to lengthen or shorten the arc length of one or more of the separation sectors or the magnetic zones 140 or nonmagnetic zones 178 therein. For example, in one embodiment, a magnetic separator includes a rotor having similar features to rotor 105, but that has an outside diameter of about twenty-six feet, and that includes ten magnetic separation sectors rather than nine. As will be appreciated by a person skilled in the art, a separator configured in this manner will have a proportionally larger number of magnets, magnetic zones and nonmagnetic zones, a proportionally larger number of treatment slurry feed points (e.g., ten per ring in this embodiment rather than nine per ring); a proportionally larger amount of lineal feet of channels, magnets, and non-magnetic zones; and a proportionally larger number of collection launders beneath the rotor. This size increase and increase in the number of separation sectors increases the lineal feet of magnet working space, channel length, amount of discrete matrix, and therefore increases the separation capacity of the separator. Other alternative sizes, dimensions and configurations are also contemplated, including, for example, a separator having similar features to separator 100 but having more or less than six troughs, having a larger overall diameter, having wider or narrower channels, having longer or shorter channel segments, having more or fewer sectors (i.e., magnetic/nonmagnetic zones), having deeper or shallower channels, and the like.

Other alternatives that can be employed include having more than two turntables vertically stacked in a single separator or the like. For example, a three level separator would allow for a fourth stage of separation, which can be referred to as a polishing stage, or to allow for a scavenging operation to extract additional iron values from the tails of the rougher, finisher and/or cleaner stages, which can operate to return "misplaced" iron values from tails back into the magnetic side of the flow streams or simply more lineal feet of channels/magnets/non-magnetic zone to provide greater separator capacity with three upgrading steps including or excluding scavenging. When a separator level is used for scavenging, another embodiment includes a grinder, such as, for example, a ball mill or a verti-mill positioned nearby or adjacent the separator so that tail fractions to be scavenged can be easily passed through a grinding step prior to introduction into the sectors of the separator being used for the scavenging operation.

In addition, rather than using different sectors for different separation operations, by appropriately arranging slurry delivery conduits and launders, a person skilled in the art can readily set up separator 100 to employ different ones of channels 133 for different separation operations. By way of example only, separator 100 can be set up to employ the two outer channels 133 (i.e., the two channels passing between magnetic members 144 and 146 and between magnetic members 146 and 147 of sets 140) for a rougher separation operation, the two middle channels 133 for a cleaner separation operation and the two inner channels 133 for a scavenger separation operation. As will be appreciated by a person skilled in the art, this is but one example, of the many ways separator 100 can be employed to carry out multiple different separation operations.

In another embodiment, different separation operations (i.e., rougher, finisher, cleaner and/or scavenger) can be achieved in separation sectors of different turntables. With reference to FIGS. 17-20, magnetic separator 200 includes two rotors 205, 205' mounted in different horizontal planes (with rotor 205 above rotor 205') about a common vertical axis on fixed separator frame 201, each rotor having associated therewith a plurality of sets of permanent magnet members 240, 240'. Each rotor 205, 205', together with its associated sets of permanent magnet members 240, 240' is configured generally as described above in connection with magnetic separator 100, and may also have increased dimensions and increased numbers of separation sectors as discussed above. While separator 200 includes two turntables, it is to be understood that the present application also contemplates embodiments including more than two turntables.

For the sake of clarity, it is noted that the direction of rotation R' of rotors 205, 205' in FIGS. 17-20 is opposite the direction of rotation R of rotor 104 in magnetic separator 100, and thus, jump magnets 260, 260' in separator 200 are positioned on the opposite sides of magnetic members 241, 241', 242, 242' 243, 243', 244, 244', 245, 245', 246, 246', 247, 247' than on magnetic members 141, 142, 143, 144, 145, 146, 147 of separator 100. While rotors 205, 205' of separator 200 are mounted about a common vertical axis, it is to be understood that this orientation is not required, and that the rotors can be positioned about different vertical axes. For example, the rotors can be positioned in a side by side relationship in a common horizontal plane. Alternatively, the rotors can be positioned to rotate about different vertical axes in two different horizontal planes. In such a vertically offset arrangement, the rotors can be positioned at elevations such that gravity flow of slurry from one rotor to another can be achieved by positioning the rotors in different horizontal planes.

Rotor 205 includes structural rotor frame 210 and six annular troughs 221, 222, 223, 224, 225, 226. Structural rotor frame 210 comprises inner support frame component 212, outer support frame component 214 and multiple radial support frame components 216 rigidly connected to inner support frame component 212 and outer support frame component 214. Annular troughs 221, 222, 223, 224, 225, 226 are spaced apart from one another in concentric rings, are mounted on and carried by structural rotor frame 210, and define channels for passage of a treatment slurry therethrough as described further hereinbelow. Each of inner support frame component 212 and outer support frame component 214 is supported by rotatable carriage wheels (not shown), which are in turn mounted on fixed separator frame 201. In operation of magnetic separator 200, rotor 205 is caused to rotate in the direction indicated by arrow R' at a generally constant rate by a driver (not shown).

Magnetic separator 200 also includes nine sets 240 of permanent magnet members, each of sets 240 including multiple curved permanent magnet members 241, 242, 243, 244, 245, 246, 247 in spaced apart relationship to define a generally constant annular space therebetween. Curved magnet members 241, 242, 243, 244, 245, 246, 247 are mounted on a portion of fixed separator frame 201 above rotor 205, and are held in fixed positions as rotor 205 rotates. Each of curved magnet members 241, 242, 243, 244, 245, 246, 247 is positioned such that the annular space between adjacent ones of magnet members 241, 242, 243, 244, 245, 246, 247 provides a pathway for passage of one of troughs 221, 222, 223, 224, 225, 226 as rotor 205 turns. More specifically, in each permanent magnet set 240, magnet members 241 and 242 are positioned such that trough 221 passes therebetween as rotor 205 turns. Similarly, magnet members 242 and 243 are positioned such that trough 222 passes therebetween as rotor 205 turns, magnet members 243 and 244 are positioned such that trough 223 passes therebetween as rotor 205 turns, magnet members 244 and 245 are positioned such that trough 224 passes therebetween as rotor 205 turns, magnet members 245 and 246 are positioned such that trough 225 passes therebetween as rotor 205 turns, and magnet members 246 and 247 are positioned such that trough 226 passes therebetween as rotor 205 turns.

Troughs 221, 222, 223, 224, 225, 226, like troughs 121, 122, 123, 124, 125, 126, can be assembled on rotor 205 using a plurality of component 130, which defines channel 133, and also defines channel sections 135 (if separating walls 134 are included).

Rotor 205' is positioned below rotor 205. Rotor 205' includes structural rotor frame 210' and six annular troughs 221', 222', 223', 224', 225', 226'. Structural rotor frame 210' comprises inner support frame component 212', outer support frame component 214' and multiple radial support frame components 216' rigidly connected to inner support frame component 212' and outer support frame component 214'. Annular troughs 221', 222', 223', 224', 225', 226' are spaced apart from one another in concentric rings, are mounted on and carried by structural rotor frame 210', and define channels for passage of a treatment slurry therethrough as described further hereinbelow. Each of inner support frame component 212' and outer support frame component 214' is supported by rotatable carriage wheels (not shown), which are in turn mounted on fixed separator frame 201. In operation of magnetic separator 200, rotor 205' is caused to rotate in the direction indicated by arrow R' at a generally constant rate by a driver (not shown).

Magnetic separator 200 also includes nine sets 240' of permanent magnet members, each of sets 240' including multiple curved permanent magnet members 241', 242', 243', 244', 245', 246', 247' in spaced apart relationship to define a generally constant annular space therebetween. Curved magnet members 241', 242', 243', 244', 245', 246', 247' are mounted on a portion of fixed separator frame 201 above rotor 205', and are held in fixed positions as rotor 205' rotates. Each of curved magnet members 241', 242', 243', 244', 245', 246', 247' is positioned such that the annular space between adjacent ones of magnet members 241', 242', 243', 244', 245', 246', 247' provides a pathway for passage of one of troughs 221', 222', 223', 224', 225', 226' as rotor 205' turns. More specifically, in each permanent magnet set 240', magnet members 241' and 242' are positioned such that trough 221' passes therebetween as rotor 205' turns. Similarly, magnet members 242' and 243' are positioned such that trough 222' passes therebetween as rotor 205' turns, magnet members 243' and 244' are positioned such that trough 223' passes therebetween as rotor 205' turns, magnet members 244' and 245' are positioned such that trough 224' passes therebetween as rotor 205' turns, magnet members 245' and 246' are positioned such that trough 225' passes therebetween as rotor 205' turns, and magnet members 246' and 247' are positioned such that trough 226' passes therebetween as rotor 205' turns.

Troughs 221', 222', 223', 224', 225', 226', like troughs 121, 122, 123, 124, 125, 126, can be assembled on rotor 205' using a plurality of component 130, which defines channel 133, and also defines channel sections 135 (if separating walls 134 are included).

In operation of magnetic separator 200, channel sections 135 (or channel 133 generally if separating walls 134 are omitted) defined by troughs 221, 222, 223, 224, 225, 226 and troughs 221', 222', 223', 224', 225', 226' contain a matrix material (not shown) as described above in connection with magnetic separator 100. It is understood that, where the matrix material selected for use in a given operation is a discrete object matrix, component 130 includes separating walls 134, and also includes a foraminous floor (not shown) that is effective to permit passage of the treatment or a fraction thereof through channel 133 without significant impedance, but that retains the discrete object matrix in channel 133.

In operation of magnetic separator 200, while each of rotors 205, 205' is rotated at a generally constant rate, a flow of treatment slurry is introduced into channel segments 135 of troughs 221, 222, 223, 224, 225, 226 of rotor 205 at a plurality of locations within one or more magnetic zones defined by magnet members 241, 242, 243, 244, 245, 246, 247. With rotor 205 turning in direction R', a flow of treatment slurry is preferably directed into channels 133 in inflow zones represented by reference numeral 270. Delivery of treatment slurry into channels 133 in inflow zones 270 can be accomplished, for example, by utilizing one or a plurality of treatment slurry delivery stations, which can be configured in a wide variety of manners as would occur to a person skilled in the art. For example, treatment slurry delivery stations can be in the form of one or more manifold holding tanks 272 (also referred to as distributors 272) positioned above rotor 205 and mounted on fixed separator frame 201, which have a plurality of outlets connected to a plurality of treatment fluid conduits (not shown) for delivering a flow of treatment slurry into fixed locations as channels 133 rotate through inflow zones 270. In one embodiment, each of the three distributors 272 is an 18-port distributor, thereby feeding treatment slurry into fifty-four hoses or other conduits (not shown). Because rotor 205 includes six circular channels 133, and each circular channel at any given time includes a portion within each of nine different magnetic zones, it is seen that delivery of treatment slurry into each channel within each of inflow zones 270 requires fifty-four separate treatment slurry delivery conduits. Thus, by utilizing three eighteen-port treatment slurry distributor 272, treatment slurry can be delivered into each of the fifty-four channel locations positioned within inflow zones 270 through the fifty-four hoses attached to distributors 272.

In an embodiment that includes ten separation sectors rather than nine, each of the six circular channels 133 at any given time includes a portion within each of ten different magnetic zones, and therefore delivery of treatment slurry into each channel within each of the ten inflow zones requires sixty separate treatment slurry delivery conduits. In this embodiment, delivery of treatment slurry into channels 133 in the inflow zones can be accomplished, for example, by utilizing five treatment slurry delivery stations, which can be in the form of manifold holding tanks 272 (also referred to as distributors 272) positioned above the rotor and mounted on the fixed separator frame, each of which has twelve outlets connected to treatment fluid conduits for delivering a flow of treatment slurry into fixed locations as channels 133 rotate through the inflow zones. In this manner, each of the five distributors feeds treatment slurry into each of the inflow zones of two of the ten separation sectors. Each of the five 12-port distributors is fed treatment slurry from a five-way master gravity distributor. With this configuration, the treatment slurry feed system feeds treatment slurry into sixty hoses or other conduits, and is therefore effective to delivery treatment slurry into each of the sixty channel locations positioned within inflow zones through the sixty hoses attached to distributors 272.

Magnetic separator 200 also includes a water delivery system (not shown) for introducing a flow of water through channels 133 at various positions. For example, a flow of rinse water can be directed into channels 133 in rinse water zones 275. Each of zones 275 is within the magnetic zones associated with rotor 205, and a flow of water through channels 133 in zone 275 can assist with washing nonmagnetic particles from channels 133 while the matrix material in channels 133 is in a magnetically energized state, and thus continues to adhere to magnetic particles captured from the treatment slurry. The water delivery system (not shown) is also preferably configured to introduce a flow of water through channels 133 in flush water zones 278, which is co-extensive with the nonmagnetic zone discussed above. While it is understood that some residual magnetic field may exist in flush zones 278 by virtue of the proximity of magnet members 241, 242, 243, 244, 245, 246, 247, zones 278 represent areas where channel sections 135 are not straddled by magnet members, and thus represent areas of least intense magnetic field within channels 133. Thus, zones 278 alternatively can be referred to as zones of zero or weaker magnetic field, and the present description is to be read in light of same.

In flush zones 278 the flow of flush water through channel segments 135 is effective to flush magnetic particles from channel segments 135 while the matrix material in channel segments 135 is in a nonmagnetic (or only weakly magnetic) state. Jump magnets 260 operate to assist the flushing of magnetic particles from channel segments 135 in zones 278 by causing the matrix material to be jolted, preferably within, or just prior to a point where flush water is passing through channel segments 135. Delivery of water into channel segments 135 in zones 275 and/or 278 can be accomplished, for example, by utilizing one or a plurality of treatment fluid delivery stations (not shown), which can be configured in a wide variety of manners as would occur to a person skilled in the art. For example, water delivery systems can be in the form of one or more manifold holding tanks (also referred to as distributors) positioned above rotor 205 and mounted to fixed separator frame 201, which have a plurality of outlets connected to a plurality of water conduits for delivering a flow of water into channels 133 at fixed locations as channel segments 135 rotate through zones 275 and/or 278. Alternatively and more preferentially, water delivery systems can be in the form of pipes, fittings, valves, hoses and nozzles that are supplied with water at a desired pressure using conventional plumbing apparatus, and which delivery water into channels 133 at fixed locations as channel segments 135 rotate through zones 275 and/or 278.

In one embodiment, the water delivery system also includes a control system for periodically activating pulses of higher pressure and/or higher flow rate spraying to enhance cleanout of the channels in the flush zones. The control system can include, for example, a computer system configured to actuate valves and/or solenoids in the water delivery system in accordance with a predetermined time sequence or other desired parameter via a programmable logic controller or other process control computer or microprocessor. For example, in one embodiment, the control system also includes sensors or testers that provide feedback to the control system, and the actuation of the valves and/or solenoids can be triggered by measured or sensed conditions of fluid flow through the separator, qualitative measurements of the magnetic or nonmagnetic fractions or the like.

Figure 21:
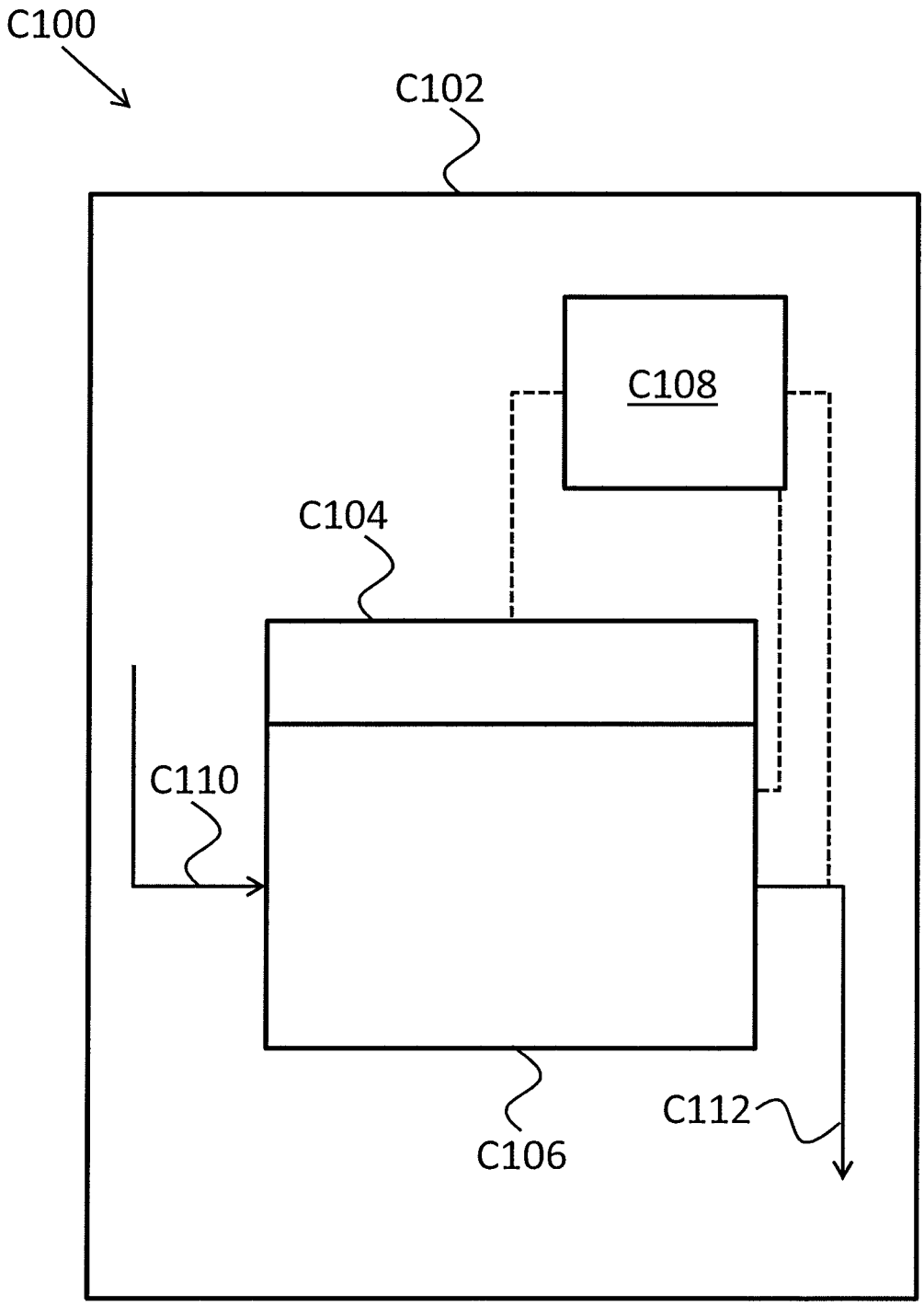
FIG. 21 is a schematic block diagram of a system for agitating a magnetic separator embodiment.

FIG. 21 is a schematic representation of a system C 100 including a magnetic separator C 102 having a plurality of channel segments C 106 and a water delivery system C104. The channel segment C 106 is shown schematically with an inlet C 110 and an effluent C112. The water delivery system C104 includes a plurality of valves, solenoids, and/or actuators, wherein the valves, solenoids, and/or actuators are responsive to an agitation control command. In certain embodiments, the system further includes a controller C 108 that performs certain operations to agitate the separation system. In certain embodiments, the controller C108 forms a portion of a processing subsystem including one or more computing devices having memory, processing, and communication hardware. The controller may be a single device or a distributed device, and the functions of the controller may be performed by hardware or software. The controller C108 is in communication with any sensor, actuator, or other device in the system 100 as will be understood to implement the functions of the controller C108.

In certain embodiments, the controller C 108 includes one or more modules structured to functionally execute the operations of the controller. In certain embodiments, the controller includes an agitation indication module, an agitation planning module, and an agitating module. The description herein including modules emphasizes the structural independence of the aspects of the controller C108, and illustrates one grouping of operations and responsibilities of the controller C108. Other groupings that execute similar overall operations are understood within the scope of the present application. Modules may be implemented in hardware and/or software on computer readable medium, and modules may be distributed across various hardware or software components. More specific descriptions of certain embodiments of controller operations are included in the section referencing FIG. 22.

Certain operations described herein include operations to interpret one or more parameters. Interpreting, as utilized herein, includes receiving values by any method known in the art, including at least receiving values from a datalink or network communication, receiving an electronic signal (e.g. a voltage, frequency, current, or PWM signal) indicative of the value, receiving a software parameter indicative of the value, reading the value from a memory location on a computer readable medium, receiving the value as a run-time parameter by any means known in the art, and/or by receiving a value by which the interpreted parameter can be calculated, and/or by referencing a default value that is interpreted to be the parameter value.

Figure 22:
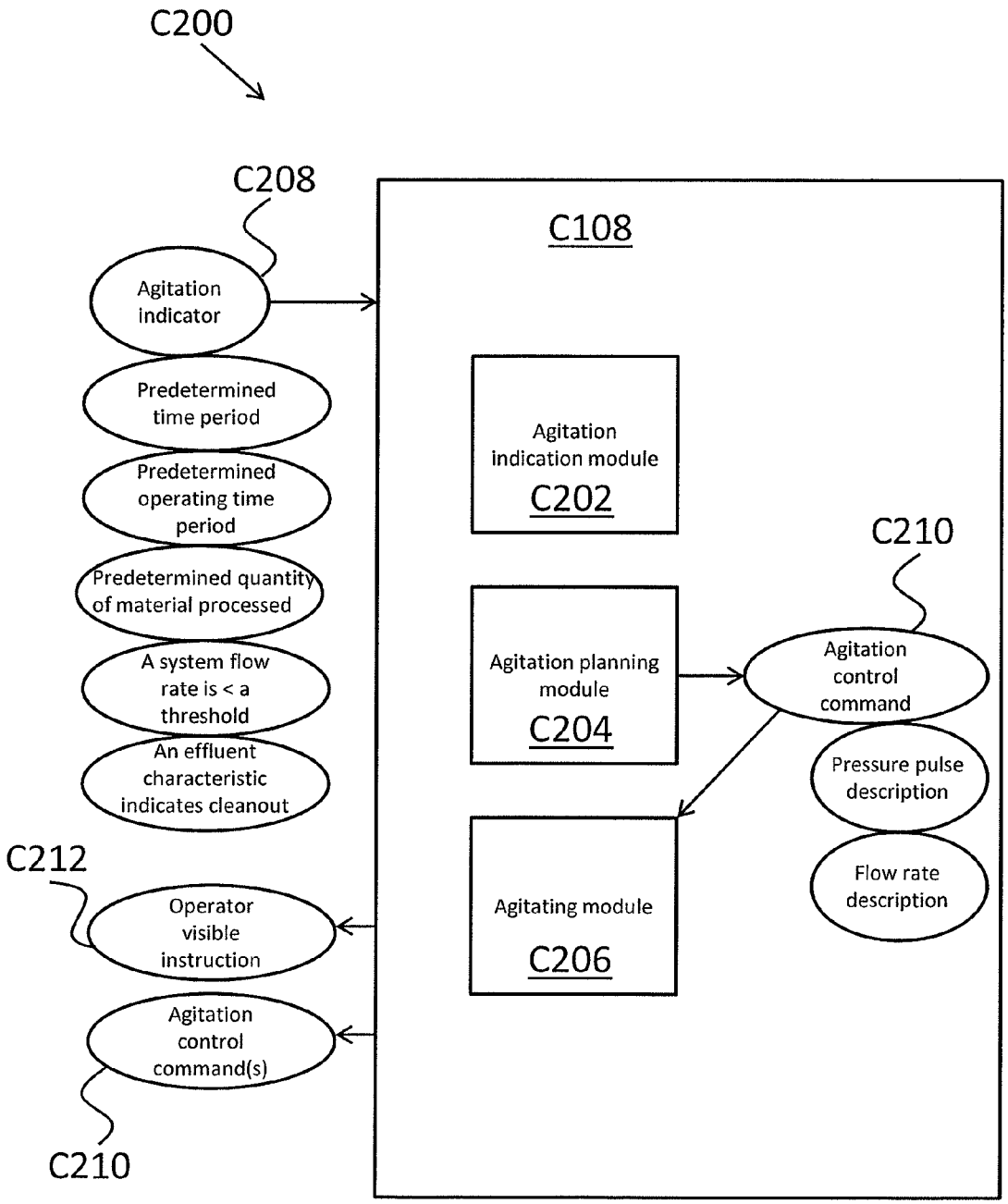
FIG. 22 is a schematic block diagram of an apparatus for controlling an agitation system.

Referencing FIG. 22, an exemplary controller C108 includes an agitation indication module C202 that interprets an agitation indicator C208, an agitation planning module C204 that provides an agitation control command C210 in response to the agitation indicator C208, and an agitating module C206 that agitates the matrix material in at least one channel segment in a flush zone in response to the agitation control command C210. In certain embodiments, the agitation indication module C202 further interprets the agitation indicator C208 in response to determining that a predetermined time period has elapsed, determining that a predetermined operating time period has elapsed, determining that a predetermined quantity of material has been processed, determining that a flow rate in the system is below a threshold value, and/or determining that a channel segment or other portion of a channel has an effluent characteristic consistent with a cleanout indication.

In certain embodiments, the agitation module C206 further agitates at least one channel segment in a flush zone by providing an operator visible instruction C212, where the operator visible instruction C212 includes a valve indication and/or an actuator indication. The valve indication includes a valve identifier, a valve modulation command, and/or a valve modulation time. The actuator indication includes an actuator identifier, an actuator modulation command, and/or an actuator modulation time. In certain embodiments, the agitation is performed by an operator in response to the operator visible instruction C212. In certain embodiments, the agitation is performed automatically, and/or is triggered by an operator (e.g. operator acknowledges that an agitation procedure should continue by pressing a button or exercising some other operator input).

An exemplary controller includes the agitation planning module C204 further determining a pressure pulse description and/or a flow rate description in response to the agitation indicator. The agitating module C206 further operates one or more actuators in response to the pressure pulse description and/or flow rate description. The agitating module C206 may be structured to operate the actuators in a feedforward (e.g. open loop actuator position trajectory) or feedback (e.g. closed loop control to achieve the pressure and/or flow rate trajectory) manner. In certain embodiments, the agitating module C206 provides the agitation control command(s) C210 directly to one or more actuators, and/or converts the agitation control command(s) C210 to an electronic format, datalink communication, etc. wherein the actuators are structured to respond to the final form of the agitation control command(s) C210.

Figure 23:
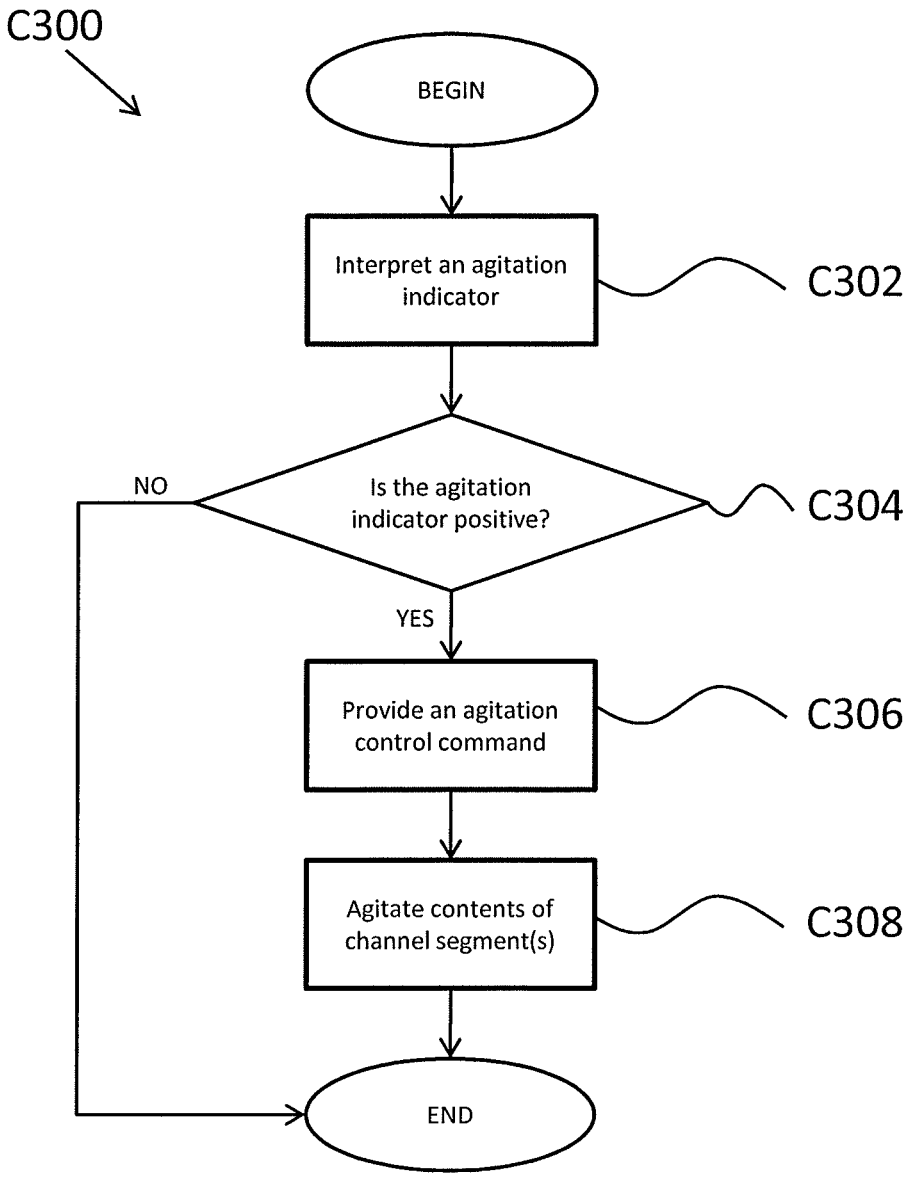
FIG. 23 depicts a schematic flow diagram of a procedure for agitating a magnetic separator embodiment.

The schematic flow diagram set forth in FIG. 23 and related description which follows provides an illustrative embodiment of performing procedures for agitating a separation system. Operations illustrated are understood to be exemplary only, and operations may be combined or divided, and added or removed, as well as re-ordered in whole or part, unless stated explicitly to the contrary herein. Certain operations illustrated may be implemented by a computer executing a computer program product on a computer readable medium, where the computer program product comprises instructions causing the computer to execute one or more of the operations, or to issue commands to other devices to execute one or more of the operations.

An exemplary procedure C300 includes an operation C302 to interpret an agitation indicator. The procedure further includes an operation C304 to determine whether the agitation indicator is positive (i.e. agitation is indicated) or negative. Exemplary operations to interpret an agitation indicator include determining that a predetermined time period has elapsed, determining that a predetermined operating time period has elapsed, and/or determining that a predetermined quantity of material has been processed. The determination of appropriate time periods or material quantities are made according to the type of material separated, the size of flow channels, and the screen mesh sizes present in a specific system. These determinations can be made from simple experiments and/or from experience operating a particular system. The determination of time periods or material quantities indicating agitation is a mechanical step for one of skill in the art contemplating a specific system and having the benefit of the disclosures herein.

Further exemplary operations to determine an agitation indicator include determining that a flow rate in the system is below a threshold value, and/or determining that a channel segment or other portion of a channel has an effluent characteristic consistent with a cleanout indication. The effluent characteristic may be a flow regime or flow characteristic (e.g. laminar flow where turbulent flow is expected, a flow distribution indicating clogging or abnormal flow, etc.), the presence or absence of an expected constituent of the channel segment effluent, or any other indicator understood in the art that can be correlated to a determination that agitation is desirable or required.

In response to the operation C304 indicating YES, the exemplary procedure C300 includes an operation C306 to provide an agitation control command in response to the agitation indicator. In certain embodiments, the agitation control command includes a pressure pulse description, which may include a pressure value or a pressure value trajectory over a period of time, and/or a flow rate description. The pressure pulse description may include a pressure value or a pressure value trajectory over a period of time, and the flow rate description may include a flow rate value or a flow rate value trajectory over a period of time. In certain embodiments, the agitation control command includes a list of actuators, a list of actuators each corresponding to a position, and/or a list of actuators and a position trajectory over a period of time corresponding to each actuator. The actuators, flow rates, and/or pressure values from the agitation control command may be correlated to specific system actuators and/or shot containing compartments (e.g. a channel or basket including a discrete object matrix) according to the agitation indicator identifying particular shot containing compartments.

The exemplary procedure C300 further includes an operation C308 to agitate the matrix material in at least one channel segment in response to the agitation control command. In certain embodiments, the agitation indicator is applied system-wide, or to a subset of the system, and each shot containing compartment, or a subset of the shot containing compartments, may be agitated sequentially or in a scheduled order. The operation to agitate the shot containing compartment(s) includes, in certain embodiments, operating one or more actuators in response to the pressure pulse description and/or flow rate description. In one embodiment the water described above can additionally be applied in an upward direction in the nonmagnetic zone to flush captured concentrate into the collection launder below. This can be done in addition to more conventional downward application of flush water in the nonmagnetic zone to enhance removal of concentrate from the nonmagnetic zone.

In one embodiment, the water delivery system is configured to operate in a state where the contents of each channel segment 135 passing a discrete location of the channel's path of rotation are agitated by lowering a relatively high pressure water delivery nozzle into the respective channel segments to provide a relatively high velocity spray of water in closer proximity to the matrix material residing in the channel segment. As will be appreciated, a nozzle that is lowered into a rotating channel segment 135 to a position lower than the tops of the respective radially-oriented separating walls 134 separating adjacent channel segments 135 must subsequently be raised to a position higher than the top of the next separating wall 134 to allow such separating wall 134 to pass thereunder without a collision between the nozzle and wall 134.

In one embodiment, lowering a nozzle into closer proximity with the matrix material in a channel segment is achieved by mounting the nozzle (which is in turn connected to a flexible conduit, i.e., hose, operable to deliver water through the nozzle) on a vertically reciprocating carriage that is operable to be moved upwardly and downwardly in a manner that corresponds to the movement of separating walls 134 along the path of rotation of a corresponding channel. The present application is not limited to the particular structure of the carriage, it being well within the purview of a person skilled in the art to select a suitable carriage for achieving such vertically reciprocating motion. In one embodiment, the vertical movement of the carriage is limited by an upper stop that is operable to prevent upward movement of the nozzle beyond a predetermined upper position and is limited by a lower stop that is operable to prevent downward movement of the nozzle beyond a predetermined lower position. In one embodiment, the predetermined lower position is above the position of a respective drop-in screen that is positioned within channel segment 135. In another embodiment, the predetermined lower position is above the matrix material positioned in channel segment 135. In yet another embodiment, the predetermined upper position is below the respective tops of channel side walls 131, 132 but above the respective tops of separating walls 134 of a given channel. In still another embodiment, the predetermined upper position is above the respective tops of channel side walls 131, 132.

In one embodiment, the vertically reciprocating motion of the carriage, and thus the nozzle mounted thereto, can be manually controlled by an operator. In another embodiment, the movement of the carriage is achieved by a drive system. Suitable drive systems are commercially available and within the purview of a person of ordinary skill in the art. A suitable drive system utilizes hydraulic or pneumatic pressure operating in concert with valves and ports under the control of one or more actuators. In one embodiment, a hydraulic system is used that employs process water as the hydraulic fluid. In other embodiments, other hydraulic fluids, such as oils, can be employed. In still another embodiment, a pneumatic system is used that employs air or other gas to move the carriage. For example, in one embodiment a 4-way, 5-port pneumatic valve is used to drive a nozzle mounted to a pneumatic cylinder-type air slide down into a channel segment as described above.

The pneumatic valve (or other valves or systems in other embodiments) can be operated, for example, by being manually actuated by an operator, or can be under the control of an actuator, such as, for example, a solenoid. The solenoid or other actuator can, in turn, be under the control of a manually operated switch, or can be under control of an automatic control system. In an embodiment in which a control system is used to periodically close a 4-way, 5-port pneumatic valve to drive a pneumatic air slide carriage into respective channel segments, the automatic closing of the valve can be achieved mechanically. For example, in one embodiment, a mechanical arm operably connected to the valve (or a switch controlling the valve) is positioned such that it is in the path of separating walls 134 in their normal path of rotation as the rotor turns, and thereby is engaged and moved by a respective separating wall 134 passing thereby as the rotor turns. When a separating wall 134 contacts and moves the mechanical arm, the mechanical arm closes the valve (or moves a switch controlling closure of the valve), thereby driving the nozzle toward the predetermined lower position in a channel segment 135. Movement of the respective separating wall 134 beyond the reach of the mechanical arm causes the arm to return toward its original position, thereby opening the valve (or actuating a switch that controls opening of the valve) and thereby causing the nozzle to retract out of the channel segment toward the predetermined upper position (i.e., to a point above the top of the separating wall 134 passing therebeneath).

In another embodiment, actuation of movement of the vertically reciprocating nozzle (actuation of a valve or switch in the embodiment described above) is under control of a means other than a mechanical lever. For example, and without limitation, opening or closing of a valve or a switch can be achieved using a sensor that is operable to sense an approaching separating wall and trigger a solenoid operated pneumatic valve to drive the carriage and nozzle toward the predetermined upper position to withdraw the nozzle from the channel segment. In one embodiment, an electrical proximity sensor is used to generate a signal causing upward movement of the carriage and nozzle.

A vertically reciprocating water delivery nozzle as described above can be employed at any one or more locations in which flush water is delivered into channel segments within nonmagnetic zones to flush concentrate into concentrate launders positioned below. In one embodiment, at least one vertically reciprocating water delivery nozzle is employed for each channel of a given rotor (i.e., in at least one of the multiple nonmagnetic zones through which a given channel passes). In another embodiment, multiple vertically reciprocating water delivery nozzles are employed for each channel, such as, for example, in every other nonmagnetic zone, every third nonmagnetic zone, etc., through which a given channel passes. In yet another embodiment, a vertically reciprocating water delivery nozzle is employed at each location where flush water is delivered into a channel segment in a nonmagnetic zone through which a given channel segment passes during a complete revolution of a rotor.

Magnetic separator 200 also includes launders 280 positioned below rotor 205 in an arrangement whereby a fraction of the treatment slurry that passes through a magnetic zone associated with rotor 205 is collected in launders positioned beneath permanent magnet sets 240 as a first tailings fraction, and a fraction of the treatment slurry that is washed from channels 133 beneath nonmagnetic zone 278 is collected in launders positioned beneath the nonmagnetic zone 278 as a first concentrate fraction.

Rotor 205' also turns in direction R'. One or both of the first tailings fraction and the first concentrate fraction is directed into channels 133 of rotor 205' in predetermined ones of inflow zones 270'. Delivery of first tailings fraction and/or first concentrate fraction into channels 133 in inflow zones 270' can be accomplished, for example, by utilizing hoses or other conduits (not shown) attached to launders 280 to pass the first tailings fraction and/or first concentrate fraction collected beneath rotor 205 from launders 280 to predetermined ones of channels 133 in zones 270' through the conduits. Flow of the first tailings fraction and/or the first concentrate fraction can be achieved by gravity flow, or can be assisted by one or more pumps (not shown). Alternatively, delivery stations in the form of one or more splitter tanks or distributors positioned above rotor 205' and mounted on fixed separator frame 201 can be used with a plurality of outlets connected to a plurality of conduits for delivering a flow of first tailings fraction and/or first concentrate fraction into fixed locations as channels 133 rotate through inflow zones 270'. A variety of alternative slurry handling systems could be used as would occur to a person skilled in the art.

Magnetic separator 200 also includes a water delivery system (not shown) for introducing a flow of water into channels 133 of rotor 205' at various positions. For example, a flow of rinse water can be directed into channels 133 in rinse water zones 275'. Each of zones 275' is within the magnetic zones associated with rotor 205', and a flow of water through channels 133 in zone 275' can assist with washing nonmagnetic particles from channels 133 while the matrix material in channels 133 is in a magnetically energized state, and thus continues to adhere to magnetic particles captured from the treatment slurry. The water delivery system is also preferably configured to introduce a flow of water through channels 133 in flush water zones 278', which is co-extensive with the nonmagnetic zone discussed above. While it is understood that some residual magnetic field may exist in flush zones 278' by virtue of the proximity of magnet members 241', 242', 243', 244', 245', 246', 247', zones 278' represent areas where channel sections 135 are not straddled by magnet members, and thus represent areas of least intense magnetic field within channels 133. Thus, zones 278' alternatively can be referred to as zones of zero or weaker magnetic field, and the present description is to be read in light of same.

In flush zones 278' the flow of flush water through channel segments 135 is effective to flush magnetic particles from channel segments 135 while the matrix material in channel segments 135 is in a nonmagnetic (or only weakly magnetic) state. Jump magnets 260' operate to assist the flushing of magnetic particles from channel segments 135 in zones 278' by causing the matrix material to be jolted, preferably while flush water is passing through channel segments 135. Delivery of water into channel segments 135 in zones 275' and/or 278' can be accomplished, for example, by utilizing one or a plurality of treatment fluid delivery stations (not shown), which can be configured in a wide variety of manners as would occur to a person skilled in the art. For example, water delivery systems can be in the form of one or more manifold holding tanks (also referred to as distributors) positioned above rotor 205' and mounted to fixed separator frame 201, which have a plurality of outlets connected to a plurality of water conduits for delivering a flow of water into channels 133 at fixed locations as channel segments 135 rotate through zones 275' and/or 278'. Alternatively and preferentially, water delivery systems can be in the form of pipes, valves, fittings, hoses and nozzles that are supplied with water at a desired pressure using conventional plumbing apparatus, and which delivery water into channels at fixed locations as channel segments 135 rotate through zones 275' and/or 278'.

Magnetic separator 200 also includes launders 280' positioned below rotor 205' in an arrangement whereby a fraction of the treatment slurry that passes through a magnetic zone associated with rotor 205, is collected in a launder positioned beneath permanent magnet sets 240' as a further tailings fraction, and a fraction of the treatment slurry that is washed from channels 133 beneath nonmagnetic zone 278' is collected in a launder positioned beneath the nonmagnetic zone 278' as a further concentrate fraction. The further tailings fractions and further concentrate fractions can then be transported from launders 280' into respective sumps 290' by gravity flow through chutes 285' or through hoses (not shown) as further discussed below.

As will be appreciated by a person skilled in the art, a magnetic separator as described herein can be configured such that different sectors of the magnetic separators perform different operations, or stages of separation, as a function of the type of slurry that is passed through the channels in that sector. For example, a given sector of a separator may be used to perform a rougher stage separation, a finisher stage separation or a cleaner stage separation, as described in detail herein. The determination of which sector is to be used for which phase of separation is a matter of process design. Due to the large number of sectors and components that are present in a single separator, difficulties can arise in connection with identifying or distinguishing a given sector or component during design, installation, operation and/or repair of the separator, or when discussing a certain component or sector of the separator. The term "component" is used to refer to a distributor, a hose, a magnetic backing plate, a launder, a feed pipe and a sump. To address this difficulty, in one embodiment, a color coding system is used to identify components of the separator that are used for a specific upgrading stage. For example, the color coding system can include assignment of a specific color to the sector or sectors of the separator that are used for the rougher stage of the process and components associated therewith, a second color can be assigned to the sector or sectors of the separator that are used for the finisher stage of the process and components associated therewith, and a third color can be assigned to the sector or sectors that are used for the cleaner stage of the process and components associated therewith. For example, if a given separation stage is identified by the color red, then all sectors associated with that separation stage and all hoses affixed to launders associated with these sectors are identified by the color red, and can be more readily distinguished from hoses that are affixed to sectors of the separator that are used for other separation stages. The color can be applied, for example, by painting portions of the components or by affixing colored tape, labels or other indicia to all or a portion of the components, for example.

In one embodiment, sectors and components of the separator that are associated with the rougher stage processing are red, sectors and components that are associated with the finisher stage processing are blue, and sectors and components associated with the cleaner stage processing are yellow. In addition, in an embodiment in which a "polisher" stage is employed, a fourth color can be assigned to the sector or sectors used for the polisher stage of the process and components associated therewith. In another embodiment, different colors are also assigned to components associated with distinct flow streams produced by the separator. For example, in one embodiment, in addition to the red, blue and yellow components associated with the rougher, finisher and cleaner stages, respectively, as described above, components that carry or hold final tailings products produced by the separator are brown, and components that carry or hold final concentrate products produced by the separator are green. In addition to other benefits, this color coding feature provides for more efficiency and accuracy, for example, when it is necessary for operators to communicate regarding the location of a blockage or the failure of a screen, or the like.

As will be appreciated by a person skilled in the art, other identification systems can also be used in place of or in addition to the color coding system described above. For example, sectors and components associated with a given stage of the process can be assigned numerical or letter designations rather than being color coded. Moreover, alternative approaches for color coding can alternatively be employed. For example, as will be appreciated by a person skilled in the art, the magnetic separators described herein are highly versatile for use with varying process parameters and flow charts. For example, as described above, the orientation of "rougher", "cleaner", "finisher" and optionally "scavenger" and/or "polisher" operations in the separators can be controlled and modified by simply repositioning various slurry delivery or conveying systems, i.e., by repositioning the outlets of various slurry fraction conveying hoses such that the hoses convey the slurry fraction into a different sump that introduces such slurry fractions into different zones or sectors of the separator or convey such slurry fractions to a product receptacle. Due to the large number of sectors, troughs, launders, hoses and the like that are present in a single separator, such different separator components are sometimes difficult to distinguish and identify. Another embodiment of a color coding system is used to identify different sectors and components of the separator, irrespective of the separation stage that is occurring in that particular sector. For example, a color coding system can include assignment of a specific color to a given sector of the separator such that all components associated with that sector are identified with the same color. For example, if a given sector is identified by the color red, then all launders and hoses associated with that sector are identified by the color red, and can be more readily distinguished from hoses that are affixed to other sectors of the separator. The color can be applied, for example, by painting portions of the components or by affixing colored labels or tape to all or a portion of the components. This provides for more efficiency and accuracy when, for example, the process is being modified to reroute a given slurry fraction to a different sump, distributor or other receptacle, when it is necessary for operators to communicate regarding the location of a blockage or the failure of a screen, or the like. In another embodiment, individual launders within a sector that is identified by a certain color, and hoses carrying slurry fractions from such individual launders, could be assigned numerical or letter designations depending upon their locations within a given sector. For example, a given hose could be identified as "red 3" to clearly associate such hose to the separator location from which it is conveying a slurry fraction.

In one manner of using magnetic separator 200, passage of the treatment slurry through rotor 205 is referred to as a rough separation stage, or "rougher" stage. The underlying rotor 205' is then used for one or more further separation stages referred to as a "cleaner" stage, a "scavenger" stage" or a "finisher stage," depending upon the separation process to be employed. The uses of rotor 205' in these different manners can be achieved simply by controlling the flow paths of the first tailings fraction and the first concentrate fraction recovered below rotor 205. For example, in one manner of using separator 200, separator 200 is used in a process in which both the first concentrate fraction and the first tailings fraction collected from the rougher stage (i.e., collected below rotor 205) are passed through different portions of rotor 205', referred to herein as a cleaner portion of rotor 205' and a scavenger portion of rotor 205', respectively. This process is depicted in the flow diagram set forth in FIG. 24. In this process, an individual particle in the treatment slurry must be separated into a concentrate fraction in two successive separation steps in order to be passed into a final concentrate product, and an individual particle in the treatment slurry must be separated into a tailings fraction in two successive separation steps in order to be passed into a final tailings product. More particularly, in FIG. 24, treatment slurry 305 is delivered to sump 310, from which it is pumped to distributor 272 using pump 315. From distributor 272, the treatment slurry is pumped through multiple hoses or other conduits into channels 133 of rotor 205, as represented schematically in FIG. 24 by arrows 320.

Figure 24:
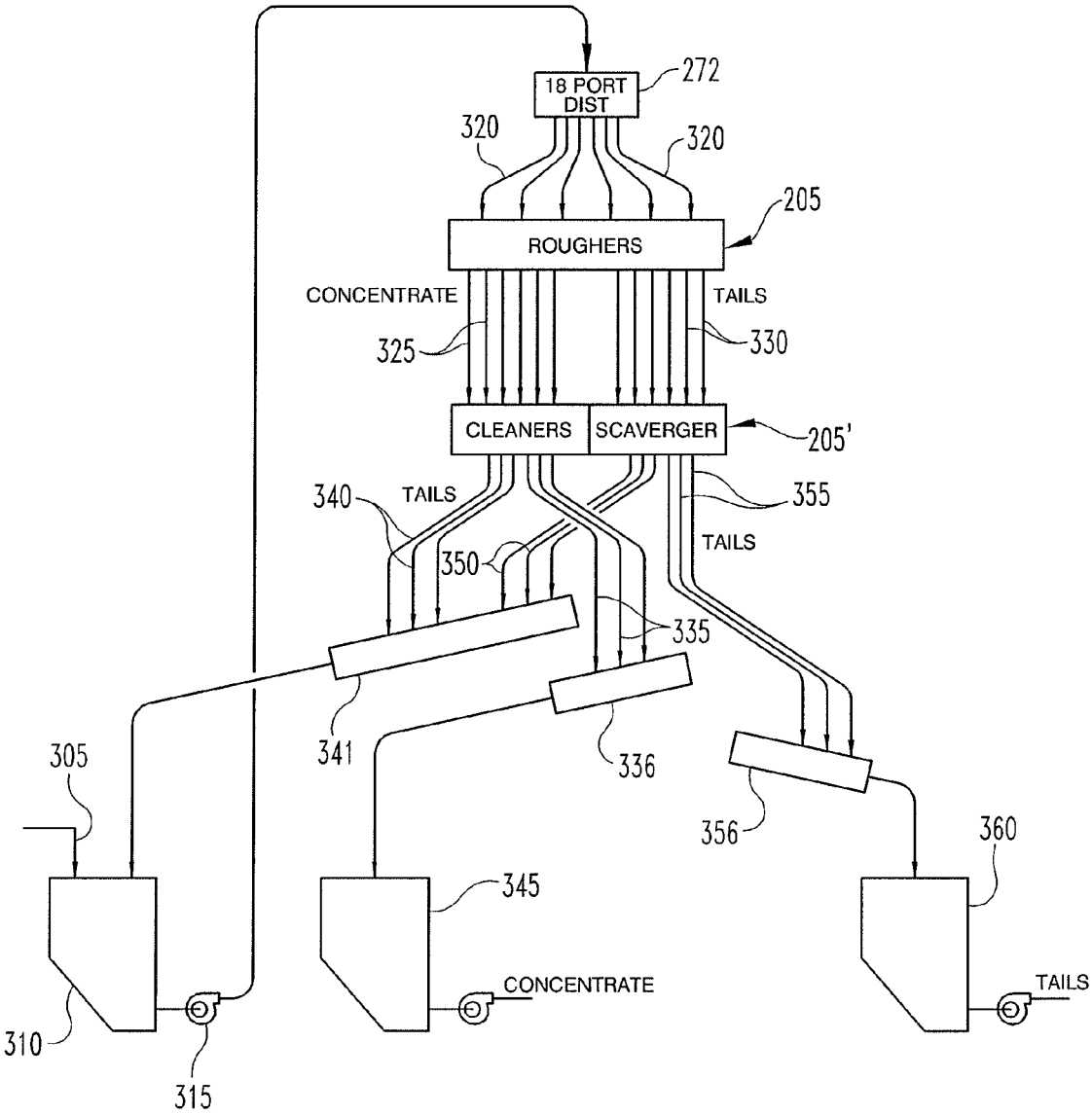
FIG. 24 is a flow diagram showing a separation process embodiment using the separator embodiment shown in FIGS. 17-20.

The first concentrate fraction collected below rotor 205, as represented schematically in FIG. 24 by arrows 325, is delivered into one or more of channels 133 of rotor 205' in one or more of zones 270' to achieve a cleaner separation operation. As described above in connection with separator 100, the cleaner operation can be achieved in certain sectors of rotor 205' (i.e., using four or five of the nine sectors of rotor 205'), or can alternatively be achieved using certain channels 133 of rotor 205' around the entire 360° of the selected channels 133 (i.e., using three of the six channels of rotor 205').

The first tailings fraction collected below rotor 205, as represented schematically in FIG. 24 by arrows 330, is delivered into one or more of the channels 133 of rotor 205' at locations in zones 270' that are not used for the cleaner operation described in the preceding paragraph, to achieve a scavenger separation operation. If the cleaner operation is achieved in certain sectors (i.e., magnetic zones) of rotor 205', then the scavenger operation is achieved in the remaining sectors. Alternatively, if the cleaner operation is achieved in certain channels 133 of rotor 205' around the entire 360° of the selected channels 133, then the scavenger operation is achieved in the remaining channels 133.

The cleaner operation separates the first concentrate fraction 325 into a second concentrate fraction 335 and a second tailings fraction 340. Because the first concentrate fraction 325 entering cleaner sectors of rotor 205' is of relatively high magnetic content, even the second tailings fraction 340 (also referred to herein as the cleaner tailings fraction) includes a relatively high concentration of magnetic material. Thus, the second tailings fraction 340, being of too high an iron concentration to reject, is transported by launders 341 to sump 310, where it is combined with treatment slurry 305 and recycled back through the separator, thereby forming a circulating load to optimize product recovery and grade. In another embodiment, the second tailings fraction 340 can be passed through a milling operation to further liberate magnetic material from nonmagnetic material before being combined with treatment slurry 305 and recycled back through the separator or a portion of the separator (i.e., a scavenger portion or the like). The scavenger operation separates the first tailings fraction 330 into a third concentrate fraction 350 and a third tailings fraction 355. Third concentrate fraction 350 is transported by launders 341 to sump 310, where it is mixed with treatment slurry 305 and recycled back through the separator. Third tailings fraction 355 is transported by launders 356 to sump 360 as a final tailings product.

Second concentrate fraction 335 is transported by launders 336 to sump 345 as a final concentrate product. Second concentrate fraction 335 includes a solid mineral product highly concentrated with respect to iron that can optionally be dewatered and deslimed in a spiral classifier and then stockpiled for optional additional de-watering, for example, by both gravity drainage of entrained water and air drying by evaporation prior to shipment to customers. Alternatively, the wet iron concentrate produced by the spiral classifier can be dried using a dewatering screen after or in place of the spiral classifier, or alternatively a cyclone/dewatering screen combination can replace or follow the spiral classifier. In alternative embodiments, one or more of the following devices can be used in series or in combination or alone: a spiral classifier, a cyclone, a dewatering screen, a drainage pile, a building over a lay down pad; optionally followed by vacuum filtration and/or thermal drying that causes additional evaporation or vaporization of the water within the iron concentrate by exposing it to electrical radiant energy or air heated by combustion of fossil fuels or air heated by electricity. Alternatively, the product can be dried using microwave driers. A dry iron concentrate product can then be bagged for sale or transport, or can alternatively be sold or otherwise transported in bulk.

The final iron concentrate product produced by the above-described process can be used in a variety of commercially useful ways, such as, for example, as an iron source in a nugget plant, as a concrete or drilling weighting agent or as a coloring agent, such as, for example, as a pigment for asphalt or glass manufacturing. The final iron concentrate product can alternatively be formed into agglomerates, such as, for example, agglomerates having the form of briquettes, pellets or compacts. These can be formed, for example, using briquetters, pelletizing drums or disks, or presses. The production of agglomerate is contemplated to employ a binder that may include hydrated lime otherwise known as calcium hydroxide, calcined lime (CaO) otherwise known as active lime, the same forms of lime as aforementioned except rather than being made from limestone only, those made from either dolomite or from blends of dolomite and limestone; bentonite, and organic binders including organic polymers, wheat starch, gluten, corn starch, or blends thereof. These agglomerates facilitate the shipment and handling of the product and allow it to be easily shipped to distant customers and used by a wider variety of iron making customer facilities.

As another alternative, second concentrate fraction 335 can be passed through a wet fine screen device to separate the product into size fractions desired by a customer, such as, for example, sinter feed which has no more than 15% by weight passing 150 mesh (105 microns) or pelletizing feed which has at least 80% smaller than 150 mesh (105 microns). Additional possible uses of the undersize material passing the fine screen include as a drilling fluid weighting agent or other weighting agent, and for the chemical manufacture of ferric sulfate water treatment anticoagulants. Following these size classification steps, the mineral slurry is pumped to dewatering/desliming steps including one or more of the following unit processes employed individually or in combination: spiral classifiers, hydro-cyclones, dewatering screens, drain pads, vacuum filters, vacuum presses, thermal driers as described above.

Alternatively, separator 200 can be used in a process in which the first tailings fraction collected from the rougher stage (i.e., collected below rotor 205) is discarded as a final tailings product, and only the first concentrate fraction collected from the rougher stage (i.e., collected below rotor 205) is passed through a portion of rotor 205', referred to herein as a finisher portion of rotor 205'. In this process, depicted in the flow diagram set forth in FIG. 25, rotor 205' also includes a cleaner portion. An individual particle in the treatment slurry must be separated into a concentrate fraction in three successive separation steps in order to be passed into a final concentrate product. An individual particle in the treatment slurry that passes into the first concentrate fraction collected from the rougher stage must thereafter be separated into a tailings fraction in two successive separation steps in order to be passed into a final tailings product. More particularly, in FIG. 25, treatment slurry 405 is delivered to sump 410, from which it is pumped to distributor 272 using pump 415. From distributor 272, the treatment slurry is passed through multiple hoses or other conduits into channels 133 of rotor 205, as represented schematically in FIG. 25 by arrows 420.

Figure 25:
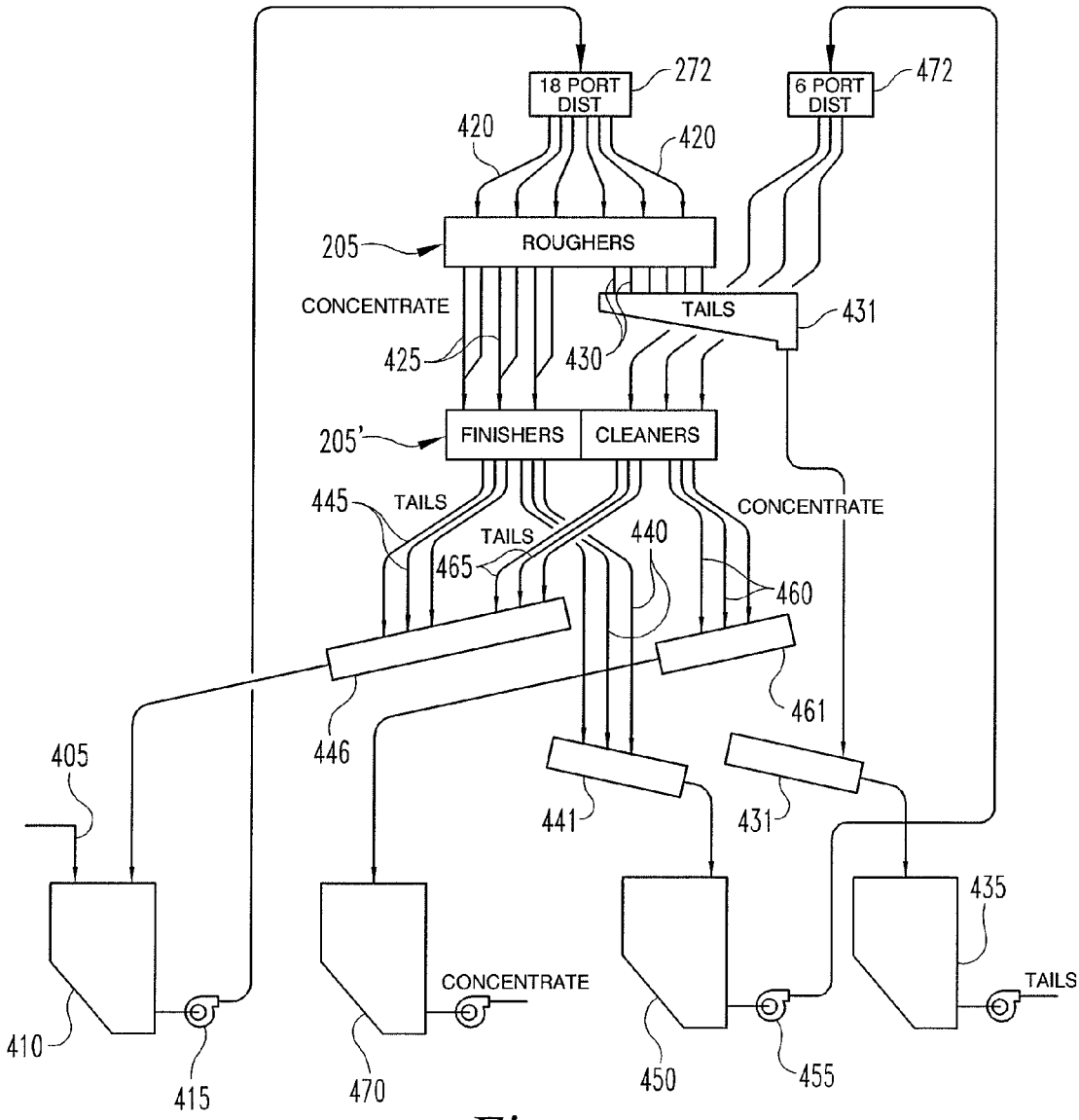
FIG. 25 is a flow diagram showing another separation process embodiment using the separator embodiment shown in FIGS. 17-20.

The first concentrate fraction collected below rotor 205, as represented schematically in FIG. 25 by arrows 425, is delivered into one or more of channels 133 of rotor 205' in one or more of zones 270' to achieve a finisher separation operation. The finisher operation can be achieved in certain sectors (i.e., magnetic zones) of rotor 205' (i.e., using four or five of the nine sectors of rotor 205'), or can alternatively be achieved using certain channels 133 of rotor 205' around the entire 360° of the selected channels 133 (i.e., using three of the six channels of rotor 205'). The first tailings fraction collected below rotor 205, as represented schematically in FIG. 25 by arrows 430, is transported by launders 431 to sump 435 as a final tailings product.

The finisher operation separates the first concentrate fraction 425 into a second concentrate fraction 440 and a second tailings fraction 445. Second tailings fraction 445 is transported by launders 446 to sump 410, where it is mixed with treatment slurry 405 and recycled back through the separator. Second concentrate fraction 440 is transported by launders 441 to sump 450, from which it is pumped using pump 455 to one or more multi-port distributors 472. From the one or more distributors 472, fraction 440 is passed through multiple hoses or other conduits into one or more of the channels 133 of rotor 205' at locations in zones 270' that are not used for the finisher operation described in the preceding paragraph, to achieve a cleaner separation operation. If the finisher operation is achieved in certain sectors (i.e., magnetic zones) of rotor 205', then the cleaner operation is achieved in the remaining sectors. Alternatively, if the finisher operation is achieved in certain channels 133 of rotor 205' around the entire 360° of the selected channels 133, then the cleaner operation is achieved in the remaining channels 133.

The cleaner operation separates the second concentrate fraction 440 into a third concentrate fraction 460 and a third tailings fraction 465. Third concentrate fraction 460 is transported by launders 461 to sump 470 as a final concentrate product. Third tailings fraction 465 is transported by launders 446 to sump 410, where it is mixed with treatment slurry 405 (optionally after passing through a milling operation to further liberate magnetic materials therein from nonmagnetic materials) and recycled back through the separator.

In both of the above processes, the final concentrate product has a higher content of magnetic particles than the treatment slurry, and can be stored, shipped or sold as a commodity. The final tailings product has a lower content of magnetic particles than the treatment slurry, and can be discarded or sold as a commodity.

Figure 26:
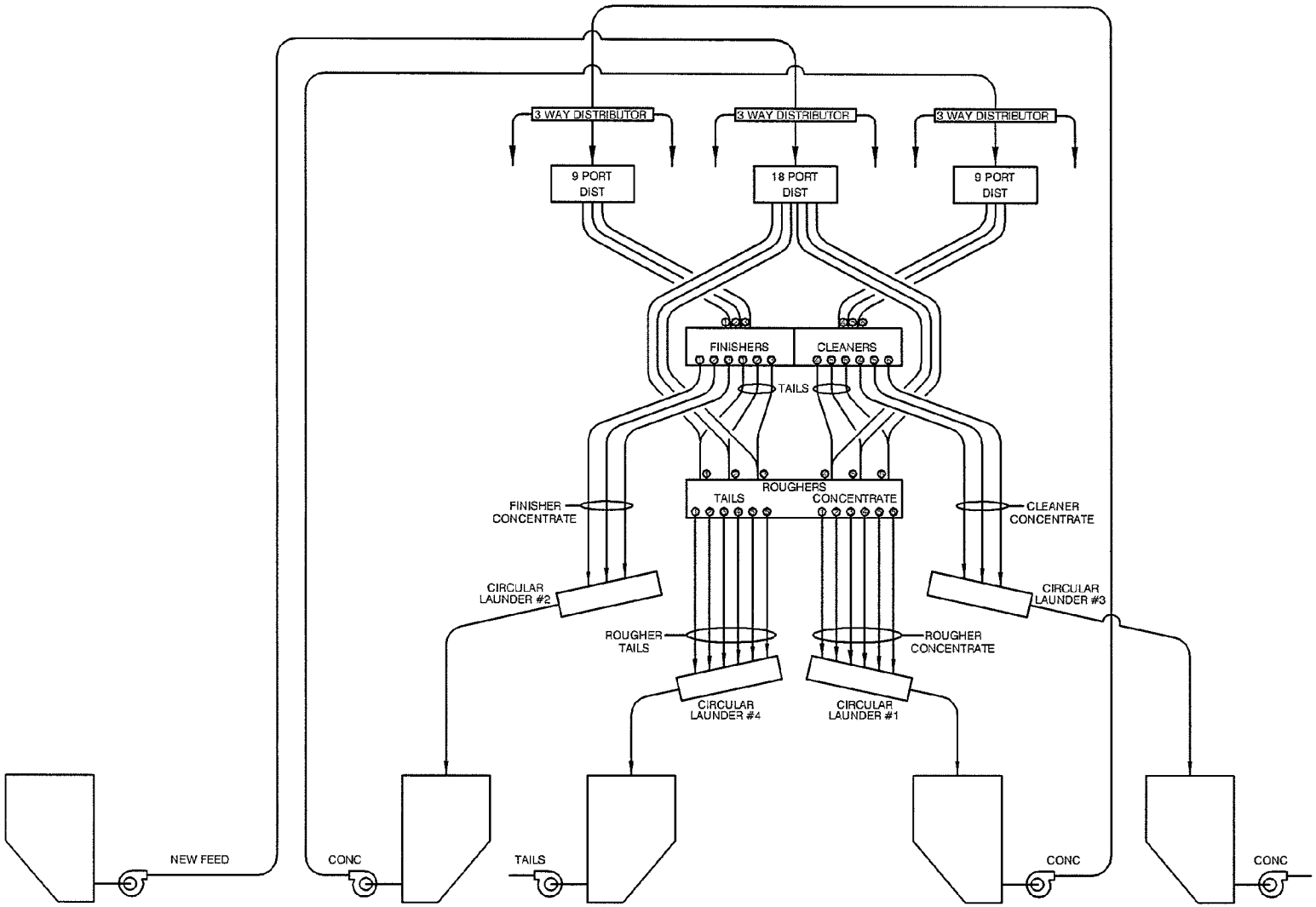
FIG. 26 is a flow diagram showing yet another separation process embodiment using the separator embodiment shown in FIGS. 17-20.

In yet another embodiment magnetic separator (not shown), the general arrangement of rotors and magnets is provided as described above in connection with magnetic separator 200; however, the treatment slurry flowpaths, the launders and the various flowpaths for tailings fractions and concentrate fractions are modified such that the lower turntable (i.e., rotor 205') is used for the rougher separation stage and the upper turntable (i.e., rotor 205) is used for the cleaner, finisher and/or scavenger separation stages. One advantage of this arrangement is that any spillage of treatment slurry in the rougher separation stage does not contaminate concentrate fractions from the cleaner or finisher stages. FIG. 26 is a flow diagram depicting a process embodiment of this type in which the flow paths for the treatment slurry and various flow paths are shown. In the embodiment shown in FIG. 26, the tailings fractions recovered from the finisher and cleaner stages (i.e., from the magnetic zones of the upper rotor) are shown as being delivered into the rougher separator (i.e., the lower rotor) for a further separation along with a new feed of treatment slurry. In an alternate embodiment, the tailings fractions recovered from the finisher and cleaner stages can be conveyed to a dewatering cyclone (i.e., via launders and/or hoses), where these fractions can be combined, and then dewatered for further processing. For example, the overflow water recovered from the dewatering cyclone can be recycled for use as process water or can be combined with a final tailings fraction and returned to a settling pond or the like. The underflow slurry recovered from the dewatering cyclone can be conveyed to a ball mill for size reduction, from which it can be conveyed back to the rougher separation stage by being mixed with a new treatment slurry feed, for example.

Another embodiment is to use the lower turntable (i.e., rotor 205') for both the rougher separation stage and the scavenger stage and to use the upper turntable (i.e. rotor 205) for the cleaner and finisher separation stages. Yet another embodiment is to use three or more levels of rotors. For example, in one embodiment that includes four rotors, the upper stage is used for cleaner, the second from the top rotor is used for finisher separation, the third from the top rotor is used for rougher operation and the bottom rotor is used for scavenging. Additional levels of rotors can be employed if additional stages of separation are desired.

As will be appreciated by a person of ordinary skill in the art in view of the above descriptions, the transport of a slurry between rotors as described above can be achieved by gravity flow, by pumping or by a combination of gravity flow and pumping with the ratio of each determined by the physical arrangement of the equipment. For example, when multiple turntables are arranged in stacked form with the upper turntable using for the rougher separation phase, transport of a slurry from the rougher turntable to a cleaner/finisher/scavenger turntable can be achieved using gravity flow, and the transport of fractions from beneath the cleaner/finisher/scavenger turntable can be transported to ground-level sumps by gravity flow. In other embodiments, such as, for example, an embodiment in which the rougher turntable is positioned below a cleaner/finisher/scavenger turntable, or where the two turntables are positioned generally in a side by side arrangement, a slurry is transported from one turntable to another primarily using pumps, and rely less on gravity flow. It is understood by a person of ordinary skill in the art that a system can include a variety of physical arrangements to move slurry from one unit step of the process to the next, depending upon the available resources and the physical environment in which the system is to be assembled.

In the preparation of a treatment slurry for passage through a separator as described herein, it is common to not only screen a rough starting material to remove debris and oversize particles, as discussed above, but also to subject the starting material to one or more dewatering treatments to increase the ratio of solids to water in the slurry to be passed through a separator device as a treatment slurry. Such dewatering treatments can be achieved using, for example, one or more deslimer, hydrocyclone, thickener or the like.

The devices, systems and processes described herein can be employed together with other mineral processing unit operations including, but not limited to, some or all of the following: tramp screens, wet screens, hydro-cyclones, desliming hydro-separators, other high intensity magnetic separators, low intensity magnetic separators, low intensity cleaner magnetic separators, wet fine screening, hydro-cyclones, spiral classifiers, vibratory dewatering screens, dredges, pumps, pipelines, sumps, slurry tanks, vacuum filters, ball mills, high pressure roll presses, thickeners, hydrometallurgical flotation cells, and conveyors. A process for treating a mineral assemblage can include, for example, providing a slurry including a mixture of magnetic and nonmagnetic particles suspended in water; passing the slurry through a plurality of treatment phases, and modifying the solid to liquid ratio of the slurry by adding water to the slurry or removing water from the slurry (also referred to herein as "dewatering") before, during or after any one of the treatment phases. The treatment phases can include, for example, a particle size separation phase, a low intensity magnetic separation phase, other high intensity magnetic separation phases or the like. Size screening phases, grinding phases, dewatering phases and the like, or recycling of various flow streams to pass a concentrate fraction or tailings fraction through a magnetic separator one or more additional times, can be employed to improve separation results where appropriate, for example, to account for varying particle size characteristics of the slurry, mineral content of the particles and the like. In addition, a final concentrate fraction produced as described herein can be dewatered and then conveyed to a stockpile for further dewatering. Tailings reject material can be pumped to one or more disposal cells or basins. As will be appreciated by a person of ordinary skill in the art, hydro-cycloning and spiral classification processes can be utilized to modify the solid to liquid ratio of the slurry by removing excess water from the slurry. In addition, the solid to liquid ratio of the slurry can be modified by adding water to the slurry during dredging, pumping, wet screening and magnetic separation processes.

As will be appreciated by a person skilled in the art in view of the above, in one aspect, the present application provides a high intensity magnetic separation device for separating a treatment slurry including magnetic particles and nonmagnetic particles suspended in water into a concentrate fraction and a tailings fraction. The device includes: (1) a first generally horizontal rotor rotatable about a first generally vertical axis, the first rotor defining a first circular channel rotatable about the first axis, the first channel defining a flow path through the first rotor and containing a matrix material therein, wherein the first channel is configured to allow passage of a downwardly moving fluid stream therethrough in contact with the matrix material; (2) a first rigid support frame operable to support the first rotor; (3) a first driver mounted to the first support frame, the first driver operable to rotate the first rotor at a generally constant rate; (4) a first plurality of permanent magnet members fixedly attached to the first support frame, the first permanent magnet members positioned to straddle the first channel at a plurality of locations spaced apart along the circular path of the first channel, the first magnet members effective to apply magnetic fields across a plurality of portions of the path where the first channel is straddled by the first permanent magnet members, the portions defining a plurality of magnetic zones, the magnetic zones being separated along the circular path by nonmagnetic zones, thereby providing a repeating series of separation zones and nonmagnetic zones along the circular path; (5) a first plurality of feed conduits for delivering a treatment slurry into the first channel at a plurality of input locations, each input location being positioned within one of the plurality of magnetic zones defined by the first plurality of permanent magnet members; (6) a first plurality of water delivery conduits for delivering water into the first channel at a plurality of locations within the magnetic zones and within the nonmagnetic zones defined by the first plurality of permanent magnet members; and (7) a first plurality of tailings launders and a first plurality of concentrate launders positioned beneath the first channel; the first tailings launders positioned beneath the magnetic zones for receiving a first tailings fraction of the treatment slurry that passes through the first channel in the magnetic zones; and the first concentrate launders positioned beneath the nonmagnetic zones for receiving a first concentrate fraction of the treatment slurry that passes through the first channel in the nonmagnetic zones. The first rotor further includes (a) a foraminous channel floor operable to allow passage of the first tailings fraction therethrough as the first tailings fraction exits the first channel, the matrix material including a plurality of discrete magnetically susceptible objects sized to be retained in the first channel by the channel floor, and (b) a plurality of vertical radial separating walls in the first channel, the separating walls dividing the first channel into a plurality of arc-shaped channel segments. The floor of at least one of the channel segments comprises a drop-in screen sized and shaped to fit within one of the channel segments.

In one embodiment, the drop-in screen comprises a substantially rigid non-magnetic material, such as, for example, a material selected from the group consisting of stainless steel, aluminum and polyurethane. In another embodiment, the drop-in screen includes at least three support bars and a plurality of generally wedge-shaped screen bars oriented generally perpendicular to the support bars and affixed to the support bars In another embodiment, the at least two adjacent ones of the plurality of screen bars each comprises a first surface having a first draft angle relative to the general direction of slurry flow therethrough and a second surface having a second draft angle relative to the general direction of slurry flow therethrough, wherein a first surface of a first screen bar and a second surface of a second screen bar defines a space between the first and second screen bars having dimensions that are greater at a bottom side of the screen than at a top side of the screen when the screen is oriented for operation. In yet another embodiment, the drop-in screen includes six support bars. In one embodiment, the screen bars are affixed to an underside of the support bars when the screen is oriented for operation. In another embodiment, the screen bars are affixed to an upper side of the support bars when the screen is oriented for operation. In still another embodiment, the drop-in screen comprises an integral body defining a plurality of slots, at least one the slot having a first angled side surface and a second angled side surface, the first and second side surfaces defining downward-opening draft angles when the screen is oriented for operation. In still yet another embodiment, the first channel is defined by a first trough having first and second vertical side walls, and the radial separating walls are sized such that a top of at least one of the radial separating walls is from about two to about six inches below the tops of the first and second vertical side walls.

In one embodiment, the magnetically susceptible objects comprise a material selected from the group consisting of steel, iron and an iron alloy. In another embodiment, the magnetically susceptible objects include one or more members selected from the group consisting of shot, hex nuts, bolts, nails, washers, rod segments, cubes, blocks, cylinders, wire pieces, wire stars and pieces of wire mesh. In yet another embodiment, the first channel is defined by a first trough, and the first channel has a sufficient height to provide a distance of at least six inches between the top of the magnetic objects positioned in the channels and the top of the trough.

In another embodiment, the device further includes a plurality of jump magnets positioned adjacent the first channel at a trailing edge of a plurality of the magnetic zones relative to the rotation of the first rotor. In one embodiment, the jump magnets are adjustably mounted to the rigid frame or to the magnet members. In another embodiment, the jump magnets are affixed to the permanent magnet members in a manner whereby the jump magnets are vertically and horizontally adjustable.

In yet another embodiment, the first rotor defines a first plurality of connected and spaced apart circular channels rotatable about the axis, each of the first plurality of channels defining a flow path through the first rotor and containing a matrix material therein, wherein each of the first plurality of channels is configured to allow passage of a downwardly moving fluid stream in contact with the matrix material contained therein. In still another embodiment, the first plurality of water delivery conduits includes at least one underspray nozzle for delivering water into the first channel from a locations beneath the first channel. In still yet another embodiment, the water delivery system further includes: (a) at least one water delivery nozzle mounted to a vertically reciprocating carriage; and (b) a control system operable to intermittently lower the water delivery nozzle to an elevational position below the tops of the respective side walls of the first channel and below the tops of two adjacent radially-oriented separating walls and intermittently raise the water delivery nozzle to an elevational position above the top of a separating wall passing thereunder.

In still another embodiment, the first rotor includes a support frame including an inner support frame component, and outer support frame component and a plurality of radial support frame components rigidly connected to the inner support frame component and the outer support frame component; and the first driver includes at least three thrust wheels positioned to engage the outer support frame component. In still yet another embodiment, each of the first plurality of tailings launders is separated from a corresponding one of the first plurality of concentrate launders by a dividing wall; and the dividing wall is configured to be horizontally adjustable. In another embodiment, at least one of the first plurality of tailings launders and the first plurality of concentrate launders includes a launder outlet that is connected to a hose. In yet another embodiment, a reducer is connected to at least one of the launder outlets and to the corresponding hose.

In another embodiment, the device further includes a control system operable to periodically activate pulses of higher pressure, higher flow rate or a combination thereof, through one or more of the water delivery conduits. In one embodiment the device further includes a control system comprising: (a) an agitation indication module structured to interpret an agitation indicator; (b) an agitation planning module structured to provide an agitation control command in response to the agitation indicator; and (c) an agitating module structured to agitate contents of at least one channel segment in response to the agitation control command. In another embodiment, the agitation indication module is further structured to interpret the agitation indicator in response to at least one of the following operations: (i) determining that a predetermined time period has elapsed; (ii) determining that a predetermined operating time period has elapsed; (iii) determining that a predetermined quantity of material has been processed; (iv) determining that a flow rate in the system is below a threshold value; and (v) determining that a channel segment has an effluent characteristic consistent with a cleanout indication. In yet another embodiment, the agitation module is further structured to agitate contents of at least one channel segment by providing an operator visible instruction, the operator visible instruction comprising at least one of the following instructions: (i) a valve indication comprising a valve identifier, a valve modulation command, and/or a valve modulation time; and (ii) an actuator indication comprising an actuator identifier, an actuator modulation command, and/or an actuator modulation time. In still another embodiment, the agitation planning module is further structured to determine at least one of a pressure pulse description and a flow rate description in response to the agitation indicator. In still yet another embodiment, the agitating module is further structured to operate one or more actuators in response to the pressure pulse description and/or flow rate description.

In another embodiment, the device further includes: (1) a second generally horizontal rotor rotatable about the first axis or a second generally vertical axis, the second rotor defining a second circular channel rotatable about the first or second axis, the channel defining a flow path through the second rotor and containing a matrix material therein, wherein the second channel is configured to allow passage of a downwardly moving fluid stream in contact with the matrix material; (2) a second rigid support frame operable to support the second rotor; (3) a second driver mounted to the second support frame, the second driver operable to rotate the second rotor at a generally constant rate; (4) a second plurality of permanent magnet members fixedly attached to the second support frame, the second permanent magnet members positioned to straddle the second channel at a plurality of locations spaced apart along the circular path of the second channel, the second magnet members effective to apply magnetic fields across a plurality of portions of the path where the second channel is straddled by the second permanent magnet members, the portions defining a plurality of separations zones, the separation zones being separated along the circular path by nonmagnetic zones, thereby providing a repeating series of separation zones and nonmagnetic zones along the circular path; (6) a second plurality of feed conduits for delivering one or both of the first concentrate fraction and the first tailings fraction into the second channel at a plurality of input locations, each input location being positioned within one of the plurality of separation zones of the second channel defined by the second plurality of permanent magnet members; (7) a second plurality of water delivery conduits for delivering water into the second channel at a plurality of locations within the separation zones and within the nonmagnetic zones defined by the second plurality of permanent magnet members; and (8) a second plurality of tailings launders and a second plurality of concentrate launders positioned beneath the second channel; the second tailings launders positioned beneath the separation zones for receiving a second tailings fraction that passes through the second channel in the separation zones; and the second concentrate launders positioned beneath the nonmagnetic zones for receiving a second concentrate fraction that passes through the second channel in the nonmagnetic zones.

In one embodiment, the second rigid support frame is integral with the first rigid support frame. In another embodiment, both of the first and second rotors are rotatable about the first axis. In yet another embodiment, the first rotor is positioned above the second rotor. In still another embodiment, at least one of the first and second rotors defines a plurality of connected and spaced apart circular channels rotatable about the first or second axis, each of the first or second plurality of channels defining a flow path through the first or second rotor and containing a matrix material therein, wherein each of the first or second plurality of channels is configured to allow passage of a downwardly moving fluid stream in contact with the matrix material contained therein.

In another aspect, the present application provides a system that includes: (1) a horizontally oriented rotor having a circular channel positioned thereon, the circular channel having a slurry-permeable floor and a discrete object matrix positioned therein, wherein the discrete object matrix comprises a plurality of shaped objects, each of the shaped object having a magnetic characteristic that is one of magnetic and magnetically susceptible; (2) a drive mechanism operationally coupled to the rotor; (3) a permanent magnet rotationally independent from the rotor, wherein the permanent magnet is positioned to apply a magnetic field across the circular channel over a range of angular positions of the rotor; (4) a feed conduit structured to deliver a treatment slurry into the first channel; (5) a first water delivery conduit structured to deliver water into the first channel from above the first channel; (6) a second water delivery conduit structured to deliver water into the first channel from below the first channel; (7) a tailings launder positioned beneath the circular channel within the range of angular positions of the rotor; and (8) a concentrate launder positioned beneath the circular channel outside the range of angular positions of the rotor. In one embodiment, the system further includes a jolting device structured to move at least one of the shaped objects within the circular channel. In another embodiment, the jolting device comprises at least one device selected from the devices consisting of: a jump magnet, a rumble strip positioned in a movement path of a wheel supporting the rotor, a bump positioned in a movement path of a wheel supporting the rotor, and a vibrator operationally coupled to the circular channel.

In another aspect of the present application, there is provided a system that includes: (1) a horizontally oriented rotor having a circular channel positioned thereon, the circular channel having a slurry-permeable floor and a discrete object matrix positioned therein, wherein the discrete object matrix comprises a plurality of shaped objects, each of the shaped object having a magnetic characteristic that is one of magnetic and magnetically susceptible; (2) a drive mechanism operationally coupled to the rotor; (3) a permanent magnet rotationally independent from the rotor, wherein the permanent magnet is positioned to apply a magnetic field across the circular channel over a range of angular positions of the rotor; (4) a feed conduit structured to deliver a treatment slurry into the first channel; (5) a water delivery conduit structured to deliver water into the first channel; (6) a tailings launder positioned beneath the circular channel within the range of angular positions of the rotor; and (7) a concentrate launder positioned beneath the circular channel outside the range of angular positions of the rotor. The tailings launder is separated from the concentrate launder by a dividing wall, and the dividing wall is configured to be horizontally adjustable. In one embodiment, the system further includes a jolting device structured to move at least one of the shaped objects within the circular channel. In another embodiment, the jolting device comprises at least one device selected from the devices consisting of: a jump magnet, a rumble strip positioned in a movement path of a wheel supporting the rotor, a bump positioned in a movement path of a wheel supporting the rotor, and a vibrator operationally coupled to the circular channel.

In another aspect, the present application provides a method that includes: (1) positioning a plurality of magnetically susceptible shaped objects into a circular channel rotationally coupled to a horizontal rotor; (2) providing a treatment slurry to the circular channel; (3) passing the treatment slurry through a magnetized portion of a rotational path of the circular channel; (4) removing an iron poor effluent from the treatment slurry in the magnetized portion of the rotational path of the circular channel; (5) passing the treatment slurry through a non-magnetized portion of the rotational path of the circular channel; (6) removing an iron rich effluent from the treatment slurry in the non-magnetized portion of the rotational path of the circular channel; and (7) interpreting an agitation indicator, providing an agitation control command in response to the agitation indicator, and agitating the contents of the circular channel in response to the agitation control command.

In one embodiment of the method, the interpreting the agitation indicator comprises performing at least one operation selected from the operations consisting of: (a) determining that a predetermined time period has elapsed; (b) determining that a predetermined operating time period has elapsed; (c) determining that a predetermined portion of the circular channel has passed a given position; (d) determining that a predetermined quantity of material has been processed; (e) determining that a flow rate in the circular channel is below a threshold value; and (f) determining that a channel segment has an effluent characteristic consistent with a cleanout indication. In another embodiment, the agitating the contents comprises providing an operator visible instruction, wherein the operator visible instruction includes at least one of the following instructions: (i) a valve indication comprising at least one of a valve identifier, a valve modulation command, and a valve modulation time; and (ii) an actuator indication comprising at least one of an actuator identifier, an actuator modulation command, and an actuator modulation time. In a still further embodiment, the providing the agitation control command comprises performing at least one operation selected from the operations consisting of: (i) determining a pressure pulse description and (ii) determining a flow rate description.

Reference will now be made to the following examples of laboratory work that has been performed in connection with the subject matter of this application. It is understood that no limitation to the scope of the invention is intended thereby. The examples of tests conducted are provided solely to promote a full understanding of the concepts embodied in the present application.

EXAMPLES OF LABORATORY TESTING

Laboratory Procedure and Bench Testing Protocol

To construct a bench tester, two sets of five 4"×6"×1" permanent magnets were prepared by binding five of the magnets together for each magnet set. The magnet sets were positioned to provide a 4¾" gap therebetween. The center line magnetic flux density in the gap was approximately 920 gauss as measured by a standard gauss meter. A 4"×5"×12" stainless steel box was placed in the 4¾" gap and filled with 10 pounds of carbon grade 1000 balls of predetermined sizes.

Figure 27:
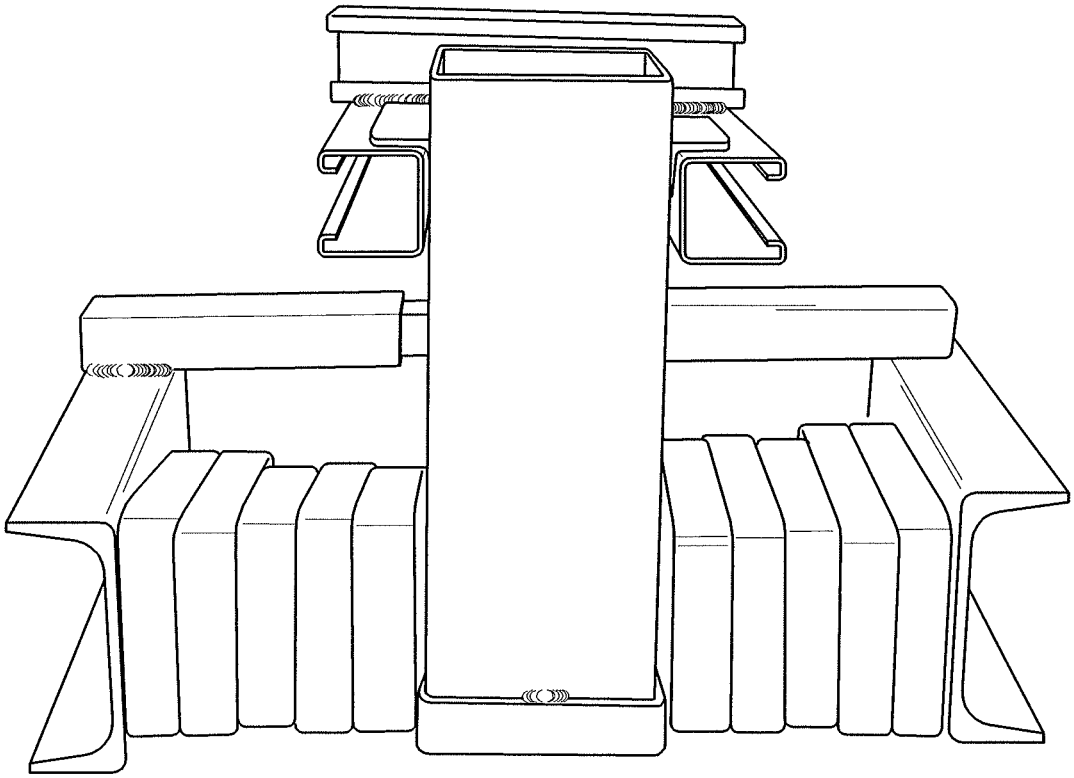
FIG. 27 is a nearly elevational perspective view of the bench tester described in the Examples.
Figure 28:
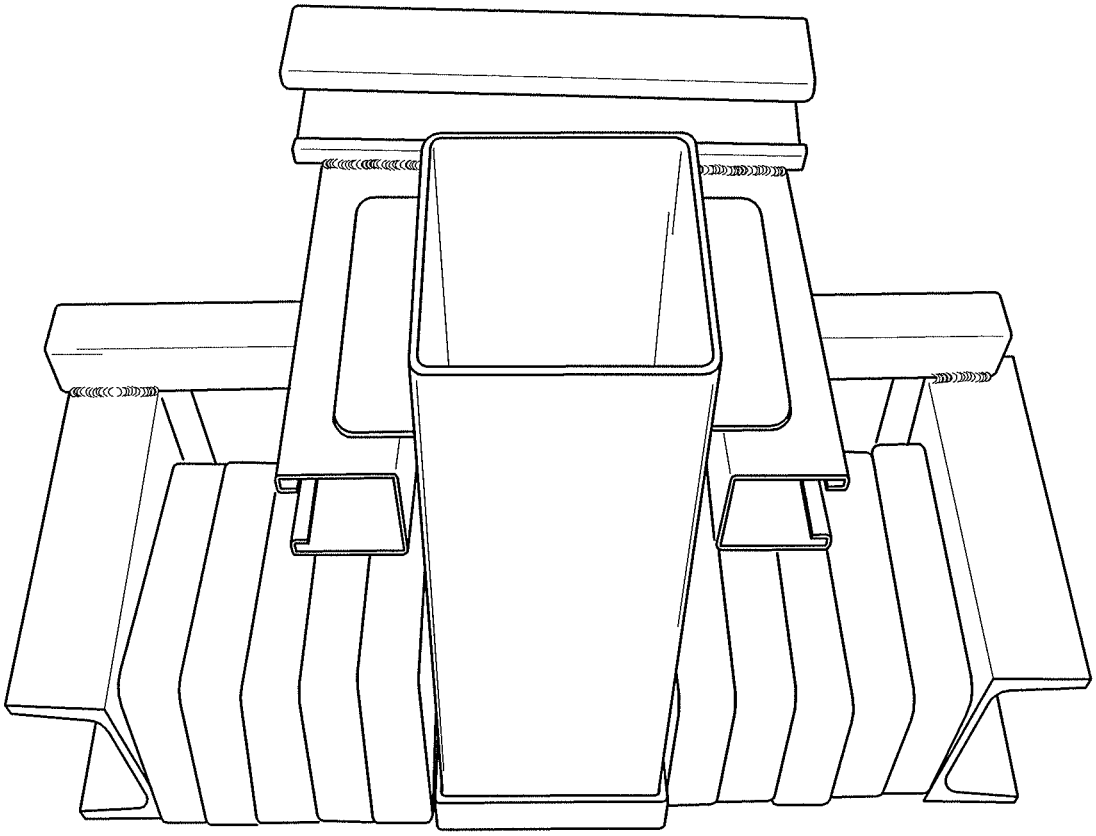
FIG. 28 is another perspective view of the bench tester of FIG. 27.

FIGS. 27 and 28 are drawings of the bench tester, and show the arrangement of the magnet sets and the stainless steel box.

To prepare a treatment fluid for testing, 500 grams of raw tailings feed was placed in a one inch deep 12 inch diameter steel pan and dried for ten minutes at 250 degrees Fahrenheit until completely dry. The dried material was then screened at 30 mesh to remove the oversize particles and produce a minus 30 mesh material fraction (also referred to herein as "on size material").

200 grams of on size material was measured out and mixed with 600 mL of water to make slurry, which was swirled to keep the solid material in suspension, and which was poured into the stainless steel box while the box was positioned in the magnetic zone of the bench tester. Water was then sprayed into the top of the stainless steel box while the box was positioned in the magnetic zone to wash out the non magnetic tailings. The material collected below the stainless steel box became the final tailing fraction in modes where rougher scavenging was not simulated.

The stainless steel box was then taken out of the magnetic zone and the concentrate was washed out of the box into a bucket to produce the first pass magnetic save material (rougher stage).

Next, the stainless steel box was placed back in the magnetic zone as depicted in FIGS. 27 and 28, and the first pass concentrate was poured into the box for a second pass (finisher stage). The same procedure as described above was repeated for washing out the tailings and concentrate; however, the finisher tailings fraction from this step was saved. The finisher concentrate was then treated by a third pass through the magnetic zone to make a final concentrate (cleaner stage). The cleaner tailings fraction from this step was also saved. The finisher tailings fraction and the cleaner tailings fraction were combined and treated by a single pass of scavenging to produce a scavenger concentrate.

The scavenger concentrate with the cleaner concentrate were combined to provide a mixture. The mixture was pressure-filtered and then oven dried and weighed. To calculate overall weight recovery, total grams of dried total concentrate was divided by the starting weight of 200 grams of feed material. The total combined concentrate was then sent to an analytical laboratory for measurement of iron and silica content.

Dozens of tests have been run using the protocol described above, including tests to determine optimal matrix type. For example, wire mesh matrix has been compared to matrix comprised of various discrete objects, including steel balls ranging in size from #8 shot up to ½ inch diameter. Other discrete objects such as hex nuts of various sizes were also tested. Evaluation criteria for best performance included a weight recovery parameter and a concentrate grade of 64% Fe dry basis or higher.

Experimental Results

The data in Table I is a summary of results using a feed mixture of 45% Fe content sized at 100% passing 30 mesh and a standard test protocol of three stages of separation as described above (roughing, finishing, and cleaning with scavenging only of finisher and cleaner tails—no scavenging of rougher tails).

TABLE I

| Matrix Type Tested | Wt Recovery (dry basis) | Conc. Grade (Fe %) |
|---|---|---|
| 5/16" size shot | 26% | 65.6% |
| 4 × 4 wire mesh | 11% | 67.0% |
| ¼" size shot | 33% | 64.0% |

The data in Table II is a summary of results using a feed mixture of 45% Fe content sized at 100% passing 30 mesh and a test protocol that included two stages of separation (roughing and finishing together with scavenging of finisher tails—no scavenging of rougher tails).

TABLE II

| Matrix Type Tested | Wt Recovery (dry basis) | Conc. Grade (Fe %) |
|---|---|---|
| F size shot (.22 inch diameter) | 37% | 62.6% |
| ¼" size hex nuts | 30% | 62.0% |
| 4 × 4 wire meshes | 13% | 66.2%. |

Ball Mill Grinding Evaluation

Raw tailings with 48% Fe content were ground in a ball mill for three different periods of time, as follows: 6 minutes, 10 minutes and 18 minutes. The ground material was then tested using the protocol described above. The data in Table III is a summary of test results obtained using two stages of separation plus one stage of scavenging of the finisher tails as described above:

TABLE III

| Amount of Grinding | Wt Recovery (dry basis) | Conc. Grade (Fe %) |
|---|---|---|
| 6 minute grind | 55% | 64.7% |
| 10 minute grind | 50% | 64.6% |
| 18 minute grind | 44% | 62.65. |

While the invention has been illustrated and described in detail in the drawings and foregoing description, the same is to be considered as illustrative and not restrictive in character, it being understood that only the preferred embodiments have been shown and described and that all changes and modifications that come within the spirit of the invention are desired to be protected.

What is claimed is:

1. A high intensity magnetic separation device for separating treatment slurry including magnetic particles and non-magnetic particles suspended in water into a concentrate fraction and a tailings fraction, said device comprising:

a first generally horizontal rotor rotatable about a first generally vertical axis, said first rotor defining a first circular channel rotatable about the first axis, said first channel defining a flow path through said first rotor and containing a matrix material therein, wherein the first channel is configured to allow passage of a downwardly moving fluid stream therethrough in contact with the matrix material;

a first rigid support frame operable to support said first rotor;

a first driver mounted to said first support frame, said first driver operable to rotate said first rotor at a generally constant rate;

a first plurality of permanent magnet members fixedly attached to said first support frame, the first permanent magnet members positioned to straddle said first channel at a plurality of locations spaced apart along the circular path of said first channel, the first magnet members effective to apply magnetic fields across a plurality of portions of said path where said first channel is straddled by the first permanent magnet members, said portions defining a plurality of magnetic zones, said magnetic zones being separated along said circular path by nonmagnetic zones, thereby providing a repeating series of separation zones and nonmagnetic zones along said circular path;

a first plurality of feed conduits for delivering a treatment slurry into the first channel at a plurality of input locations, each input location being positioned within one of the plurality of magnetic zones defined by said first plurality of permanent magnet members;

a first plurality of water delivery conduits for delivering water into the first channel at a plurality of locations within, the magnetic zones and within the nonmagnetic zones defined by said first plurality of permanent magnet members; and a first plurality of tailings launders and a first plurality of concentrate launders positioned beneath said first channel; said first tailings launders positioned beneath said magnetic zones for receiving a first tailings fraction of the treatment slurry that passes through the first channel in said magnetic zones; and said first concentrate launders positioned beneath said nonmagnetic zones for receiving a first concentrate fraction of the treatment slurry that passes through the first channel in said nonmagnetic zones;

wherein said first rotor further comprises a foraminous channel floor operable to allow passage of the first tailings fraction therethrough as the first tailings fraction exits said first channel, and wherein said matrix material comprises a plurality of discrete magnetically susceptible objects sized to be retained in said first channel by said channel floor;

wherein said first rotor further comprises a plurality of vertical radial separating walls in said first channel, said separating walls dividing said first channel into a plurality of arc-shaped channel segments;

wherein said floor of at least one of said channel segments comprises a drop-in screen sized and shaped to fit within one of said channel segments; and wherein said first rotor defines a first plurality of connected and spaced apart circular channels rotatable about the axis, each of said first plurality of channels defining a flow path through the first rotor and containing a matrix material therein, wherein each of said first plurality of channels is configured to allow passage of a downwardly moving fluid stream in contact with the matrix material contained therein.

2. The device in accordance with claim 1 wherein the drop-in screen comprises a substantially rigid non-magnetic material.

3. The device in accordance with claim 2 wherein the drop-in screen comprises a material selected from the group consisting of stainless steel, aluminum and polyurethane.

4. The device in accordance with claim 1 wherein the drop-in screen comprises at least three support bars and a plurality of generally wedge-shaped screen bars oriented generally perpendicular to the support bars and affixed to the support bars.

5. The device in accordance with claim 4 wherein the at least two adjacent ones of the plurality of screen bars each comprises a first surface having a first draft angle relative to the general direction of slurry flow therethrough and a second surface having a second draft angle relative to the general direction of slurry flow therethrough, wherein a first surface of a first screen bar and a second surface of a second screen bar defines a space between the first and second screen bars having dimensions that are greater at a bottom side of said screen than at a top side of said screen When said screen is oriented for operation.

6. The device in accordance with claim 4 wherein the drop-in screen comprises six support bars.

7. The device in accordance with claim 4 wherein the screen bars are affixed to an underside of the support bars when said screen is oriented for operation.

8. The device in accordance with claim 4 wherein the screen bars are affixed to an upper side of the support bars when said screen is oriented for operation.

9. The device in accordance with claim 1 wherein the drop-in screen comprises an integral body defining a plurality of slots, at least one said slot having a first angled side surface and a second angled side surface, the first and second side surfaces defining downward-opening draft angles when said screen is oriented for operation.

10. The device in accordance with claim 1 wherein said first channel is defined by a first trough having first and second vertical side walls, and wherein the radial separating walls are sized such that a top of at least one of said radial separating walls is from about two to about six inches below the tops of said first and second vertical side walls.

11. The device in accordance with claim 1 wherein said magnetically susceptible objects comprise a material selected from the group consisting of steel, iron and an iron alloy.

12. The device in accordance with claim 1 wherein said magnetically susceptible objects comprise one or more members selected from the group consisting of shot, hex nuts, bolts, nails, washers, rod segments, cubes, blocks, cylinders, wire pieces, wire stars and pieces of wire mesh.

13. The device in accordance with claim 1 wherein said first channel is defined by a first trough, and wherein said first channel has a sufficient height to provide a distance of at least six inches between the top of the magnetic objects positioned in said channels and the top of said trough.

14. The device in accordance with claim 1, further comprising a plurality of jump magnets positioned adjacent said first channel at a trailing edge of a plurality of said magnetic zones relative to the rotation of said first rotor.

15. The device in accordance with claim 14 wherein said jump magnets are adjustably mounted to said rigid frame or to said magnet members.

16. The device in accordance with claim 15 wherein said jump magnets are affixed to said permanent magnet members in a manner whereby said jump magnets are vertically and horizontally adjustable.

17. The device in accordance with claim 1 wherein said first plurality of water delivery conduits comprises at least one underspray nozzle for delivering water into the first channel from a locations beneath the first channel.

18. The device in accordance with claim 1 wherein at least one of said first plurality of tailings launders and said first plurality of concentrate launders includes a launder outlet that is connected to a hose.

19. The device in accordance with claim 18 wherein a reducer is connected to at least one of said launder outlets and to said corresponding hose.

20. A high intensitv magnetic separation device for separating a treatment slurry including magnetic particles and nonmagnetic particles suspended in water into a concentrate fraction and a tailings fraction, said device comprising:

a first generally horizontal rotor rotatable about a first generally vertical axis, said first rotor defining a first circular channel rotatable about the first axis, said first channel defining a flow path through said first rotor and containing a matrix material therein, wherein the first channel is configured to allow passage of a downwardly moving fluid stream therethrough in contact with the matrix material;

a first rigid support frame operable to support said first rotor;

a first driver mounted to said first support frame said first driver operable to rotate said first rotor at a generally constant rate;

a first plurality of permanent magnet members fixedly attached to said first support frame, the first permanent magnet members positioned to straddle said first channel at a plurality of locations spaced apart along the circular path of said first channel, the first magnet members effective to apply magnetic fields across a plurality of portions of said path where said first channel is straddled by the first permanent magnet members, said portions defining a plurality of magnetic zones, said magnetic zones being separated along said circular path by nonmagnetic zones, thereby providing a repeating series of separation zones and nonmagnetic zones along said circular path;

a first plurality of feed conduits for delivering a treatment slurry into the first channel at a plurality of input locations, each input location being positioned within one of the plurality of magnetic zones defined by said first plurality of permanent magnet members;

a first plurality of water delivery conduits for delivering water into the first channel at a plurality of locations within the magnetic zones and within the nonmagnetic zones defined by said first plurality of permanent magnet members; and a first plurality of tailings launders and a first plurality of concentrate launders positioned beneath said first channel; said first tailings launders positioned beneath said magnetic zones for receiving a first tailings fraction of the treatment slurry that passes through the first channel in said magnetic zones; and said first concentrate launders positioned beneath said nonmagnetic zones for receiving a first concentrate fraction of the treatment slurry that passes through the first channel in said nonmagnetic zones;

wherein said first rotor further comprises a foraminous channel floor operable to allow passage of the first tailings fraction therethrough as the first tailings fraction exits said first channel, and wherein said matrix material comprises a plurality of discrete magnetically susceptible objects sized to be retained in said first channel by said channel floor;

wherein said first rotor further comprises a plurality of vertical radial separating walls in said first channel, said separating walls dividing said first channel into a plurality of arc-shaped channel segments; and wherein said water delivery system further comprises:

at least one water delivery nozzle mounted to a vertically reciprocating carriage; and a control system operable to intermittently lower the water delivery nozzle to an elevational position below the tops of the respective side walls of said first channel and below the tops of two adjacent radially-oriented separating walls and intermittently raise the water delivery nozzle to an elevational position above the top of a separating wall passing thereunder.

21. A high intensity magnetic separation device for separating a treatment slurry including magnetic particles and nonmagnetic particles suspended in water into a concentrate fraction and a tailings fraction, said device comprising:

a first generally horizontal rotor rotatable about a first generally vertical axis, said first rotor defining a first circular channel rotatable about the first axis, said first channel defining a flow path through said first rotor and containing a matrix material therein, wherein the first channel is configured to allow passage of a downwardly moving fluid stream therethrough in contact with the matrix material;

a first rigid support frame operable to support said first rotor;

a first driver mounted to said first support frame said first driver operable to rotate said first rotor at a generally constant rate;

first plurality of permanent magnet members fixedly attached to said first support frame, the first permanent magnet members positioned to straddle said first channel at a plurality of locations spaced apart along the circular path of said first channel, the first magnet members effective to apply magnetic fields across a plurality of portions of said path where said first channel is straddled by the first permanent magnet members, said portions defining a plurality of magnetic zones, said magnetic zones being separated along said circular path by nonmagnetic zones, thereby providing a repeating series of separation zones and nonmagnetic zones along said circular path;

a first plurality of feed conduits for delivering a treatment slurry into the first channel at a plurality of input locations, each input location being positioned within one of the plurality of magnetic zones defined by said first plurality of permanent magnet members;

a first plurality of water delivery conduits for delivering water into the first channel at a plurality of locations within the magnetic zones and within the nonmagnetic zones defined by said first plurality of permanent magnet members; and a first plurality of tailings launders and a first plurality of concentrate launders positioned beneath said first channel; said first tailings launders positioned beneath said magnetic zones for receiving a first tailings fraction of the treatment slurry that passes through the first channel in said magnetic zones; and said first concentrate launders positioned beneath said nonmagnetic zones for receiving a first concentrate fraction of the treatment slurry that passes through the first channel in said nonmagnetic zones;

wherein said first rotor further comprises a foraminous channel floor operable to allow passage of the first tailings fraction therethrough as the first tailings fraction exits said first channel, and wherein said matrix material comprises a plurality of discrete magnetically susceptible objects sized to be retained in said first channel by said channel floor;

wherein said first rotor further comprises a plurality of vertical radial separating walls in said first channel, said separating walls dividing said first channel into a plurality of arc-shaped channel segments; and wherein said first rotor comprises a support frame including an inner support frame component, and outer support frame component and a plurality of radial support frame components rigidly connected to said inner support frame component and said outer support frame component; and wherein said first driver comprises at least three thrust wheels positioned to engage said outer support frame component.

22. A high intensity magnetic separation device for separating a treatment slurry including magnetic particles and nonmagnetic particles suspended in water into a concentrate fraction and a tailings fraction, said device comprising;

a first generally horizontal rotor rotatable about a first generally vertical axis, said first rotor defining a first circular channel rotatable about the first axis, said first channel defining a flow path through said first rotor and containing a matrix material therein, wherein the first channel is configured to allow passage of a downwardly moving fluid stream therethrough in contact with the matrix material;

a first rigid support frame operable to support said first rotor;

a first driver mounted to said first support frame, said first driver operable to rotate said first rotor at a generally constant rate;

a first plurality of permanent magnet members fixedly attached to said first support frame, the first permanent magnet members positioned to straddle said first channel at a plurality of locations spaced apart along the circular path of said first channel, the first magnet members effective to apply magnetic fields across a plurality of portions of said path where said first channel is straddled by the first permanent magnet members, said portions defining plurality of magnetic zones, said magnetic zones being separated along said circular path by nonmagnetic zones, thereby providing a repeating series of separation zones and nonmagnetic zones along said circular path;

a first plurality of feed conduits for delivering a treatment slurry into the first channel at a plurality of input locations, each input location being positioned within one of the plurality of magnetic zones defined by said first plurality of permanent magnet members;

a first plurality of water delivery conduits for delivering water into the first channel at a plurality of locations within the magnetic zones and within the nonmagnetic zones defined by said first plurality of permanent magnet members; and a first plurality of tailings launders and a first plurality of concentrate launders positioned beneath said first channel; said first tailings launders positioned beneath said magnetic zones for receiving a first tailings fraction of the treatment slurry that passes through the first channel in said magnetic zones; and said first concentrate launders positioned beneath said nonmagnetic zones for receiving a first concentrate fraction of the treatment slurry that passes through the first channel in said nonmagnetic zones;

wherein said first rotor further comprises a foraminous channel floor operable to allow passage of the first tailings fraction therethrough as the first tailings fraction exits said first channel, and wherein said matrix material comprises a plurality of discrete magnetically susceptible objects sized to be retained in said first channel by said channel floor;

wherein said first rotor further comprises a plurality of vertical radial separating walls in said first channel, said separating walls dividing said first channel into a plurality of arc-shaped channel segments; and wherein each of said first plurality of tailings launders is separated from a corresponding one of said first plurality of concentrate launders by a dividing wall; and wherein said dividing wall is configured to be horizontally adjustable.

23. A high intensity magnetic separation device for separating a treatment slurry including magnetic particles and nonmagnetic particles suspended in water into a concentrate fraction and a tailings fraction, said device comprising:

a first generally horizontal rotor rotatable about a first generally vertical axis, said first rotor defining a first circular channel rotatable about the first axis, said first channel defining a flow path through said first rotor and containing a matrix material therein, wherein the first channel is configured to allow passage of a downwardly moving fluid stream therethrough in contact with the matrix material;

a first rigid support frame operable to support said first rotor;

a first driver mounted to said first support frame, said first driver operable to rotate said first rotor at a generally constant rate;

a first plurality of permanent magnet members fixedly attached to said first support frame, the first permanent magnet members positioned to straddle said first channel at a plurality of locations spaced apart along the circular path of said first channel, the first magnet members effective to apply magnetic fields across a plurality of portions of said path where said first channel is straddled by the first permanent magnet members, said portions defining a plurality of magnetic zones, said magnetic zones being separated along said circular path by nonmagnetic zones, thereby providing a repeating series of separation zones and nonmagnetic zones along said circular path;

a first plurality of feed conduits for delivering a treatment slurry into the first channel at a plurality of input locations, each input location being positioned within one of the plurality of magnetic zones defined by said first plurality of permanent magnet members;

a first plurality of water delivery conduits for delivering water into the first channel at a plurality of locations within the magnetic zones and within the nonmagnetic zones defined by said first plurality of permanent magnet members;

a first plurality of tailings launders and a first plurality of concentrate launders positioned beneath said first channel; said first tailings launders positioned beneath said magnetic zones for receiving a first tailings fraction of the treatment slurry that passes through the first channel in said magnetic zones; and said first concentrate launders positioned beneath said nonmagnetic zone for receiving a first concentrate fraction of the treatment slurry that passes through the first channel in said nonmagnetic zones; and a control system operable to periodically activate pulses of higher pressure, higher flow rate or a combination thereof, through one or more of said water delivery conduits;

wherein said first rotor further comprises a foraminous channel floor operable to allow passage of the first tailings fraction therethrough as the first tailings fraction exits said first channel, and wherein said matrix material comprises a plurality of discrete magnetically susceptible objects sized to be retained in said first channel by said channel floor; and wherein said first rotor further comprises a plurality of vertical radial separating walls in said first channel, said separating walls dividing said first channel into a plurality of arc-shaped channel segments.

24. A high intensity magnetic separation device for separating a treatment slurry including magnetic particles and nonmagnetic particles suspended in water into a concentrate fraction and a tailings fraction, said device comprising:

a first generally horizontal rotor rotatable about a first generally vertical axis, said first rotor defining a first circular channel rotatable about the first axis, said first channel defining a flow path through said first rotor and containing a matrix material therein, wherein the first channel is configured to allow passage of a downwardly moving fluid stream therethrough in contact with the matrix material;

a first rigid support frame operable to support said first rotor;

a first driver mounted to said first support frame, said first driver operable to rotate said first rotor at a generally constant rate;

a first plurality of permanent magnet members fixedly attached to said first support frame, the first permanent magnet members positioned to straddle said first channel at a plurality of locations spaced apart along the circular path of said first channel, the first magnet members effective to apply magnetic fields across a plurality of portions of said path where said first channel is straddled by the first permanent magnet members, said portions defining a plurality of magnetic zones, said magnetic zones being separated along said circular path by nonmagnetic zones, thereby providing a repeating series of separation zones and nonmagnetic zones along said circular path;

a first plurality of feed conduits for delivering a treatment slurry into the first channel at a plurality of input locations, each input location being positioned within one of the plurality of magnetic zones defined by said first plurality of permanent magnet members;

a first plurality of water delivery conduits for delivering water into the first channel at a plurality of locations within the magnetic zones and within the nonmagnetic zones defined by said first plurality of permanent magnet members;

a first plurality of tailings launders and a first plurality of concentrate launders positioned beneath said first channel; said first tailings launders positioned beneath said magnetic zones for receiving a first tailings fraction of the treatment slurry that passes through the first channel in said magnetic zones; and said first concentrate launders positioned beneath said nonmagnetic zones for receiving a first concentrate fraction of the treatment slurry that passes through the first channel in said nonmagnetic zones; and a control system comprising:

an agitation indication module structured to interpret an agitation indicator;

an agitation planning module structured to provide an agitation control command in response to the agitation indicator; and an agitating module structured to agitate contents of at east one channel segment in response to the agitation control command;

wherein said first rotor further comprises a foraminous channel floor operable to allow passage of the first tailings fraction therethrough as the first tailings fraction exits said first channel, and wherein said matrix material comprises a plurality of discrete magnetically susceptible objects sized to be retained in said first channel by said channel floor; and wherein said first rotor further comprises a plurality of vertical radial separating walls in said first channel, said separating walls dividing said first channel into a plurality of arc-shaped channel segments.

25. The device in accordance with claim 24, wherein the agitation indication module is further structured to interpret the agitation indicator in response to at least one of the following operations:

determining that a predetermined time period has elapsed;

determining that a predetermined operating time period has elapsed;

determining that a predetermined quantity of material has been processed;

determining that a flow rate in the system is below a threshold value; and determining that a channel segment has an effluent characteristic consistent with a cleanout indication.

26. The device in accordance with claim 24 wherein the agitation module is further structured to agitate contents of at least one channel segment by providing an operator visible instruction, the operator visible instruction comprising at least one of the following instructions:

a valve indication comprising a valve identifier, a valve modulation command, and/or a valve modulation time; and an actuator indication comprising an actuator identifier, an actuator modulation command, and/or an actuator modulation time.

27. The device in accordance with claim 24 wherein the agitation planning module is further structured to determine at least one of a pressure pulse description and a flow rate description in response to the agitation indicator.

28. The device in accordance with claim 27, wherein the agitating module is further structured to operate one or more actuators in response to the pressure pulse description and/or flow rate description.

29. A high intensity magnetic separation device for separating a treatment slurry including magnetic particles and nonmagnetic particles suspended in water into a concentrate fraction and a tailings fraction, said device comprising:

a first generally horizontal rotor rotatable about a first generally vertical axis, said first rotor defining a first circular channel rotatable about the first axis, said first channel defining a flow path through said first rotor and containing a matrix material therein, wherein the first channel is configured to allow passage of a downwardly moving fluid stream therethrough in contact with the matrix material;

a first rigid support frame operable to support said first rotor;

a first driver mounted to said first support frame, said first driver operable to rotate said first rotor at a generally constant rate;

a first plurality of permanent magnet members fixedly attached to said first support frame, the first permanent magnet members positioned to straddle said first channel at a plurality of locations spaced apart along the circular path of said first channel, the first magnet members effective to apply magnetic fields across a plurality of portions of said path where said first channel is straddled by the first permanent magnet members, said portions defining a plurality of magnetic zones, said magnetic zones being separated along said circular path by nonmagnetic zones, thereby providing a repeating series of separation zones and nonmagnetic zones alone said circular path;

a first plurality of feed conduits for delivering a treatment slurry into the first channel at a plurality of input locations, each input location being positioned within one of the plurality of magnetic zones defined by said first plurality of permanent magnet members;

a first plurality of water delivery conduits for delivering water into the first channel at a plurality of locations within the magnetic zones and within the nonmagnetic zones defined by said first plurality of permanent magnet members;

a first plurality of tailings launders and a first plurality of concentrate launders positioned beneath said first channel; said first tailings launders positioned beneath said magnetic zones for receiving a first tailings fraction of the treatment slurry that passes through the first channel in said magnetic zones; and said first concentrate launders positioned beneath said nonmagnetic zones for receiving a first concentrate fraction of the treatment slurry that passes through the first channel in said nonmagnetic zones;

a second generally horizontal rotor rotatable about the first axis or a second generally vertical axis, said second rotor defining a second circular channel rotatable about the first or second axis, said channel defining a flow path through said second rotor and containing a matrix material therein, wherein the second channel is configured to allow passage of a downwardly moving fluid stream in contact with the matrix material;

a second rigid support frame operable to support said second rotor;

a second driver mounted to said second support frame, said second driver operable to rotate said second rotor at a generally constant rate;

a second plurality of permanent magnet members fixedly attached to said second support frame, the second permanent magnet members positioned to straddle said second channel at a plurality of locations spaced apart along the circular path of said second channel, the second magnet members effective to apply magnetic fields across a plurality of portions of said path where said second channel is straddled by the second permanent magnet members, said portions defining a plurality of separations zones, said separation zones being separated along said circular path by nonmagnetic zones, thereby providing a repeating series of separation zones and nonmagnetic zones along said circular path;

a second plurality of feed conduits for delivering one or both of the first concentrate fraction and the first tailings fraction into the second channel at a plurality of input locations, each input location being positioned within one of the plurality of separation zones of the second channel defined by said second plurality of permanent magnet members;

a second plurality of water delivery conduits for delivering water into the second channel at a plurality of locations within the separation zones and within the nonmagnetic zones defined by said second plurality of permanent magnet members; and a second plurality of tailings launders and a second plurality of concentrate launders positioned beneath said second channel; said second tailings launders positioned beneath said separation zones for receiving a second tailings fraction that passes through the second channel in said separation zones; and said second concentrate launders positioned beneath said nonmagnetic zones for receiving a second concentrate fraction that passes through the second channel in said nonmagnetic zones;

wherein said first rotor further comprises a foraminous channel floor operable to allow passage of the first tailings fraction therethrough as the first tailings fraction exits said first channel, and wherein said matrix material comprises a plurality of discrete magnetically susceptible objects sized to be retained in said first channel by said channel floor;

wherein said first rotor further comprises a plurality of vertical radial separating walls in said first channel, said separating walls dividing said first channel into a plurality of arc-shaped channel segments;

wherein said floor of at least one of said channel segments comprises a drop-in screen sized and shaped to fit within one of said channel segments; and wherein at least one of said first and second rotors defines a plurality of connected and spaced apart circular channels rotatable about the first or second axis, each of said first or second plurality of channels defining a flow path through the first or second rotor and containing a matrix material therein, wherein each of said first or second plurality of channels is configured to allow passage of a downwardly moving fluid stream in contact with the matrix material contained therein.

30. The device in accordance with claim 29 wherein said second rigid support frame is integral with said first rigid support frame.

31. The device in accordance with claim 30 wherein both of said first and second rotors are rotatable about said first axis.

32. The device in accordance with claim 30 wherein said first rotor is positioned above said second rotor.

33. A system, comprising:

a horizontally oriented rotor having a circular channel positioned thereon, the circular channel having a slurry-permeable floor and a discrete object matrix positioned therein, wherein the discrete object matrix comprises a plurality of shaped objects, each of the shaped object having a magnetic characteristic that is one of magnetic and magnetically susceptible;

a drive mechanism operationally coupled to the rotor;

a permanent magnet rotationally independent from the rotor, wherein the permanent magnet is positioned to apply a magnetic field across the circular channel over a range of angular positions of the rotor;

a feed conduit structured to deliver a treatment slurry into the first channel;

a first water delivery conduit structured to deliver water into the first channel from above said first channel;

a second water delivery conduit structured to deliver water into the first channel from below said first channel;

a tailings launder positioned beneath the circular channel within the range of angular positions of the rotor; and a concentrate launder positioned beneath the circular channel outside the range of angular positions of the rotor.

34. The system in accordance with claim 33, further comprising a jolting device structured to move at least one of the shaped objects within the circular channel.

35. The system in accordance with claim 34 wherein the jolting device comprises at least one device selected from the devices consisting of: a jump magnet, a rumble strip positioned in a movement path of a wheel supporting the rotor, a bump positioned in a movement path of a wheel supporting the rotor, and a vibrator operationally coupled to the circular channel.

36. A system, comprising:

a horizontally oriented rotor having a circular channel positioned thereon, the circular channel having a slurry-permeable floor and a discrete object matrix positioned therein, wherein the discrete object matrix comprises a plurality of shaped objects, each of the shaped object having a magnetic characteristic that is one of magnetic and magnetically susceptible;

a drive mechanism operationally coupled to the rotor;

a permanent magnet rotationally independent from the rotor, wherein the permanent magnet is positioned to apply a magnetic field across the circular channel over a range of angular positions of the rotor;

a feed conduit structured to deliver a treatment slurry into the first channel;

a water delivery conduit structured to deliver water into the first channel;

a tailings launder positioned beneath the circular channel within the range of angular positions of the rotor; and a concentrate launder positioned beneath the circular channel outside the range of angular positions of the rotor;

wherein tailings launder is separated from said concentrate launder by a dividing wall; and wherein said dividing wall is configured to be horizontally adjustable.

37. The system in accordance with claim 36, further comprising a jolting device structured to move at least one of the shaped objects within the circular channel.

38. The system in accordance with claim 37 wherein the jolting device comprises at least one device selected from the devices consisting of: a jump magnet, a rumble strip positioned in a movement path of a wheel supporting the rotor, a bump positioned in a movement path of a wheel supporting the rotor, and a vibrator operationally coupled to the circular channel.

* * * * *